US005475364A

United States Patent [19]

Kenet

[11] Patent Number: 5,475,364

[45] **Date of Patent: * Dec. 12, 1995**

[54] ROOM OCCUPANCY FIRE ALARM INDICATOR MEANS AND METHOD

[75] Inventor: Ran Kenet, Thornhill, Canada

[73] Assignee: Electronic Environmental Controls Inc., Toronto, Canada

[ * ] Notice: The portion of the term of this patent subsequent to May 3, 2011, has been disclaimed.

[21] Appl. No.: 235,628

[22] Filed: Apr. 28, 1994

Related U.S. Application Data

[62] Division of Ser. No. 950,363, Sep. 24, 1992, Pat. No. 5,309,146, which is a division of Ser. No. 470,294, Jan. 25, 1990, Pat. No. 5,165,465, which is a continuation-in-part of Ser. No. 259,904, Oct. 19, 1988, abandoned.

[30] Foreign Application Priority Data

May 3, 1988 [CA] Canada ..... 565830

[51] Int. Cl.[6] ..... G08B 13/19; G08B 21/00

[52] U.S. Cl. ..... 340/522; 340/525; 340/567; 340/587; 340/691

[58] Field of Search ..... 340/521, 522, 340/540, 567, 628, 691, 573, 525, 587, 589, 584

[56] References Cited

U.S. PATENT DOCUMENTS

| | | | |
|---|---|---|---|
| 3,255,441 | 6/1966 | Goodwin et al. | 340/589 |
| 3,560,950 | 2/1971 | Peters | 340/567 |
| 4,149,159 | 4/1979 | Dätwyler et al. | 340/584 |
| 4,242,672 | 12/1980 | Gault | 340/573 |
| 4,590,460 | 5/1986 | Abbott et al. | 340/522 |
| 4,933,667 | 6/1990 | Shaw et al. | 340/525 |
| 5,057,818 | 10/1991 | Tennefoss | 340/525 |
| 5,309,146 | 5/1994 | Kenet | 340/540 |

*Primary Examiner*—Glen Swann
*Attorney, Agent, or Firm*—Bereskin & Parr

[57] ABSTRACT

Rooms in a building each have a heating, ventilating and air conditioning system (HVAC), a room control unit having a temperature controller, and various sensors. The control unit monitors the presence of persons in the room, determines the season, sets back the temperature in an empty room by a variable amount which the HVAC can restore in a given time, and restores the temperature to the previous user request when the user returns but to a standard temperature if the user has newly checked in. An outside hallway panel briefly displays, when interrogated by a maid, a person's presence. By monitoring maid requests, door status and maid activity, the unit indicates on a room map whether the room is being cleaned, clean, or ready to rent. By establishing the heat loss/gain (l/g) factor of a room with the HVAC off and comparing it with the time to heat or cool the room, HVAC failures are determined. By comparing a room's l/g factor with those of its neighbors, room environment failures are determined. A fire alarm is displayed immediately if more than one unit or more than one sensor reports fire; otherwise a fire alarm display is delayed briefly to reduce false alarms. Fire spreading is displayed on a screen room map showing in red rooms over a certain temperature. For fire, the hallway panels indicate those rooms where a person is present.

14 Claims, 63 Drawing Sheets

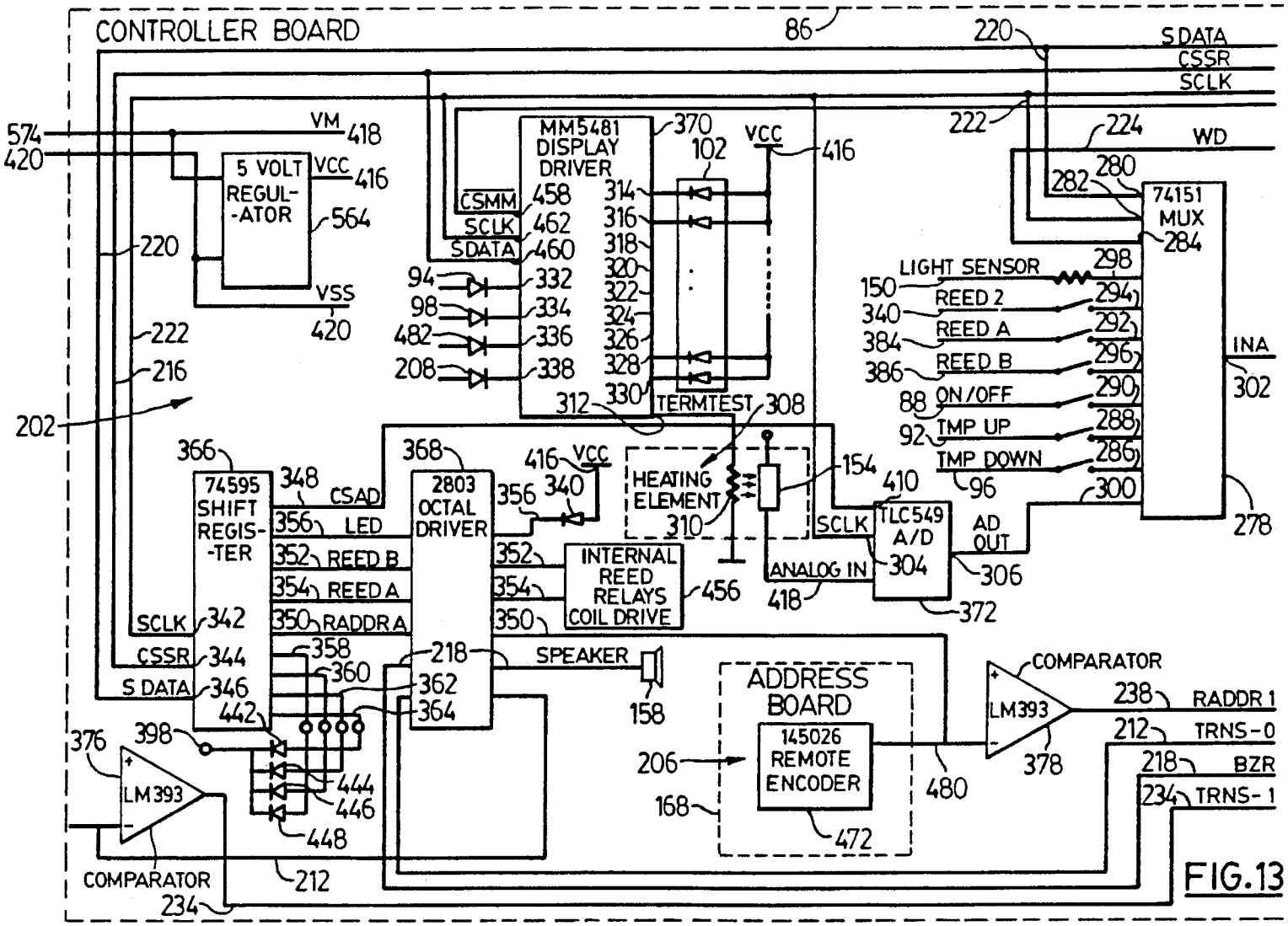
CONTROLLER BOARD
S DATA
CSSR
SCLK
WD
74151 MUX
INA
LIGHT SENSOR
REED 2
REED A
REED B
ON/OFF
TMP UP
TMP DOWN
AD OUT
TLC549 A/D
SCLK
ANALOG IN
TERMTEST
HEATING ELEMENT
VCC
MM5481 DISPLAY DRIVER
CSMM
SCLK
SDATA
INTERNAL REED RELAYS COIL DRIVE
SPEAKER
2803 OCTAL DRIVER
CSAD
LED
REED B
REED A
RADDR A
74595 SHIFT REGIS-TER
SCLK
CSSR
S DATA
5 VOLT REGUL-ATOR
VM
VCC
VSS
COMPARATOR
LM393
RADDR 1
TRNS-0
BZR
TRNS-1
ADDRESS BOARD
145026 REMOTE ENCODER
FIG.13

| | |
|---|---|
| 2572 | HEADER BYTE |
| 2574 | LOWER ADDRESS BYTE |
| 2576 | UPPER ADDRESS BYTE |
| 2578 | COMMAND CODE |
| 2580 | ROOM PARAMETER DATA_1 |
| 2582 | ROOM PARAMETER DATA_2 |
| 2584 | ROOM PARAMETER DATA_3 |
| 2586 | ROOM PARAMETER DATA_4 |
| 2588 | ROOM PARAMETER DATA_5 |
| 2590 | ROOM PARAMETER DATA_6 |
| 2592 | EVEN BYTE CHECKSUM |
| 2594 | ODD BYTE CHECKSUM |

2570

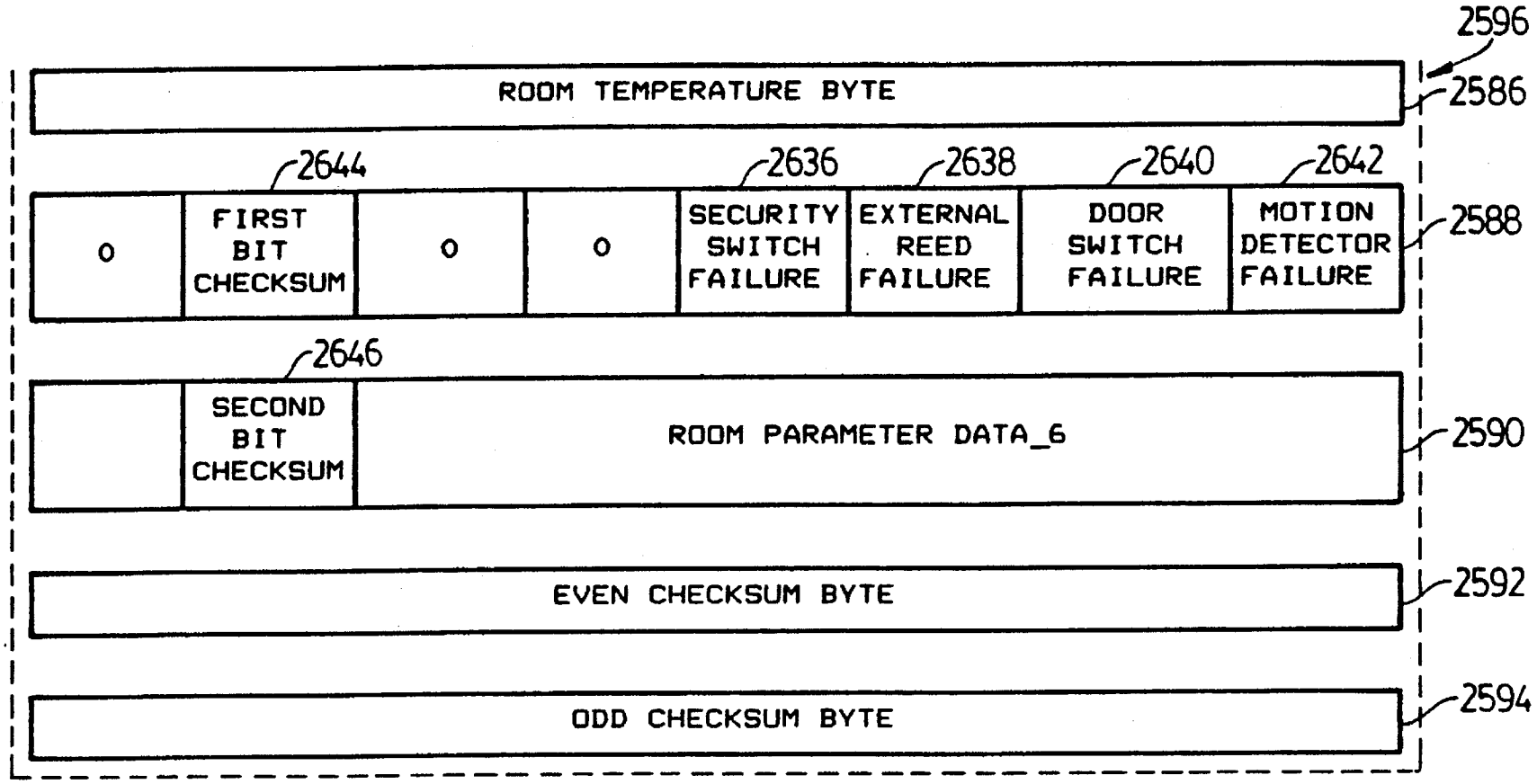
FIG. 49Aii

ROOM OCCUPANCY FIRE ALARM INDICATOR MEANS AND METHOD

This is a divisional of application Ser. No. 07/950,363 filed Sep. 24, 1992, now U.S. Pat. No. 5,309,146, which is a divisional of application Ser. No. 07/470,294 filed on Jan. 25, 1990, now U.S. Pat. No. 5,165,465, which is a continuation-in-part of application Ser. No. 259,904 filed on Oct. 19, 1988, now abandoned.

FIELD OF THE INVENTION

This invention relates to a room monitoring and control system for use in buildings such as hotels, office complexes, apartments, and in other structures in which there are rooms.

BACKGROUND OF THE INVENTION

In the operation of buildings such as hotels, apartments, condominiums, office buildings, and other structures in which rooms exist and where persons such as residents, visitors or others may be present, there are many rooms which at any given moment may or may not be occupied, may or may not require cleaning, and may or may not require heating or cooling. In addition all such rooms should be monitored for smoke and fire.

The present description will deal with a hotel as a typical application of the invention. However the invention is applicable to other buildings and structures containing a number of separate rooms.

In the past, some of the functions referred to above have been carried out in hotels by the hotel staff, or by reference to an accounting computer recording check-outs and check-ins, and by the use of door signs such as "Do Not Disturb". Some of the functions have been carried out by essentially independent systems, such as fire alarm systems, air conditioning systems, and the like.

Past methods of monitoring and carrying out the above functions are well known to be a cause of problems. For example, guests frequently forget either to hang a "Do Not Disturb" sign on the door when it is required, or to remove the sign when they leave. Hence cleaning staff pay little attention to such signs and commonly disturb hotel guests even where the signs are in use.

In addition, the present system of communicating to a hotel front desk that a room is vacant, clean, inspected and ready to rent requires a number of manual inputs which take considerable time to receive and process and which are not always received. Therefore guests wishing to check-in must often wait, even though clean rooms may be available.

A further problem is that in many cases, rooms have been deficiently cleaned but the hotel staff does not notice this until a guest has rented the room and then complains. It is then necessary to find the guest another room and to send cleaning staff to the first room. This wastes the time of the hotel staff and causes guest dissatisfaction.

A further consideration is that in most buildings, heating and cooling of rooms is a major expense. When a room is unoccupied, or when the guest has left for a period of time, it is unnecessary to supply full heating or cooling. However no satisfactory system exists for monitoring the presence or absence of a guest and setting back the room temperature in a satisfactory way when a guest is absent from the room.

A further problem area relates to smoke and fire detection systems. While smoke and fire detectors are widely used, they are in practice wired to a central fire detector panel as a "stand alone" system which does not provide other information. With such systems fire fighters do not know which rooms are actually occupied at the time, in order to remove guests from those rooms. The only information which a hotel can provide is which rooms have been let and which have not. Therefore fire fighters must commonly break down all the doors of all rooms in the fire zone to see whether a person is actually there. This wastes critical time.

Accordingly, the present invention provides a room monitoring and control system which will continuously receive and update a variety of different information from each room and report it to a central computer, which can then be monitored by the staff for such information as they require at any moment. In this way the facility will be operated with greater efficiency, so that it can earn more money, create greater comfort and greater safety, save on heating and air conditioning costs, and reduce administrative costs.

SUMMARY OF THE INVENTION

The invention described has a number of aspects. These will be described in detail, and only a few will be referred to here.

In one of its aspects the invention provides a method of automatically operating a room heating and cooling system of the kind having remotely controlled air flow means, heat exchange means, heating means for providing heat to said heat exchange means and cooling means for removing heat from said heat exchange means, a temperature controller having temperature sensing means mounted within said room and adapted to receive and register a user requested temperature, said method comprising turning off said air flow means when said requested and sensed temperatures coincide, turning on said air flow means when the sensed temperature departs by a first predetermined amount from the requested temperature but without operating said heating or cooling means, and then operating said heating or cooling means when the sensed temperature departs from the requested temperature by a second predetermined amount greater than said first predetermined amount.

In another aspect the invention provides a method of displaying the presence of a person in a room of the kind having a door, door sensing means for detecting whether said door is opened or closed, and a presence sensor, said method comprising displaying a presence indication when a person is present in the room, and when such person has left the room leaving the room vacant then continuing to display said presence indication for a predetermined period of time thereafter.

In another aspect the invention provides a method of detecting the presence or absence of a person in a room having a door, a wall outside the room, presence sensing means in said room to sense the presence or absence of a person in the room, said method comprising providing indicating means on said wall outside said room, said indicating means being coupled to said sensing means, and operating said indicating means from outside said room to display thereon, for use by a person outside the room, the presence or absence of a person in the room.

In another aspect the invention provides a method for indicating when a room is in the process of being cleaned, said room having a door and means for detecting whether the door is opened or closed, presence sensing means for sensing whether a person is present or absent in the room, a wall outside the room, indicating means on the wall coupled to said presence sensing means to provide, when interrogated by a cleaning person, an indication of whether a person is present or not in said room, said method comprising detecting when said indicating means have been interrogated, and then if the door is opened within a predetermined period of time thereafter, providing an indication that said room is being cleaned.

In another aspect the invention provides a method of controlling the temperature in a room having a temperature controller, user input means to control said temperature controller, and heating and cooling means coupled to said temperature controller and responsive to a user temperature request at said input means to produce a temperature change in said room, said method comprising reading a user request input for a temperature at said input means, waiting a predetermined period of time, and enabling said heating and cooling means only if said reading of said user request input has not changed during said predetermined period.

In another aspect the invention provides a method of automatically controlling the temperature in a room having a temperature controller having a temperature request register adapted to receive user requested temperatures from users, said method comprising determining whether said room is vacant or occupied and whether the season is summer or winter, and if the room is vacant, then clearing any previous user requested temperature from said register and setting the temperature in said room to a first predetermined temperature if the season is summer and to a second predetermined temperature if the season is winter.

In another aspect the invention provides a method of automatically determining the amount by which to set back the temperature in a room of the kind having an air flow means and heating and cooling means, said method comprising: detecting when the heating or cooling means in said room come on with said air flow means on and at such time reading the temperature in said room, and then reading the temperature in said room a predetermined period of time later but while said air flow means and heating or cooling means are still on, and determining the temperature difference between said first and second readings, such temperature difference being the temperature by which said room gains or loses heat in said time and constituting the amount of said set back.

In another aspect the invention provides a method of automatically setting the season in the heating and air conditioning control system of a room, said method comprising: determining when the heating or cooling in said room has stopped and no overshoot of the temperature in said room is occurring, taking a first temperature reading in said room, reading the temperature in said room again when it has dropped or risen a selected amount from said first temperature reading with the heating or cooling still off, and setting the season as winter if the temperature has dropped and summer if it has risen.

In another aspect the invention provides a method of automatically establishing the heat loss/gain factor of a room of the kind having a temperature controller having temperature sensing means, and an air flow means and heating and cooling means, said method comprising detecting when said heating and cooling means are off and there is no temperature overshoot from said heating and cooling means, and then counting the time for the temperature sensed by said temperature sensing means to change by a predetermined number of degrees while said heating and cooling means are still off, said time being the heat loss/gain factor of said room.

In another aspect the invention provides for a room having air flow means and heating and cooling means, a method of automatically indicating whether said air flow means or heating or cooling means have failed comprising: determining the time required for the temperature in said room to use or fall a first predetermined amount with said air flow means and heating and cooling means off, and then determining the length of time which said air flow means and heating or cooling means takes when on to raise or lower the temperature of the room by a second predetermined amount, and providing an indication that a failure has occurred if the last mentioned time is too long in relation to the first mentioned time.

In another aspect the invention provides a method of automatically displaying when hotel rooms are ready to rent, said method comprising displaying on a screen a map of said rooms, and indicating on said map all those rooms which are ready to rent by differentiating the display of such rooms from any display of the remaining rooms.

In another aspect the invention provides a method of setting a fire alarm in a building having a number of rooms, each room having a fire sensor adapted to provide an indication of whether there is a fire in the room, said method comprising determining if fire indications have been provided for one or more rooms, and if fire indications have been set for more than one room then immediately providing a fire alarm, but if a fire indication has been provided for only one room, then providing a fire alarm only if said fire indication continues for a short selected period of time, thereby to reduce the likelihood of false alarms.

In another aspect the invention provides a method of automatically providing, for a building having a plurality of rooms, an indication whether any of such rooms has an environment failure, said method comprising: determining periodically the heat loss or heat gain (lg) factor of each room, polling said rooms periodically to register their respective lg factors, comparing for each room (such room being the room being analyzed) its lg factor with those of its neighbouring rooms, and if fewer than a selected number of such neighbouring rooms has an lg factor similar to that of the room being analyzed, then providing an indication that the room being analyzed has an environment failure.

Further objects and advantages of the invention will appear from the following description taken together with the accompanying drawings.

BRIEF DESCRIPTION OF THE DRAWINGS

In the accompanying drawings:

FIGS. 12 and 13 are diagrammatic views of the controller circuitry;

DETAILED DESCRIPTION OF PREFERRED EMBODIMENT

Figure 1:
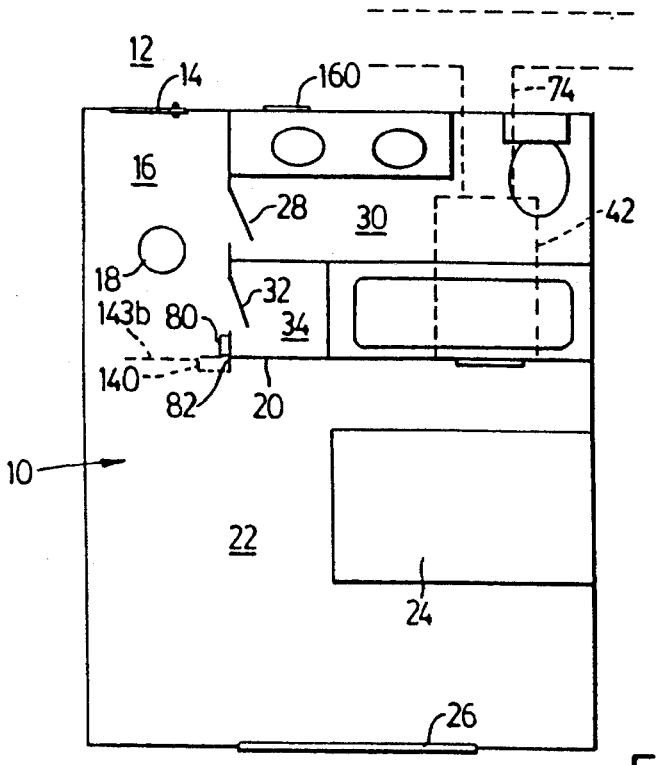
FIG. 1 is a plan view of a typical hotel room in which the system of the invention may be installed.
Figure 2:
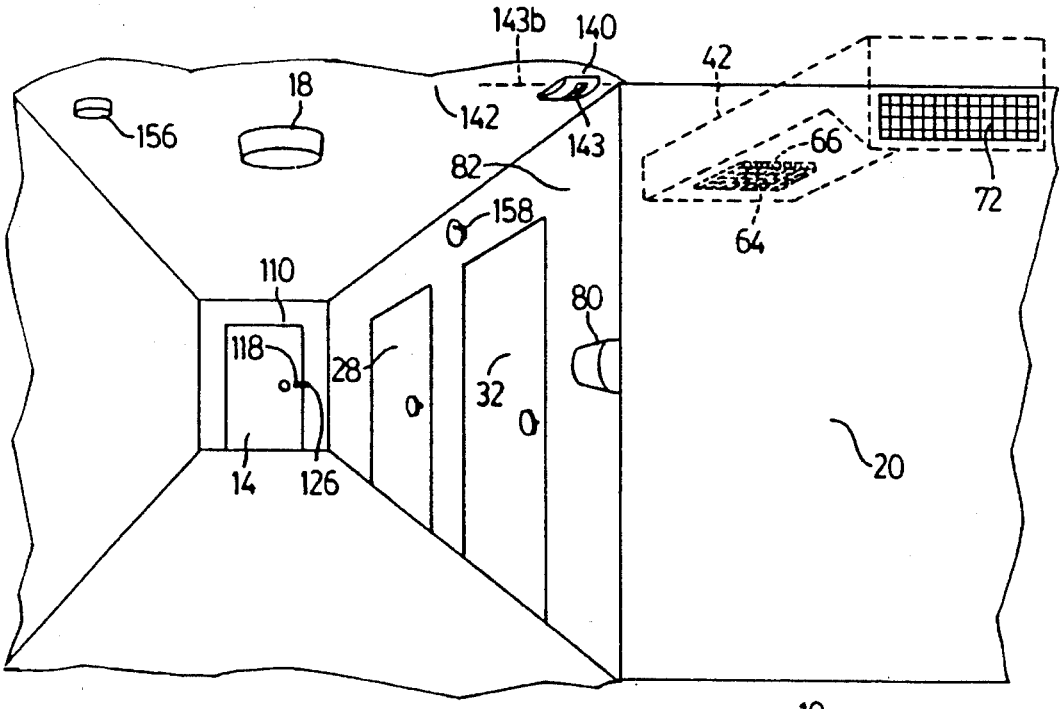
FIG. 2 is a perspective view of a portion of the room of FIG. 1.

Reference is first made to FIGS. 1 and 2, which show a typical hotel room 10 separated from a hotel hallway 12 by a door 14. The door 14 leads into a typical narrow and usually relatively dark foyer 16 illuminated by a light 18. The foyer 16 opens at wall 20 into a wider bedroom 22 having a bed 24 and a window 26. A door 28 leads from the foyer into a bathroom 30, and another door 32 leads from the foyer into a closet 34.

Figure 3:
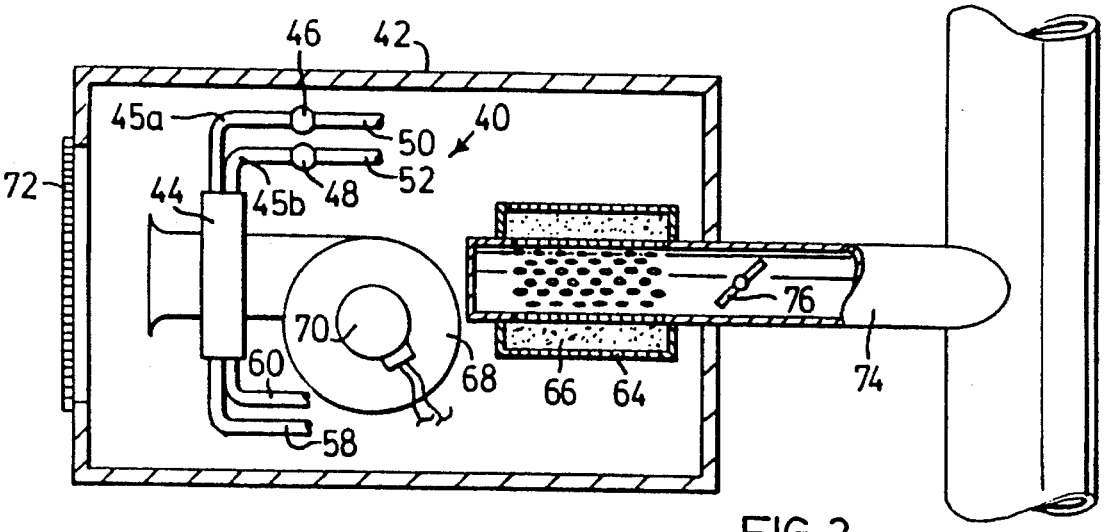
FIG. 3 is a plan view of a plenum in the FIG. 1 room.

A conventional heating, ventilation and air conditioning (HVAC) unit 40 (FIG. 3) is located behind the wall 20 in a plenum 42 above the bathroom ceiling. The HVAC 40 has a heat exchange coil 44 which in conventional fashion has two tubes 45*a*, 45*b* wound in parallel with each other (not shown). One such tube is connected through a solenoid valve 46 to a hot water pipe 50. The other tube is connected through a solenoid valve 48 to a cold water pipe 52. The tubes are also connected to not and cold water return pipes 58, 60. Valve 46 when operated sends hot water through coil 44. Valve 48 when operated sends cold water through coil 44.

The plenum 42 typically is connected to an air inlet grate 64 in the bathroom ceiling. A replaceable filter 66 behind grate 64 filters dust and dirt. The grate 64 is near the inlet of a fan 68 having a two speed motor 70. The fan 68 draws air from the plenum 42 and forces it through the heat exchange coil 44, and then through a grate 72 back into the room. The plenum 42 is also usually connected to a fresh air supply duct 74 which runs from the hallway over the filter 66 to a location near the fan 68, to provide some fresh air along with recirculated air into the room. Duct 74 may have a solenoid controlled damper 76.

Figure 4:
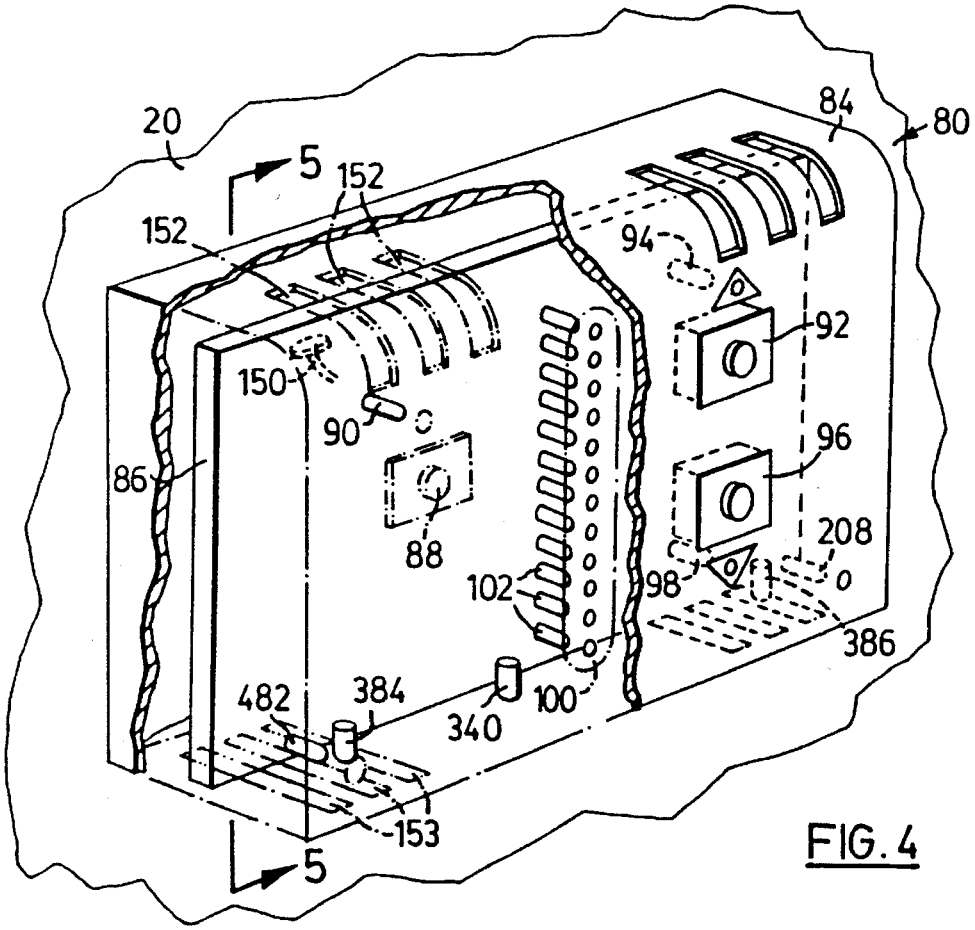
FIG. 4 is a perspective view of a room control unit according to the invention.
Figure 5:
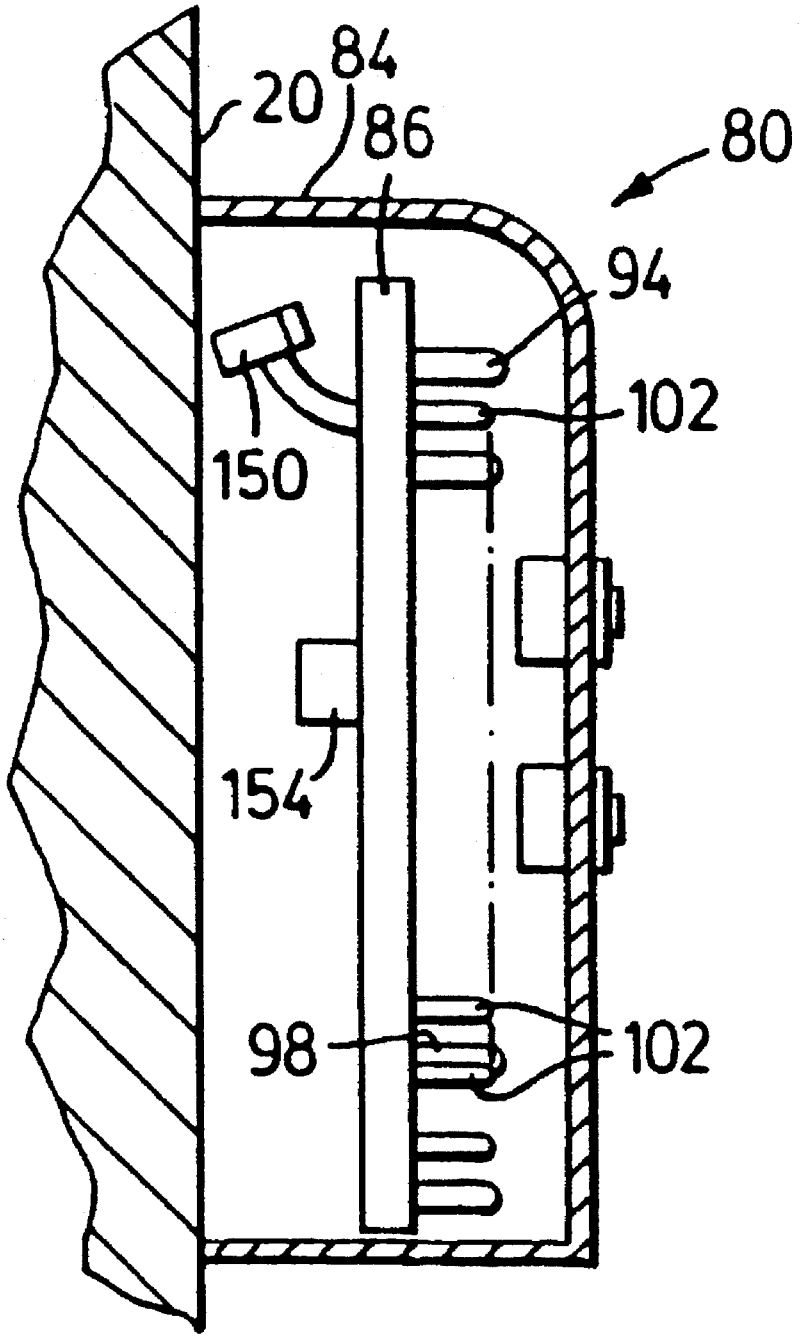
FIG. 5 is a side sectional view of the room control unit of FIG. 4.

A room control unit 80 according to the invention is placed on a wall 82 of the foyer 16, adjacent the wall 20. The room control unit 80 (also shown in FIGS. 4 and 5) monitors and controls the various room functions as will be described. The room control unit 80 will be described in more detail later, but as shown in FIGS. 4 and 5 it includes a housing 84 in which is located a circuit board 86. The circuit board 86 includes an on-off button 88 with a light emitting diode (LED) 90 above it to indicate when the unit is on, a temperature up operating button 92 with an LED 94 above it to display when heating is on, a temperature down operating button 96 with an LED 98 below it to display when the cooling is on, a temperature display scale 100, and a column of LED's 102 behind the scale to indicate the temperature selected by the guest. (One LED 102 lights to illuminates the selected temperature.)

Figure 6:
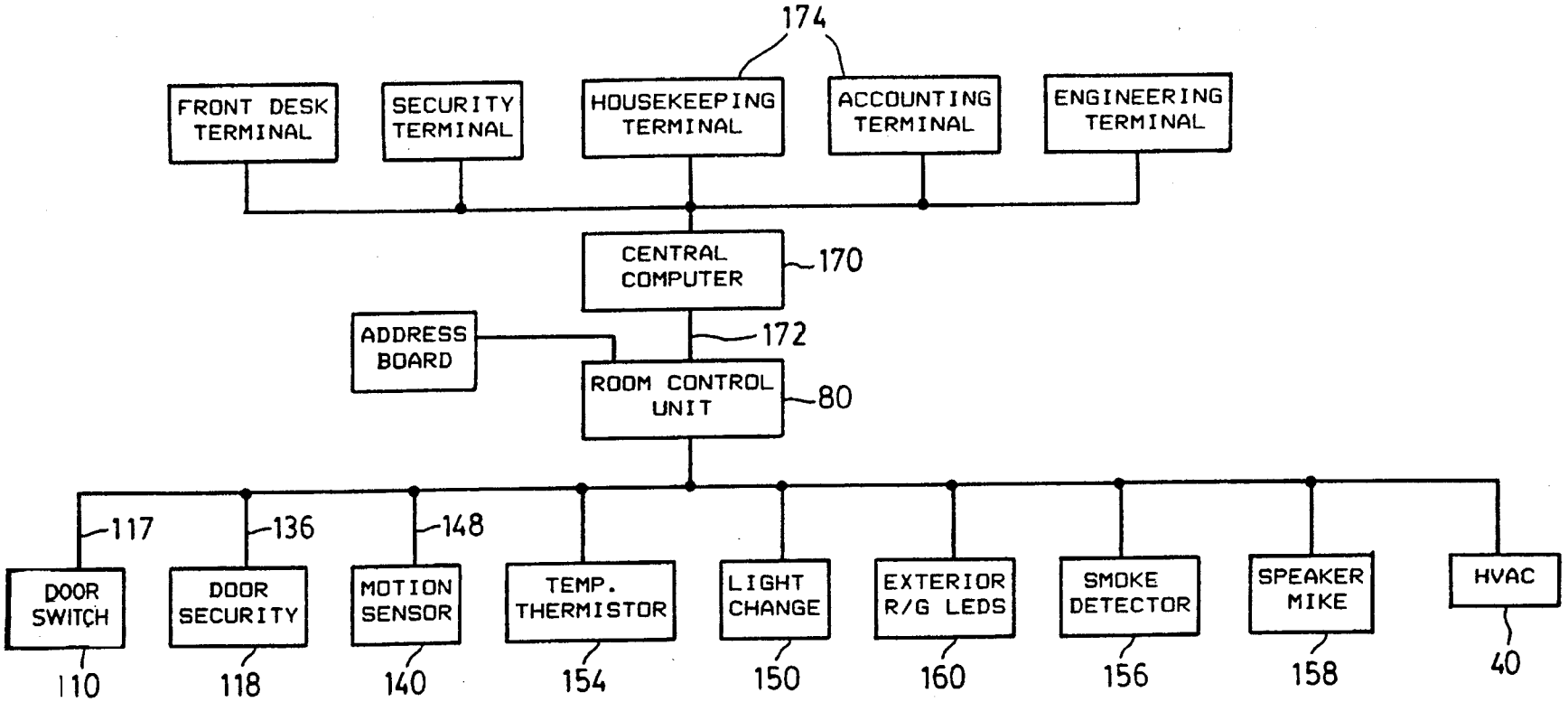
FIG. 6 is a schematic block diagram showing the connection of the room control unit of FIG. 4 to outside sensors and inputs and to a central computer and terminals.

The room control unit 80 is connected to various sensors and outputs, as shown in FIG. 6. Some of the sensors shown in FIG. 6 are actually physically located within the unit 80, as will be described, but are shown separately in FIG. 6 for clarity.

Figure 7:
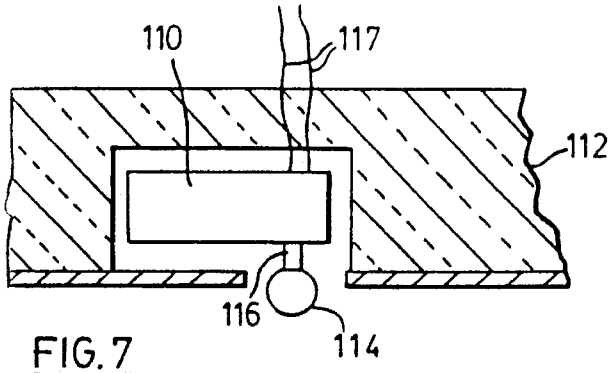
FIG. 7 PRIOR ART)
FIG. 7 is a diagrammatic view of a prior art infrared motion sensing unit.

The first sensor of FIG. 6 is a conventional door position switch, shown diagrammatically in FIG. 7 as being a simple ball microswitch 110 set into the upper part of the door frame 112. A ball 114 secured to the plunger 116 of the microswitch 110 protrudes slightly below the door frame 112. The microswitch 110 is normally open but is closed when the door 14 is closed to depress the ball 114. Leads 117 extend from switch 110 to unit 80.

Figure 8:
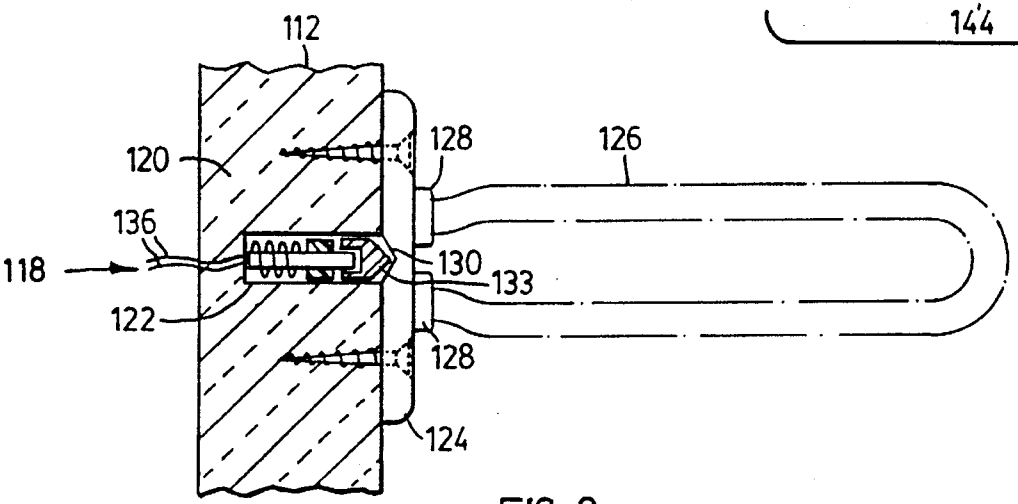
FIG. 8 is a diagrammatic view of a security switch for a door bar.

The next sensor of FIG. 6 is a door security switch shown diagrammatically at 118 in FIG. 8. The door security switch includes a conventional magnetic reed switch 120 located in a recess 122 in the door frame 112, behind the mounting plate 124 of a conventional swing bar 126. The swing bar 126 is hinged at 128 to the mounting plate 124. The mounting plate 124 has a central line of weakness 130. A magnet 132 is located in the recess 122, encircling the reed switch 120 and biased outwardly by a spring 134. The magnet is held from moving outwardly by a stop pin 133 having a V-shaped front end which is stopped by the line of weakness 130. The reed switch 120 is normally closed. If an intruder forces the door open when the swing bar is in its safety position, this will either crack or bend the mounting plate 124 at its line of weakness 130, or will pull it off the wall, allowing the pin 133 and magnet 132 to move forwardly. The magnet movement opens the contacts of reed switch 120, providing an intrusion signal on leads 136 connected to unit 80. (Use of the sealed reed switch 120 helps to ensure that its contacts will not oxidize unduly even though it may not be used for many years.)

Figure 9:
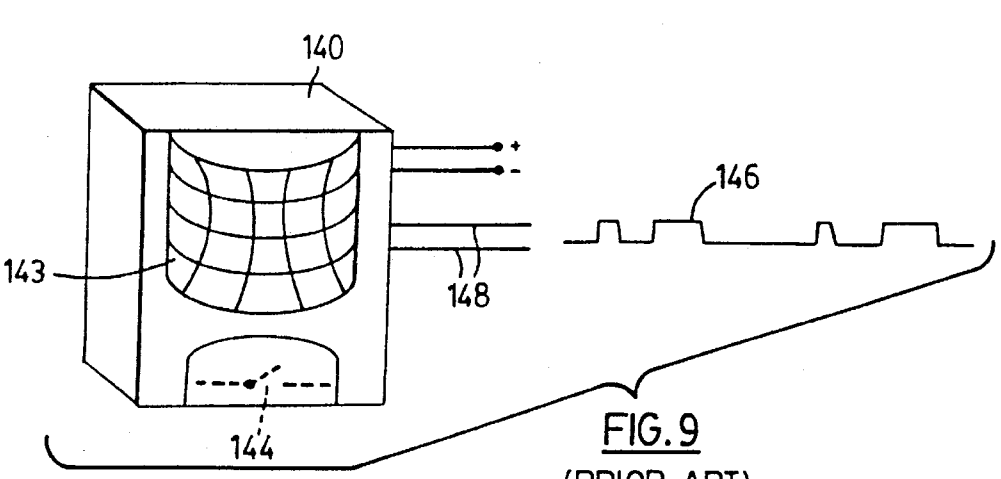
FIG. 9 (PRIOR ART)
FIG. 9 is a perspective view of a prior art motion sensor for use with the invention.

The next sensor of FIG. 6 is a conventional infrared motion sensor 140 (FIG. 9). Motion sensor 140 is preferably mounted on the ceiling 142 above room control unit 80, so that it can "see" persons entering the room through door 14 or from the bathroom through door 28, as well as persons standing at the room control unit 80 to change the temperature in the room, and persons in the room e.g. around or on the bed 24. The motion sensor 140 is typically a model MR-3000 "MAGIC RED" (trade mark) sensor distributed by Visonic USA of Hartford, Conn. This sensor has a infrared light sensitive diode which "sees" the area being scanned through an array of (typically 56 or more) small lenses 143. The lenses 143 are bisected by an imaginary line **143*a* projected along ceiling 142 from wall 20, so that the lenses can "see" into both the foyer 16 and the bedroom 22**. Each lens concentrates the infrared radiation from a particular zone onto the face of the infrared light sensitive diode in the sensor. Each zone is divided into a negative half and a positive half so that when there is a fixed stationery source of infrared radiation (e.g. the sun, a television set or the like), the signal from the negative half of the zone will cancel that from the positive half of the zone.

However when a source of infrared radiation moves from the negative part of one zone to the negative part of another zone, or from the positive part of one zone to the positive part of another, then the contacts 144 of a normally closed relay in the sensor 140 open, producing pulses 146 on signal output leads 148 from the sensor 140. The length of the pulses 146 will vary depending on the duration of the movement. It is a characteristic of the device mentioned that even a relatively brief human movement will produce an output pulse 146 of duration 1.4 to 1.6 seconds. As will be described, the room control unit 80 will normally consider a motion to be a valid motion only when an output pulse 146 is received of duration at least four seconds. However as will be described, the room control unit 80 has a high sensitivity mode in which it will accept as valid motion an output pulse 146 of duration equal to about 1.4 seconds or longer.

The next sensor of FIG. 6 is a change of light sensor 150 (FIGS. 4, 5). The change of light sensor 150 is a conventional photosensitive resistor produced by Phillips NV of Eindhoven, Holland. Photosensitive resistor 150 is mounted at the back of circuit board 86, below a series of slots 152 in the top of the housing 84. Hence light within the room, e.g. light from the light fixture 18, falling on the housing and entering the slots 152 will reduce the resistance of resistor 150, resulting in a signal which can be read by the unit 80 as will be described. Slots 153 in the bottom of the housing allow air flow through the two sets of slots and hence through the housing.

The next sensor of FIG. 6 is a temperature sensor 154 (FIG. 4). The temperature sensor 154 is simply a conventional thermistor (FIG. 5) mounted on the back of circuit board 86. Changes in temperature change the resistance of the thermistor 154, producing a signal which can be read by the unit as will be described. The thermistor 154 also serves as a fire indicator in case of a very rapid increase in heat, as will also be described.

The room control unit 80 is also connected to a conventional smoke detector 156 (FIG. 2) having normally open contacts which close on detection of smoke, and to a speaker/microphone 158. The speaker/microphone 158 will relay audio messages (e.g. fire instructions) to guests in the room and will also pick up sounds (e.g. the sound of a vacuum cleaner) for analysis as will be described.

Figure 10:
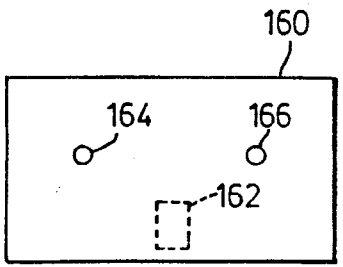
FIG. 10 is a plan view of an outdoor red and green light panel for use with the invention.

The room control unit 80 is also connected to a panel 160 (FIGS. 1, 10) on the wall in the outside hallway 12. The panel 160 contains a special reed relay switch 162 (to be described) which can be operated by a maid or other authorized person to interrogate the room control unit 80 as to whether or not there is a person present in the room 10. If a person is present, a red LED 164 on the panel 160 flashes for a short period of time (e.g. two seconds). If there is no person in the room, then a green LED 166 on the panel 160 glows continuously for the same period of time. Even if the person checking the panel is colour blind, such person can distinguish between the presence and absence of a person in the room by whether the lit LED 164 or 166 is flashing or glowing steadily.

The room control unit 60 is also connected to the solenoid valves 46, 54 and 48, 60 of the HVAC system 40, and to the fan motor 70, to drive these elements when required. If there is a solenoid operated damper 76, it will be connected to the damper also. The room control unit 80 is further connected to an address board 168 (which can be in the unit itself or can be in the wall behind unit 80), and to a central computer 170 which communicates with all the room control units via a line 172. The central computer may be connected to terminals 174 at the front desk, security desk, and in the housekeeping and accounting and engineering departments.

The hardware of the room control unit 80 will next be described in more detail, with reference to FIGS. 11 to 18.

The Electronic Control Circuitry (FIGS. 11 to 18)

Figure 11:
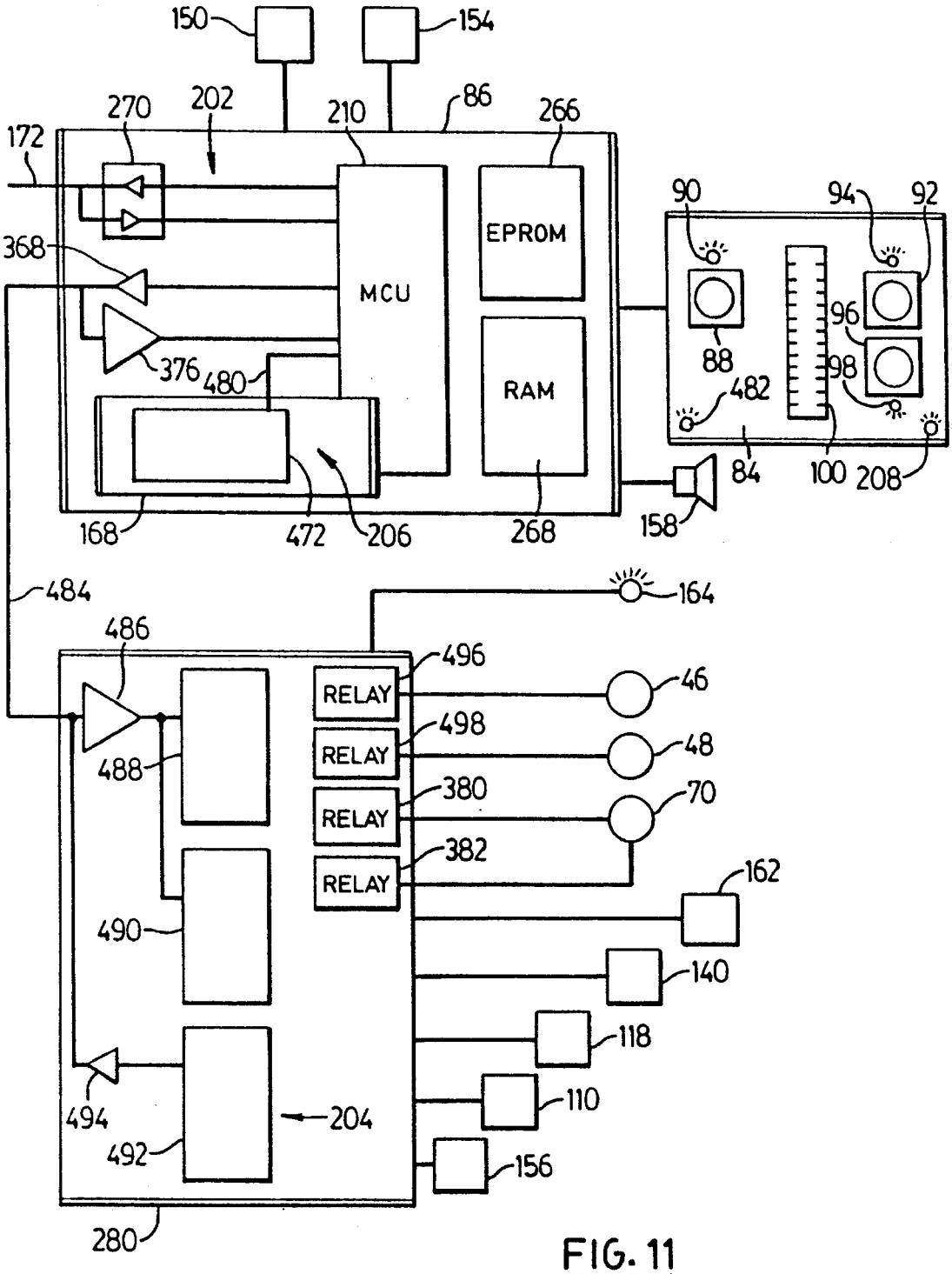
FIG. 11 is a schematic block diagram snowing the room control unit housing connected to the control circuit and the driver interface circuit.

FIG. 11 is a schematic block diagram of the electronic circuitry used to control the room control unit 80. The control circuitry consists of three units: a controller circuit 202, a driver circuit 204, and an address circuit 206 as shown in FIG. 11.

Figure 12:
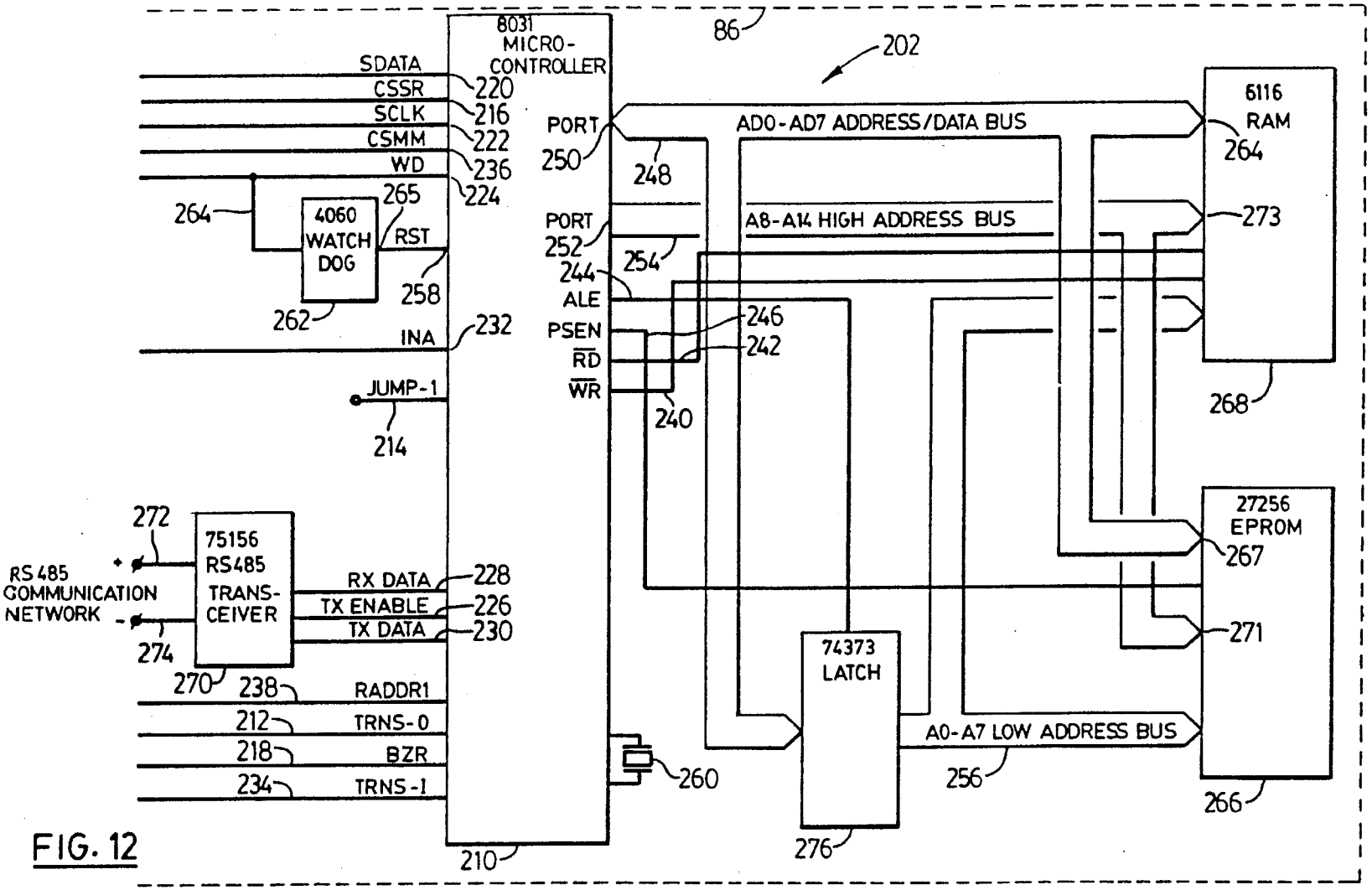

The controller circuit 202 is shown in more detail in FIGS. 12 and 13, and is located on a double-sided printed circuit board ("PCB") 86. Referring to FIG. 12, the controller circuit 202 includes a micro-controller unit ("MCU") 210. The MCU 210 is a standard micro-controller, such as the well-known 80C31 micro-controller sold by Intel Corporation. The MCU 210 consists of an 8-bit central processing unit with on-chip peripheral devices. The on-chip peripheral devices include 128 bytes of data RAM, 2 16-bit timers, a full duplex serial communication port, and four bidirectional S-bit input/output ("i/o") ports. The MCU 210 has a 12 mega-hertz crystal 260 connected to it. This crystal 260 generates a clocking signal which is used to control the internal timing of the MCU 210.

The MCU 210 includes a sanity check or "watchdog" circuit. The purpose of the watchdog circuit is to prevent the MCU 210 firmware from locking up. The watchdog circuit consists of a digital counter 262 with a latched output pin 265 which is connected to reset pin 258 and to output pin 224 of the MCU 210. Unless the watchdog circuit is periodically reset by the MCU 210 via output pin 224, the counter 262 will output a binary pulse on pin 265. The binary pulse on input pin 265 resets the MCU 210 and causes it to restart the operational program.

The on-chip serial communication port of the MCU 210 is used to communicate with the central computer 170. The communication port utilizes the industry standard RS-485 serial communication protocol. The MCU 210 interfaces to a RS-485 transceiver chip 270 through output pins 230,226 and input pin 228. The MCU 210 transmits on output pin 230 and receives data on input pin 228. The MCU 210 uses output pin 226 to control the direction of transmission on the transceiver 270. The transceiver 270 transmits outgoing messages (i.e. to the central computer 170) and receives incoming messages on a differential loop consisting of two lines 272,274 which are electrically compatible with the RS-485 communication standards. These two lines 272,274 form the communication link 172 to the computer 170.

As shown in FIG. 12, the MCU 210 is configured in external program and data mode. In this mode, the MCU 210 uses an external data bus 248, an upper address bus 254, and a lower address bus 256 to interface to electronic memory devices. The memory devices include an erasable-programmable-read-only-memory ("EPROM") chip 266 and a random-access-memory ("RAM") chip 268. The MCU 210 accesses the EPROM 266 and RAM 268 using two of the 8-bit bidirectional i/o ports, port 250 and port 252, and the control pins 246,242,240.

In external program and data mode, the MCU 210 multiplexes the 8 bits of data and the lower 8 bits of the address on i/o port. The lower 8 bits of the address bus 256 are demultiplexed by latching the address output on i/o port 250. The ALE control pulse 244 latches the lower 8 bits of the address in an octal transparent latch 276. The output of the latch 276 forms the lower byte of the address bus 256 which is connected to the respective address inputs on the program memory chip 266 and the data memory chip 268. The data bus 248 is formed by directly connecting i/o port 250 to the data output port 267 on the EPROM 266 and the bidirectional data port 269 on the RAM 268.

The upper address bus 254 consists of port 252 output from the MCU 210. As shown in FIG. 12, the high address port 271 of the EPROM 266 connects to the upper address bus 254. Similarly, the high address port 273 of the RAM 268 connects to the upper address bus 254.

The EPROM 266 provides 65,536 addressable memory locations, each of which includes one byte of eight binary digits. Using the upper address bus 254 and lower address bus 256, the MCU 210 addresses any one of the memory locations on the EPROM 266. In response to such addressing and the program-store-enable control signal 246, the EPROM 266 supplies a byte of information to the MCU 210. Since the EPROM 266 is only capable of supplying information to the MCU 210, its only use is for storing the operational program for the MCU 210.

The RAM 268 provides 2,048 addressable memory locations, each of which is one byte wide. The MCU 210 addresses the RAM 268 using the upper address bus 254 and the lower address bus 256. The RAM 268 supplies data to the MCU 210 using the data bus 248 and control pins 240,242. The memory 268 contains 2,048 separately addressable bytes of RAM memory. The MCU 210 uses the memory 268 to store variables generated during the operation of its various program functions, such as the user requested temperature.

Referring still to FIG. 12, the MCU 210 controls the electronic and electrical devices in the room unit 80 through i/o pins 212–224,232–238. The i/o pins enable the MCU 210 to transmit or to receive a binary signal from a selected peripheral device.

As shown in FIG. 13 (the right side of which matches the left side of FIG. 12), by using a serial-to-parallel shift register 366 and an eight-to-one line multiplexer ("MUX") 278, the i/o capability of the MCU 210 is expanded. The shift register 366 provides 8 output control pins 348 to 362. Conversely, the MUX 278 provides 8 input status pins 286 to 300 which are selectively read by the MCU 210 through pin 232 using the three address pins 220,222,224.

The MCU 210 also uses i/o pins 220,222 along with i/o pin 216, which are configured as outputs, to interface with the shift register 366. The shift register 366 has a serial data input 346, a clock input 342, a chip select input 344, and 8 parallel output pins 348 to 362 along with a serial data output 364. Output pin 216, which is connected to pin 344 of the register 366, selects the register 366 and enables it to accept data on pin 346 from the MCU 210. With the register 366 selected, the MCU 210 serially shifts binary data, which is output on pin 220, into the serial input 346 of the register 366 by generating a clock pulse on pin 222. As the MCU 210 shifts the data into the register 366, the data appears on the output pins 348 to 362.

In the present embodiment, the MCU 210 uses 5 output pins of the shift register 366 for control functions. Output pin 348 selects and enables an analog-to-digital ("A/D") convertor chip 372. Output pin 350 controls the address board 168. Output pins 352,354 interface with two magnetic reed relays 384,386. Output pin 356 controls the power-on LED 90 mounted on the housing 84. The remaining three output pins 358,360,362 and the serial data output pin 364 are not being used. These output pins 358,360,362,364 form a logic OR gate 440, which is configured using four diodes 442,444,446,448, and has an output 398. The output 398 of the gate 440 can be read on input pin 214 of the MCU 210. To implement a future function, output pins 358,360,362, 364 can be connected or "jumpered" to one of the diodes.

To provide the required current drive capability, the outputs 350,352,354,356 are buffered using a driver array 368, such as the known ULN2803 manufactured by Motorola Corporation. The driver array 368 allows the logic signals generated by the MCU 210 and output to the shift register 366 to properly interface with high current devices such as the reed relays 384,386.

In the present embodiment, to register whether a room is occupied or vacant (described below), the cleaning staff activates one of the two reed relays 384,386 on the control unit 80. To activate one of the reed relays 384, 386, the cleaning staff use a key 394 with a unique magnetic polarity. Similarly, to confirm such a registration, the inspectress activates one of the reed relays 384,386 with a key 400. Referring to FIG. 13, the MCU 210 determines the magnetic polarity of a key 394,400 by outputting control pulses on pins 352,354 and monitoring the state of the reed relays on pins 292,296. The MCU 210 then uses the magnetic polarity of the key 394,400 to identify and validate the input.

A third magnetic reed relay 340 on the unit 80 provides an additional status input for the hotel staff. In the present embodiment, activation of the reed relay 340 initiates the self-test of the room control unit 80. The self-test is a routine which diagnoses any installation problems, such as reversed polarities on the fan 70.

Figure 18A:
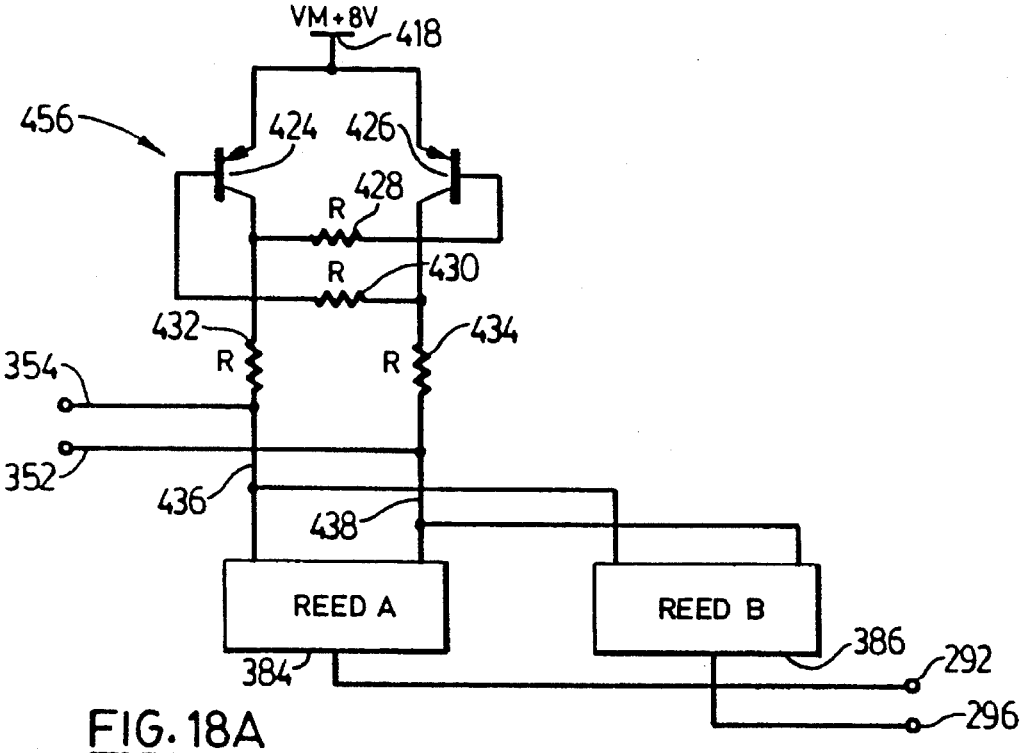
FIG. 18A is a diagrammatic view of the magnetic key identification circuit.
Figure 18B:
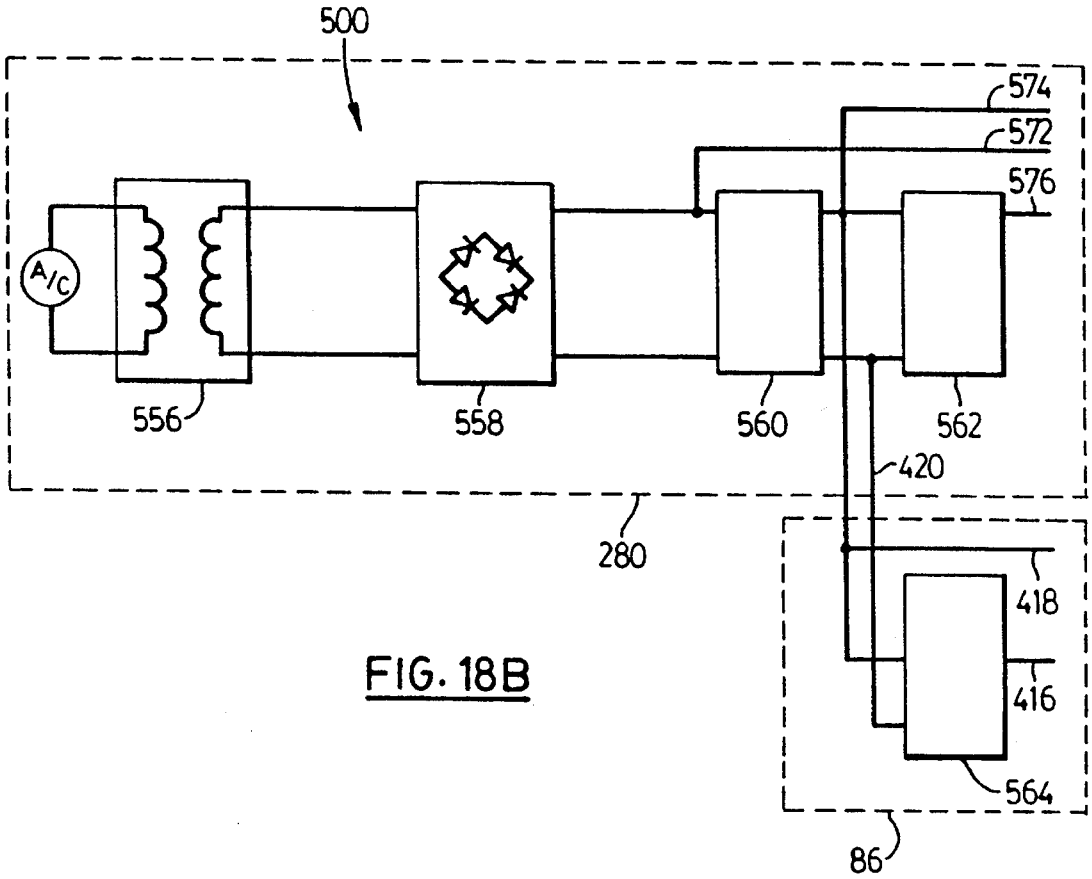
FIG. 18B is a diagrammatic view of the power supply circuit.
Figure 18C:
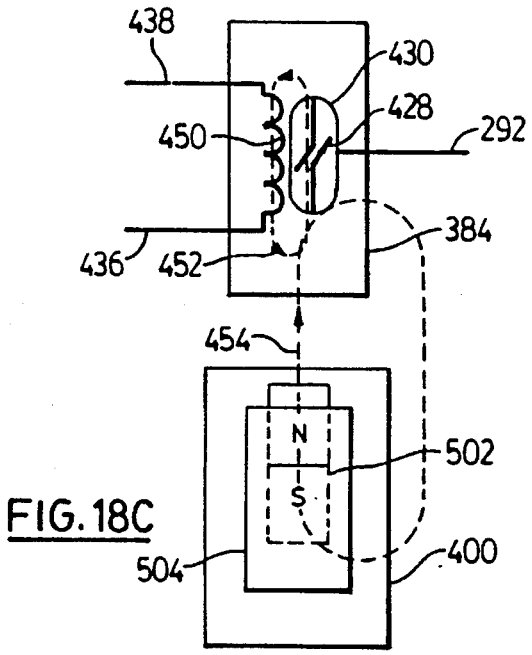
FIG. 18C is a diagrammatic view of the reed relay and key.
Figure 18D:
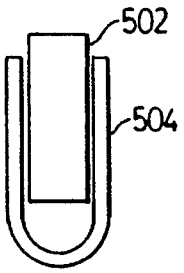
FIG. 18D is a side view of the magnet and shield for the key.

As shown in FIG. 18C, the reed relay 384 (same for relay 386) has a contact 428, which is enclosed in a sealed bulb 430, a coil 450 with two leads 436,438, and an output 292. The output 292 is used to determine the state of the contact 428, which can be either closed or open, but is normally open. When a key 394,400 is brought near the reed relay 384, the magnetic field of the key 394,400, which is generated by a permanent magnet 502, causes the contact 428 to close. As shown in FIG. 18D, a permanent magnet 502, shielded by a U-shaped piece of metal 504, is used to generate the the magnetic field. The purpose of the shield 504 is to focus and concentrate the magnetic field, and to allow the key 394,400 to be used only in one orientation relative to the reed relays 384,386. Referring to FIG. 18C, the closed contact 428 is detected by the MCU 210 on pin 292. To determine the magnetic polarity and thus the identity of the key 394,400, the MCU 210 generates an electro-magnetic field 452 and monitors the state of the contact 428 on pin 292.

As shown in FIG. 18C, the electro-magnetic field 452 is generated by passing an electric current through the coil 450. Since the direction of an electro-magnetic field depends on the current direction, the direction of the field 452 can be changed by switching the current direction.

Referring to FIG. 18A, the MCU 210 controls the current direction through the coil 450, by using a RS flip-flop 456. The flip-flop 456 is configured using two transistors 424,426 and two resistors 428,430. Two additional resistors 432,434 are used to limit the current through the coil 428. By controlling the logic levels on output pins 352,354, the MCU 210 can change the state of the flip-flop 456. Each of the two states of the flip-flop 456 corresponds to a different current direction. Thus, by changing the state of the flip-flop 456 the direction of the electro-magnetic field 452 can be reversed.

By directing the electro-magnetic field 452 against the magnetic field 454 of the key 400, the field 454 can be cancelled, as shown in FIG. 18C. The cancelling of the magnetic field 454 causes the contact 428 to open which is monitored by the MCU 210 on pin 292. By correlating the direction of the current (i.e. the state of the flip-flop 456) to the open contact 428, the MCU 210 can determine the magnetic polarity of the key 400. The MCU 210 then uses the magnetic polarity to register whether the key 400 is that of maid or an inspectress.

As shown in FIG. 13, the MCU 210 controls the speaker 158 using output pin 218. The MCU 210 turns the speaker 158 on and off by outputting the appropriate logic signal on pin 218. Since the speaker 158 is a high current device, the driver array 368 buffers the signal output on pin 218 to provide the additional drive capability.

Referring still to FIG. 13, the MCU 210 utilizes three output pins 220,222,224 and one input pin 232 to interface with the MUX 278. Output pins 220,222,224 together address one of the eight input lines on the MUX 278. Using input pin 232, which is connected to the output pin 302 of the MUX 278, the MCU 210 reads the selected input line of the MUX 278.

The first three inputs 290,288,286 of the MUX 278 are connected to the three push button switches 88,92,96 on the housing 84. Using the three output pins 220,222,224 to address the MUX 278, the MCU 210 can use input pin 232 to selectively read the switches. A push button switch registers a logic signal that is read on pin 232 of the MCU 210.

The next three inputs 292,296,294 of the MUX 278 are connected to three magnetic reed relays 340,384,386. Similar to the push button switches 88,92,96, the MCU 210 selectively reads the reed relays on input pin 232. A reed relay generates a logic signal that is read on pin 232 of the MCU 210.

Figure 17:
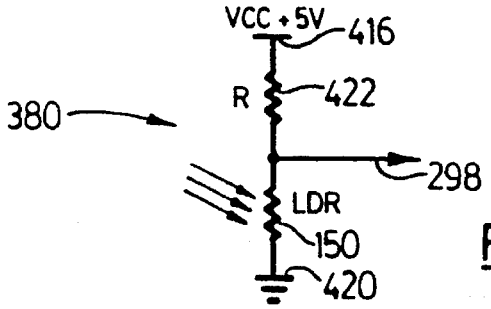
FIG. 17 is a diagrammatic view of the light sensor circuit.

Input pin 298 of the MUX 278 interfaces with a light detection circuit 380. As shown in FIG. 17, the light detection circuit 380 consists of a light-dependent resistor 150 which is connected in series with a current limiting resistor 422 and the positive supply rail 416. When light energy hits the resistor 150, the resistor 150 conducts current which causes a voltage drop. The voltage drop generates a logic signal on pin 298 that is read by the MCU 210 on output pin 302 of the MUX 278.

As shown in FIG. 13, the MCU 210 uses a display driver chip 370 to control the temperature up LED 94, the temperature down LED 98, and the temperature scale LEDs 102 which are all located on the front of the housing 84. In addition, the display driver 370 controls a cleaning status LED 482 and an inspection status LED 208. These two LEDs provide feedback on the activation of the two reed relays 384,386.

The display driver 370 is a standard LED driver, such as the known MM5481 chip sold by National Semiconductor Corporation. The display driver 370 has a chip select input 458, a serial data input 460, a data clock input 462, and 14 output pins. Output pins 314 to 330 drive 9 LEDs which comprise the temperature scale LEDs 102. Output pin 332 drives the temperature up LED 94, and output pin 334 drives the temperature down LED 98. The two outputs 336,338 control the cleaning and inspection LEDS 482,208. The remaining output 312 controls the test function for the room temperature sensor 154.

The MCU 210 interfaces to the display driver 370 through the output pins 220,222,236. The output pin 236 selects the display driver 370 and enables it to accept serial data from the MCU 210. The MCU 210 outputs the serial data bit by bit on pin 220 and then generates a digital clock pulse on pin 222 to latch the data bit into the display driver 370. Once the entire serial transmission sequence is completed by the MCU 210, the display driver 370 outputs the received data bits which control the LEDs on the housing 84.

Referring still to FIG. 13, the MCU 210 interfaces to the A/D converter 372 using the eighth input line 300 of the MUX 278, output line 348 and output line 222. The A/D converter 372 allows the MCU 210, a digital device, to communicate with the room temperature sensor 154 which is essentially an analog device. The A/D converter 372 generates a digital data byte corresponding to the reading of the temperature sensor 154 which is then serially input by the MCU 210.

Figure 16:
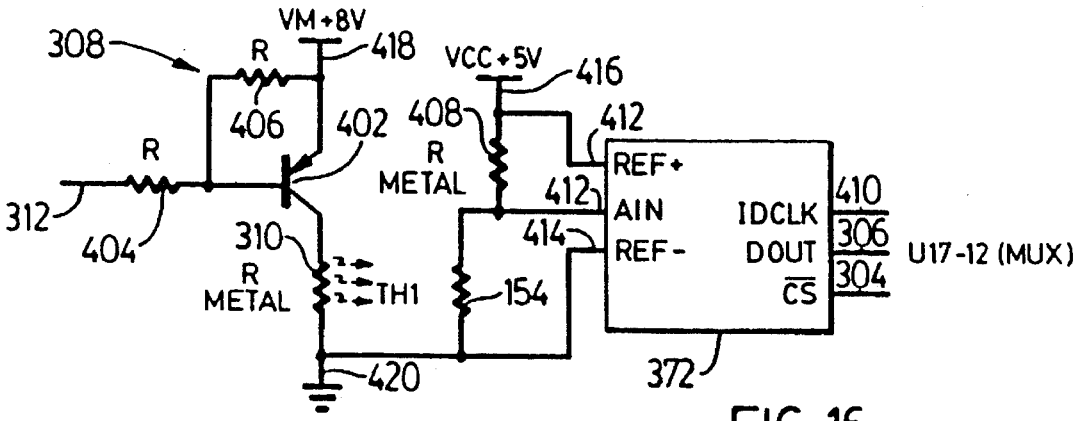
FIG. 16 is a diagrammatic view of the thermistor circuit.

On the analog side, the A/D converter 372 interfaces to the thermistor circuit 308. The thermistor circuit 308 is used by the MCU 210 to sense the room temperature. As shown in FIG. 16, the circuit 308 includes the thermistor 154, two metal resistors 310,408, and a transistor driver 402 which includes two resistors 404,406. The MCU 210 uses the resistor 310 and transistor 402 to test the thermistor 154.

To test the thermistor 154, the MCU 210 outputs a logic signal on output pin 312 of the display driver 370. This logic signal activates the transistor 402 and causes a current to flow through the resistor 310. The resistor 310 is physically located beside the thermistor 154 on the PCB 86. The resultant current heats resistor 310 and the adjacent thermistor 154. The heating of the thermistor 154 generates an analog voltage level across the voltage divider consisting of thermistor 154 and resistor 408. The A/D converter 372 inputs this analog voltage level on pin 418. The A/D converter 372 then generates a digital data byte which corresponds to the analog voltage level and the temperature reading of the thermistor 154.

As shown in FIG. 16, the analog voltage range of the A/D converter 372 is set by connecting pin 412 to an upper reference voltage and pin 414 to a lower reference voltage. In the present embodiment, the upper reference is set at the positive supply rail 416 (VCC), and the lower reference is set at the negative supply rail or ground 420 (VSS).

Referring back to FIG. 13, the MCU 210 inputs the digital data byte from the A/D converter 372 using the output pins 220,222,224 to select input pin 300 of the MUX 278 which is connected to the digital output pin 306 of the A/D converter 372. The MCU 210 then serially inputs the digital data byte by enabling the A/D converter 372 with output pin 348 of the register 366, which is connected to the chip select pin 410, and by generating 8 digital clock pulses on output pin 222, which is connected to the clock input pin 304. For each clock pulse, the. A/D converter 372 outputs one bit of the data which is then read by the MCU 210 on output pin 302 of the MUX 278.

Figure 15:
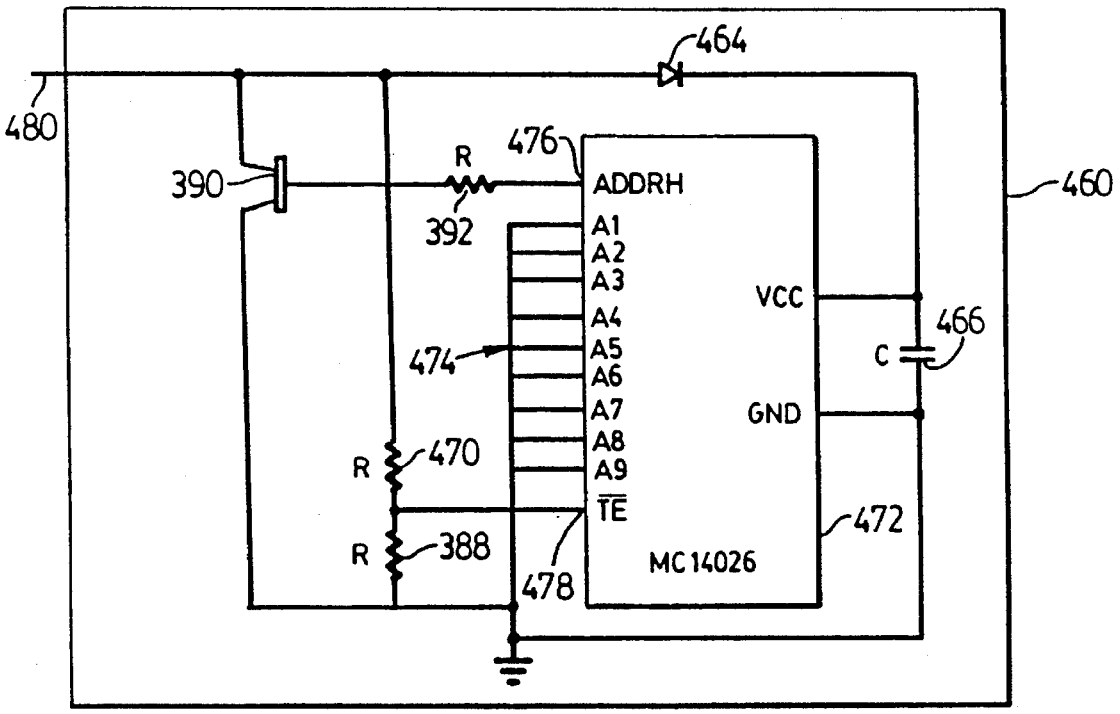
FIG. 15 is a diagrammatic view of the address circuit.

The address of the particular room control unit 80 is generated by the address circuit 206 shown in FIG. 15. The address circuit 206 is contained on a separate printed circuit board 168 which "piggy-backs" on the controller board 86, and is connected via a communication line 480. The address circuit 206 is hard-wired to encode a digital address unique to the particular room control unit 80.

The address circuit 206 consists of an encoder chip 472. The encoder chip 472 used in the present embodiment is the Motorola MC145026 which is known in the industry. The encoder 472 has 9 address inputs 474, a serial data output 476 and a transmit enable input 478. The address of the particular room control unit 80 is hardwired on the nine address inputs 474 of the encoder 472. In response to a transmit enable signal received from the MCU 210 on line 480, the chip 472 encodes the bit pattern on its inputs 474 and serially transmits the message packet to the MCU 210.

Referring to FIG. 13, the address circuit 206 interfaces to the controller board 86 via communication line 480. The communication line 480, in turn, connects to the output pin 350 of the register 366 in the transmit direction, and in the receive direction, line 480 connects to input pin 238 of the MCU 210. Before the MCU 210 inputs the encoded address signal on pin 238, the signal is conditioned bypassing it through a differential comparator 378. Similarly, the signal output by the MCU 210 on pin 350 of the register 366 is buffered by the driver 368 before it reaches the address board 168 and encoder 472.

Referring to FIG. 15, the MCU 210 powers the address circuit 206 using output pin 350 which charges a supply capacitor 466. A diode 464 connects to the capacitor 466 to reverse bias the power feed from the output pin 350 and thereby prevent the capacitor 466 from discharging.

To initiate a transmission, the MCU 210 generates an active low pulse on output pin 350, which is connected to the transmit enable input 478 of the encoder 472 via a voltage divider network consisting of two resistors 470,388. Upon receiving the active low pulse, the encoder 472 commences to transmit the address code wired to its inputs 474. The encoder 472 outputs the address message to the MCU 210 on pin 476 which is connected to a drive transistor 390 through a resistor 392. Once the transmission is completed, the encoder 472 returns to standby mode.

Figure 14:
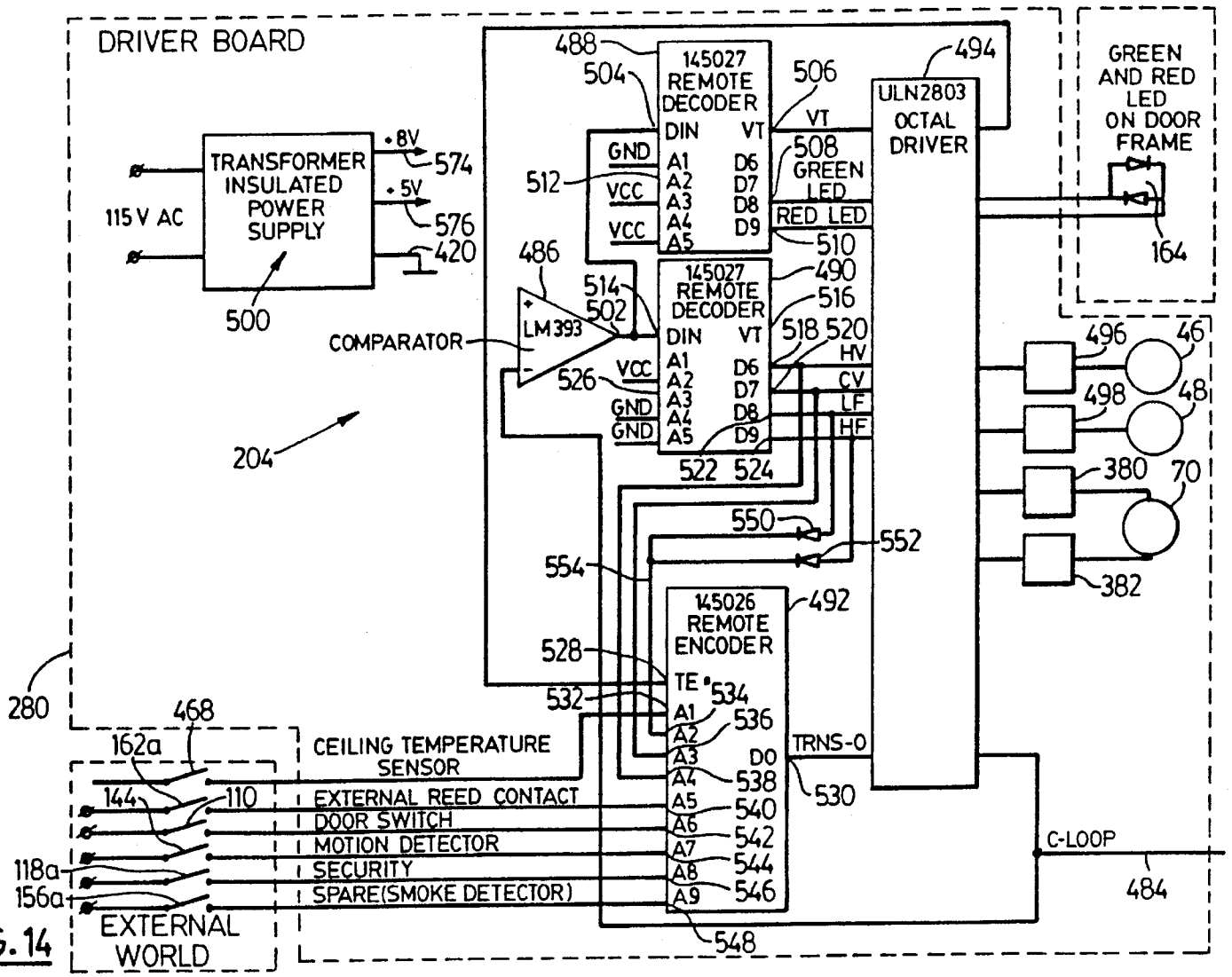
FIG. 14 is a diagrammatic view of the driver interface circuitry.

As shown in FIG. 14, the driver circuit 204, which is mounted on a double-sided PCB 280, interfaces the room control unit 80 to the various room environment control devices and room status devices. The environment control devices include the hot water valve 46 and the cold water valve 48, and the fan 70. The status devices include the motion detector 140, the door switch 110, the security detector 118, the external reed switch relay 162, the smoke detector 156, and a temperature sensor 468.

The MCU 210 communicates with the driver circuit 204 using a single wire 484. The wire 484 provides serial communication in both the receive and transmit directions. The MCU 210 transmits control messages to the driver circuit 204 using output pin 212. The signal output on this pin 212 is buffered using the driver array 368. In the receive direction, the MCU 210 reads status messages on pin 234. The receive signal is conditioned using a differential comparator 376.

Referring to FIG. 14, the MCU 210 transmits control messages to two decoder chips 488,490 and receives status messages from a encoder chip 492. The encoder chip 492 is the same type that is being used on the address board 168. The decoder chips 488,490 are the well known MC145027 manufactured by Motorola Corporation. The decoder chips 488,490 receive encoded messages in serial format from the MCU 210 transmitted via output pin 212. As shown in FIG. 14, a differential comparator 486 conditions the encoded messages before they are read by the decoders 488,490. If the address encoded in the message matches the hard-wired address 512,526 of the either decoder 488,490, then the matched decoder 488 or 490 outputs the data bits of the message. The decoder 488 also generates an active high logic pulse when a valid message is received.

As shown in FIG. 14, the first decoder 488 controls the state of the external LED 164. The external LED 164 is a hi-color (red/green) LED which emits either red or green light depending on the current direction.

The first decoder 488 has five address inputs 512 which are hard-wired with a 5-bit address specific to the LED control messages encoded and transmitted by the MCU 210. Two outputs 508,510 of the decoder 488 control the current through the LED 164. To provide extra current drive capability, the two outputs 508,510 are buffered using the driver array 494.

The driver array 494 also buffers the valid transmission pulse generated by the first decoder 488 on output pin 506. The driver 494 inverts the valid transmission pulse, which is active high, and thereby initiates a message transmission by the encoder 492 whenever the address of decoder 488 is matched by a message from the MCU 210.

The second decoder 490 also has 5 address inputs 526 which are hard-wired with a 5-bit address code specific to the valve and fan control messages. The decoder 490 controls a hot water valve relay 496 using output 518, and a cold water valve relay 498 using output 520, a low speed fan relay 380 using output 522, and a high speed fan relay 382 using output 524. The relays 380,382,496,498 allow the driver circuit 204 to interface and control devices which operate on alternating current. To provide extra drive capability, the driver array 494 buffers the decoder 490 outputs before they connect to the relays.

To turn the appropriate relays on or off, the MCU 210 transmits an encoded message addressed to the second decoder 490. The second decoder 490 receives this message and latches the appropriate logic signals on the output pins 518,520,522,524 which are connected to the relays through the driver array 494.

On the transmit side, the encoder 494 sends the current status of the control and sensing devices connected to the driver circuit 204. As shown in FIG. 14, the contact **162*a* of the external reed relay 162 connects to input pin 540 of the encoder 492; the door switch 110 connects to input pin 542; the contact 144 of the motion detector 140 connects to input pin 544; the contact 118*a* of the reed relay in the security detector 118 connects to input pin 546; the contact 156*a* of the smoke detector 156 connects to input pin 548; the hot water valve control pin 518 connects to pin 538; and the cold water valve control pin 520 connects to pin 536**.

The temperature sensor 468 connects to input 532 of the encoder 492. This sensor 468 monitors the temperature in the ceiling of the room 10, and is used to detect fires in the suspended ceiling.

Referring still to FIG. 14, the low speed fan control pin 522 and the high-speed control pin 524 feed a logic OR gate consisting of diodes 550,552. The output of this logic gate 554 is connected to input pin 534 of the encoder 492.

To receive the current status message from the encoder 492, the MCU 210 must first transmit a valid message to the first decoder 488. A valid transmission to the decoder 488 causes it to generate a logic pulse on the output pin 506. The driver array 494 inverts and buffers this active high logic pulse which is connected to the transmit enable pin 528 of the encoder 492. Strobing the transmit enable pin 528 with the active low pulse causes the encoder 492 to serially transmit the current status message on output pin 530 which is also buffered by driver 494. The MCU 210 receives this message on pin 234 after it is conditioned by a differential comparator 376.

The driver circuit 204 includes a power supply circuit 500. Referring to FIG. 18B, the power supply circuit 500 consists of a step-down transformer 556, which receives alternating line current ("AC") and reduces it to a lower voltage, a bridge rectifier 558, which rectifies the AC voltage provided by the transformer 556, and two voltage regulators 560,562 which filter and regulate the rectified voltage to produce the desired direct current ("DC") voltages for powering the electronic devices resident on the driver board 280. The first voltage regulator 560 produces an 8-volt DC output 574, while the second voltage regulator 562 produces a 5-volt DC output 576. The power supply circuit 500 also includes an unregulated DC voltage tap 572 which is used to drive the motion detector 140.

The power supply circuit 500 also powers the controller circuit 202 (FIG. 13). The 8 volt DC output 574 is connected to the controller circuit to provide a regulated 8 volt power rail 418. On the controller board 86, the DC output 574 is regulated by a chip 564 to produce a 5 volt DC power rail 416. As shown in FIG. 18B, all DC voltage levels are referenced to a return rail 412 (VSS).

The detailed method of operation of the system will next be described, with reference to the flow charts shown in FIGS. 19 and following. It will be understood that in the flow charts described, the program continuously cycles through the sequence of logical operations described in the charts, beginning at the top of each chart and ending at the bottom of each chart with the word "out". In addition, throughout the description there will be reference to various timers. These timers are all provided by the software in conventional fashion and will therefore not themselves be described.

Figure 19:
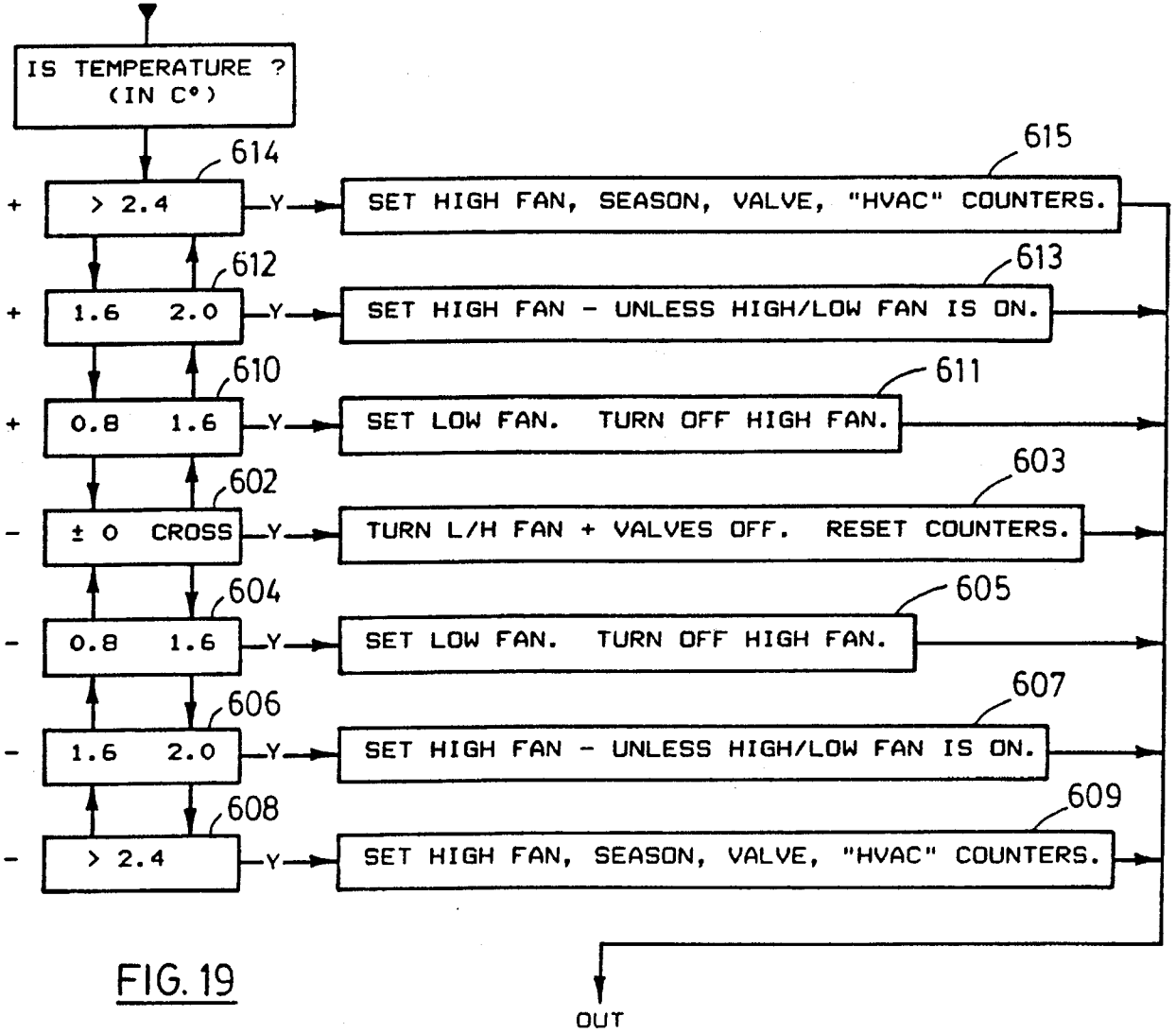
FIG. 19 is a logic flow chart for the fan/valve operation.

Fan-Valve Operation (FIG. 19)

Reference is first made to FIG. 19, which shows the basic method of operation of the high and low speed fan motor 100 and the valves 46, 48. In FIG. 19, block 602 is labelled "cross" and indicates the situation where the temperature requested by the user is the same as the temperature sensed by the unit 80, i.e. the two temperatures have "crossed". In this condition both the low and high speed fan and any valves are turned off (block 603). In addition the "season" and certain failure timers are reset. This will be explained later.

Figure 20:
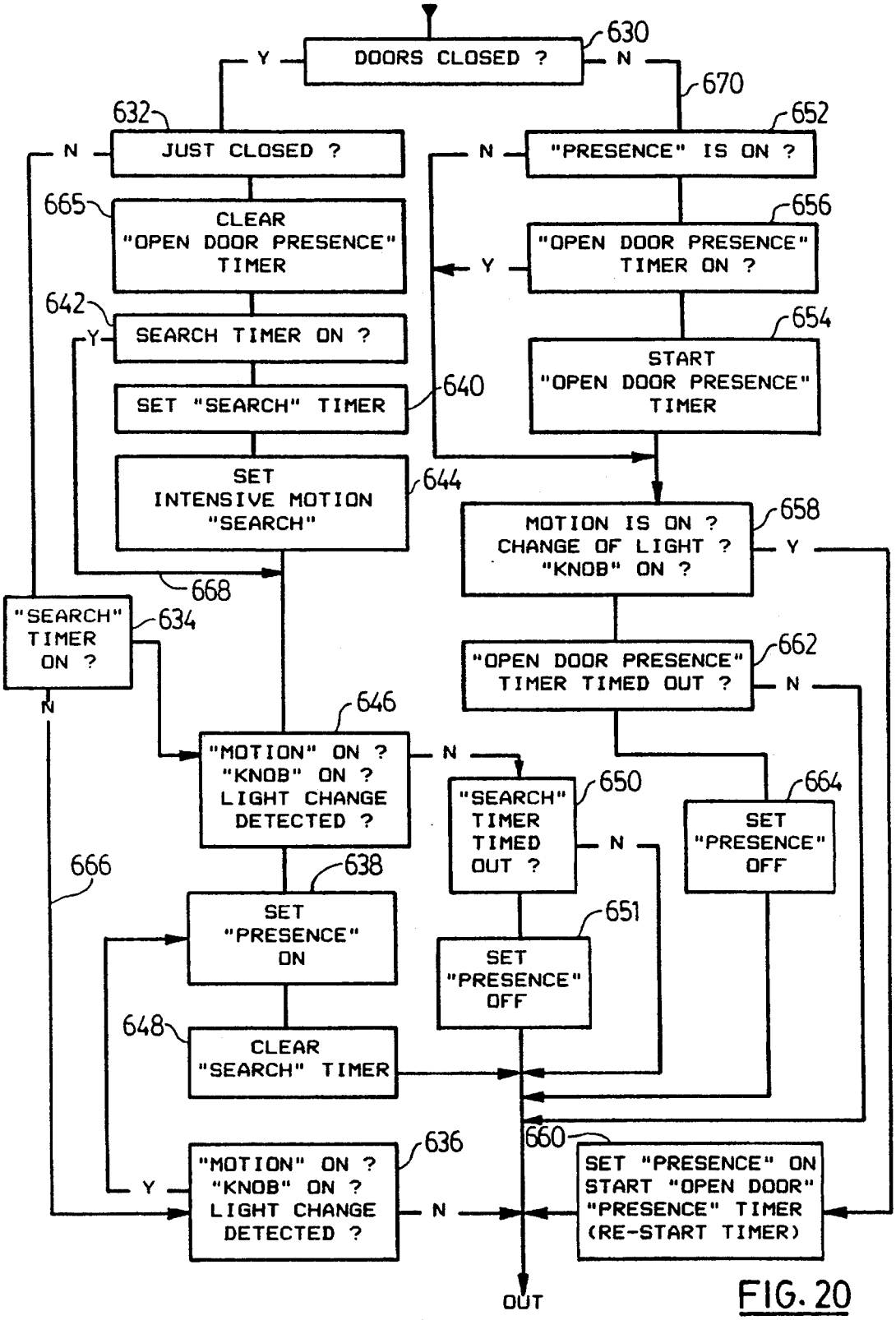
FIG. 20 is a logic flow chart for presence determination.

All temperatures shown in FIG. 20 are in centigrade. Assume that the temperature now begins to drop (e.g. because it is winter). The routine takes the path of the arrows and temperatures shown at the right hand side of blocks 604,606,608. When the temperature drops to 1.6° below the cross temperature, the low fan is set, i.e. it turns on (Block 605). This circulates the air in the room so that the thermistor 154 will more accurately read an average or comfort temperature in the room and not merely the temperature of the air near the wall. This occurs before the hot or cold valve 46 or 48 is set.

When the temperature read by the thermistor 154 falls to 2° below the cross (block 606), the high fan is set (block 607). The high fan provides more vigorous air circulation to help ensure that the thermistor 154 reads an average temperature in the room.

When the temperature falls to 2.4° below the cross (block 608), the hot valve is set (block 609). In addition the season is set, and the failure timers are set or started, as will be explained.

The setting of the fan before the valve is set provides an important comfort advantage and energy saving. In winter the window temperature can be 0° and the temperature near the bed can be 10°, while the thermistor reads 21° to 23°. If the fan were left on all the time, it would consume energy and its bearings may burn out. Turning it on when the temperature falls a certain amount below the cross (all temperatures given are illustrative only) helps to ensure that the thermistor will read a temperature closer to an average comfort temperature (i.e. a temperature between that which would have prevailed near the wall and near the middle of the room had there been no circulation).

Now that the hot valve is set (block 609), the room begins to heat. When the temperature rises to 0.8° below the cross temperature (block 604), the high fan is turned off (block 605) but the low fan continues to operate. When the temperature reaches the cross temperature (block 602), the fan and the valve are turned off and the timers are reset as will be explained.

The operation is exactly reversed during the summer when the temperature rises from the cross temperature after the fan and valves are set off. This operation is shown at blocks 610 to 615 of FIG. 19.

As will be explained later, various conditions override the normal operation of the fan and valves. Among these conditions are emergency and evacuation conditions (in which the flow of air to rooms on fire is limited as will be described), a check-out condition in which fresh air is cycled to clear smoke or odors, and an HVAC failure in which the fan and valves are not forced if they fail.

Further it will be realized that instead of a room fan, other air flow means (e.g. dampers and a central fan) could be used.

Presence (FIG. 20)

The determination of presence in a room will next be described, with reference to FIG. 20. As there shown, the first determination (block 630) is whether or not the door is closed (determined by the door switch 110). If the door is closed, the next determination is whether or not it was just closed (block 632). This is determined by counting the number of cycles through the flow chart since the door was closed. If the door has only been closed for a few seconds, it is considered to have been "just closed".

Assume that the door is closed but not just closed (i.e. it has been closed for more than a few seconds) and that the search timer (to be described) is not on (block 634). Then as indicated at block 636, if the motion sensor 140 senses motion, or if a button 88, 92 or 96 is operated (referred to as a "knob" in the drawings), or if the photo sensitive resistor 150 detects a light change, then "presence" is set on (block 638). If none of the above is detected, the routine cycles to "out". In this routine the motion sensor 140 detection operates in its normal mode, requiring a 4 to 5 second pulse (as previously described) before declaring that there is motion.

Assume that the door has just closed (block 632). In that case the guest may or may not have just left. Then a 15 minute intensive motion search timer is set (block 640) if it is not already on (block 642). Intensive motion search is then set (block 644). In this mode, a shorter pulse is required from the light sensor, and shorter pulses from the motion sensor, to declare presence. For the motion sensor this means that pulses of 1.4 seconds or more are declared as "motion" instead of requiring a pulse of 4 to 5 seconds or more. The likelihood of false indications of presence is increased, but the likelihood of detecting any motion and therefore a presence in the room is also increased. (False signals are sometimes caused by sun ray movement, but in 15 minutes the likelihood of this occurring is low.) For the light sensor 150, a change in light signal (and hence in logic state) of about 0.4 seconds is normally considered to represent a change in light produced by a person, but in intensive search mode during the 15 minute interval, any change in logic state produced by a light is considered to indicate presence.

If during intensive search motion, knob operation or a light change are detected (block 646), presence is set on (block 638) as before. Once this occurs, the search timer is cleared (block 648). If during intensive search no motion is detected and the search timer times out (block 650), then presence is set off (block 651).

Next, assume that the door is not closed, i.e. it is open (shown by the right hand side of the flow chart of FIG. 19). The first test is whether presence is on (block 652). If presence is on, and since the door is open, an open door presence timer is started (block 654) if it is not already on (block 656). The open door presence timer is typically 15 minutes. While the open door presence timer is on, the motion and light sensors and knobs are read (block 658). If there is any change here, resulting in a "yes" from block 658, presence is set on (block 660) and the open door presence timer is started (if it was not on) or re-started (if it was on).

If there is a "no" from block 658, and if the open door presence timer has timed out (block 662), then presence is set off (block 664). If the door closes while the open door presence timer is on, this timer is cleared (block 665).

It will be noted from the foregoing description that when the door is closed but has not just closed, and presence has been set on, presence is then latched on so long as the door remains closed. This is because branch 666 has no "set presence off". There are two usual ways in which the presence is set off. One way is if the door opens and then closes, in which case the occupant may have left. In that case, the routine takes branch 668, and if after an intensive search no motion, knob or light change is detected, then the presence is set off at block 651. Here, presence is not set off until 15 minutes after the occupant has left.

The other way in which the presence can be set off is if the door is left open. When this occurs, the routine takes branch 670. Then (see block 658) if there is no motion, change of light or change of a knob or button setting, and once the open door presence timer (15 minutes) times out (block 662), the presence is set off (block 664). In addition, since a person will not usually remain in a hotel room continuously for 24 hours, if there is presence for 24 hours and no motion during the entire 24 hours, then presence is cleared and a security message will be sent to the hotel terminal (not specifically illustrated).

If a presence indication has been erroneously set on because in the high sensitivity search mode a false indication has occurred, then as mentioned there is no way to set this presence signal off if the door is not opened. However if no movement or confirmation of the presence occurs for a predetermined time period, then a "no presence" alarm will be given, calling to the attention of the front desk that there is a problem. The no presence alarm will be described later in this description.

It will be noted that when the door is open, then each time motion occurs, the open door presence timer (block 660) is reset and its 15 minute cycle is re-started. There must be no motion for 15 minutes before the presence is set off with the door open.

If the door is closed with the open door presence timer on, this timer is cleared (block 665). In addition, if the door opens while the search timer is on, then the search timer is cleared (not shown).

It should be noted that if presence was cleared at any time, and the door is now closed, and there has been no change in the door status, and if an emergency or evacuation situation occurs within 30 minutes (an adjustable parameter) of the presence indication being cleared, then the presence status is restored (as will be explained). This is simply a safety factor, to help ensure that in the event of emergency or evacuation, there is less likelihood that a person in a room will be overlooked.

It will be noted that the presence flow chart 101 embodies the following logical determinations.

1. Motion+door opens+door closes+no motion= no entry. In other words, a person in the room has left and no one has entered. This is exemplified by the left hand side of FIG. 20, where the door is closed; it has just closed, the search timer has been on and has timed out, and no motion, light change or knob operation have been detected. In this case the presence is set off (block 651).
2. No motion+door open+door closed+motion= entry. This again is exemplified by the left hand side of flow chart 101, where the routine moves from door not just closed (block 632), search timer not on and no change detected (block 636), and presence not on, to the door just closed (block 632) and a change is detected (block 646), thereby setting presence on (block 638).
3. Motion+door open+door closed+motion=no change. This is exemplified in FIG. 20 which shows that presence is on (since there has been motion); the door opens and then closes, resulting in a "just closed" condition, and motion is detected (block 646), thereby again setting presence on (no change).
4. No motion+door open+door closed+no motion =no change. Here, the presence was initially off. When the door opens and then closes, an intensive search occurs, but since no motion is detected, there is no change.

The presence or absence of the guest is used in numerous determinations in the method of operation in the system, as will be described.

Figure 21:
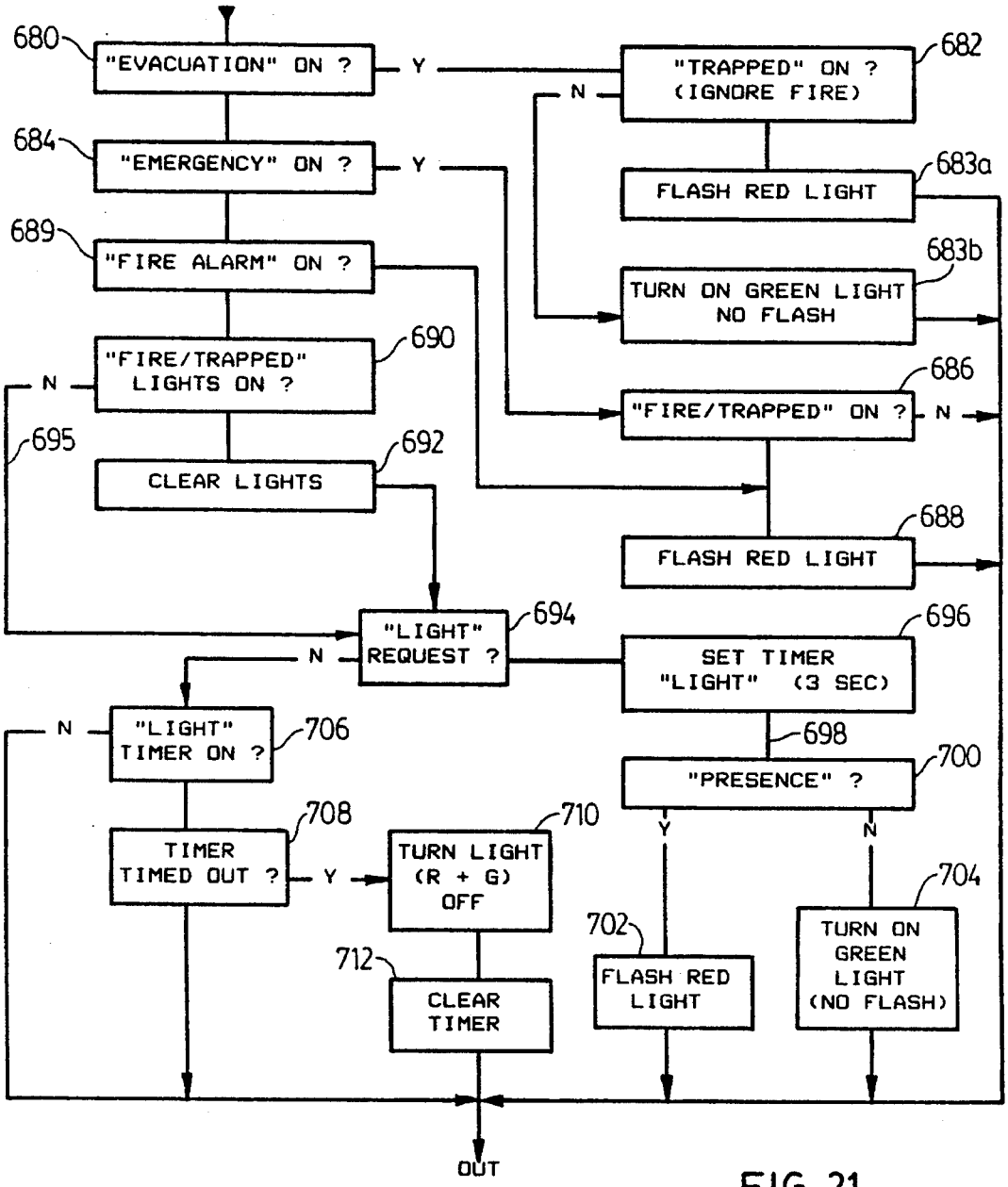
FIG. 21 is a logic flow chart for the operation of the outdoor red/green lights.

Outdoor Red-Green Lights (FIG. 21)

Next, the operation of the outdoor red and green lights or LED's 164, 166 will be described, with reference to the flow chart of FIG. 21. The outdoor red or green LED's are typically operated in the following circumstances. Firstly, if a maid wishes to clean the room, she holds her magnetic key against the panel 160 over the reed relay 162 for a short period of time, typically 5 to 10 seconds. If there is no one in the room, the green LED 166 will turn on for a short time, e.g. two seconds. If there is a person in the room, the red LED 164 will flash for the same time.

Another set of circumstances in which the outdoor red and green LED's will operate is if there is a fire condition (fire alarm in one room) or an emergency situation (fire alarm in two rooms or in two different ceilings), or if there is an evacuation condition (more than two valid fife warnings in the same wing at the same time). The fire alarm operation will be described presently, but the operation of the red/green LED's is as follows with reference to FIG. 21.

As shown, the first test is whether there is an evacuation condition (block 680), i.e. 3 or more fires. These fires can be in the room in question and two other rooms, or in three other rooms. If the answer is yes, the next question is whether a person is "trapped" in the room, i.e. whether there is a person present in the room (block 682). If the answer is yes, then the red LED 164 is flashed (block 683*a*). If the answer is no, then the green LED 166 is turned on without flashing (block 683*b*). When this occurs, fire fighters moving down a hallway can immediately see whether there is a person in a room who needs to be rescued. If the green light is on, this is a verification that there is no person in the room. If no light is on, this indicates that the light or the unit for the room has failed, and then the fire fighting personnel can take appropriate measures.

If there is no evacuation situation, the next question is whether there is an emergency on (block 684). An emergency situation means that there is a fire alarm in two rooms or two different ceiling sensors. The fires can be in the room in question and one other room, or in two other rooms. If there is an emergency on, then the next question is whether a person is present in the room, i.e. trapped (block 686). If the answer is yes, the red LED 164 for the room is flashed (block 688). If the answer is no, the routine cycles to "out". In this situation guests in the main parts of the hotel are not alarmed by having all the green LED's light up since there is not an evacuation situation.

If there is no evacuation or emergency, the next question is whether there is a fire in the room in question (block 689). If so, the red LED 164 for the room is flashed (block 688). No other red or green LED's are lit at this time.

If there is no evacuation, emergency situation or fire, the next step is to see whether there are any fire/trapped lights, i.e. red or green LED's, on (block 690). If there are, the lights are cleared (block 692) and the next step is to see whether there has been a request (by a maid) for a light (block 694). If the red/green LED's are not lit, the routine proceeds directly (branch 695) to the light request block 692.

If there is a light request, a two or three second light timer (block 696) is set. The routine then proceeds via branch 698 to determine whether presence exists or not (block 700). If there is presence, the red LED 164 is flashed (block 702) for the duration of the light timer (e.g. three seconds). If there is no presence, the green LED 166 is lit steadily (no flash) for three seconds (block 704).

If there is no light request, the routine asks whether the light timer is on (block 706). If the light timer is on but has timed out (block 708), the red or green LED is turned off (block 710) and the timer is cleared (block 712). If the timer at 708 has not timed out, then the routine cycles to "out" for the next repetition.

It will be seen that the arrangement described performs several functions. Firstly, it tells the maid, inspectress or other hotel staff person whether or not there is a person in the room before opening the door and bursting into the room, thereby avoiding embarrassment to the maid and to the guest. It also informs fire fighters whether there is a person trapped in the room so they will know which doors to check first, i.e. it defines an order of priorities. In addition in an emergency situation it will light all of the green lights where rooms are unoccupied, to provide an extra verification as to whether or not the unit is working.

It will noted that in an evacuation situation, a transmission is sent by the central computer 170 to all of the room units 80. However since each room unit 80 receives the messages sent by all of the other room units, the room units themselves can determine when an evacuation situation has occurred and can make the appropriate red or green LED selection even if the wires to the main computer are inoperable.

It will also be noted that in an evacuation situation, the red LED 164 flashes only if a person is trapped (block 682), and not if there is a fire but no person in the room. In this extreme situation, one is not looking for the fire (which in any event can often be seen) but only whether a person is trapped. "Trapped" in this situation means presence plus an evacuation condition.

However in an emergency (not an evacuation) situation, it will be seen that the red LED 164 flashes if a person is trapped in the room, or if there is a fire detected in the room. The red LED then indicates either a person trapped or a fire. There is no green LED lit in this situation.

Therefore, it will be seen that the outdoor red/green lights have multiple functions. They serve to indicate whether a person is trapped, and/or whether there is a fire in the room, and whether the unit is functioning in case of an evacuation situation. They also serve, upon request by the maid, to indicate whether a person is or is not present in the room, i.e. whether the maid may enter. They also indicate the nature of the event: if only red lights are flashing, the event is local, but if the green lights come on, this indicates that the event has become global.

While FIG. 21 illustrates three levels of decision (fire, emergency or evacuation), one could instead provide only two levels, e.g. fire and a second level which could be called emergency or evacuation—say evacuation. In that case blocks 684 and 686 would be omitted from FIG. 21, i.e. the emergency level would be omitted.

Figure 22:
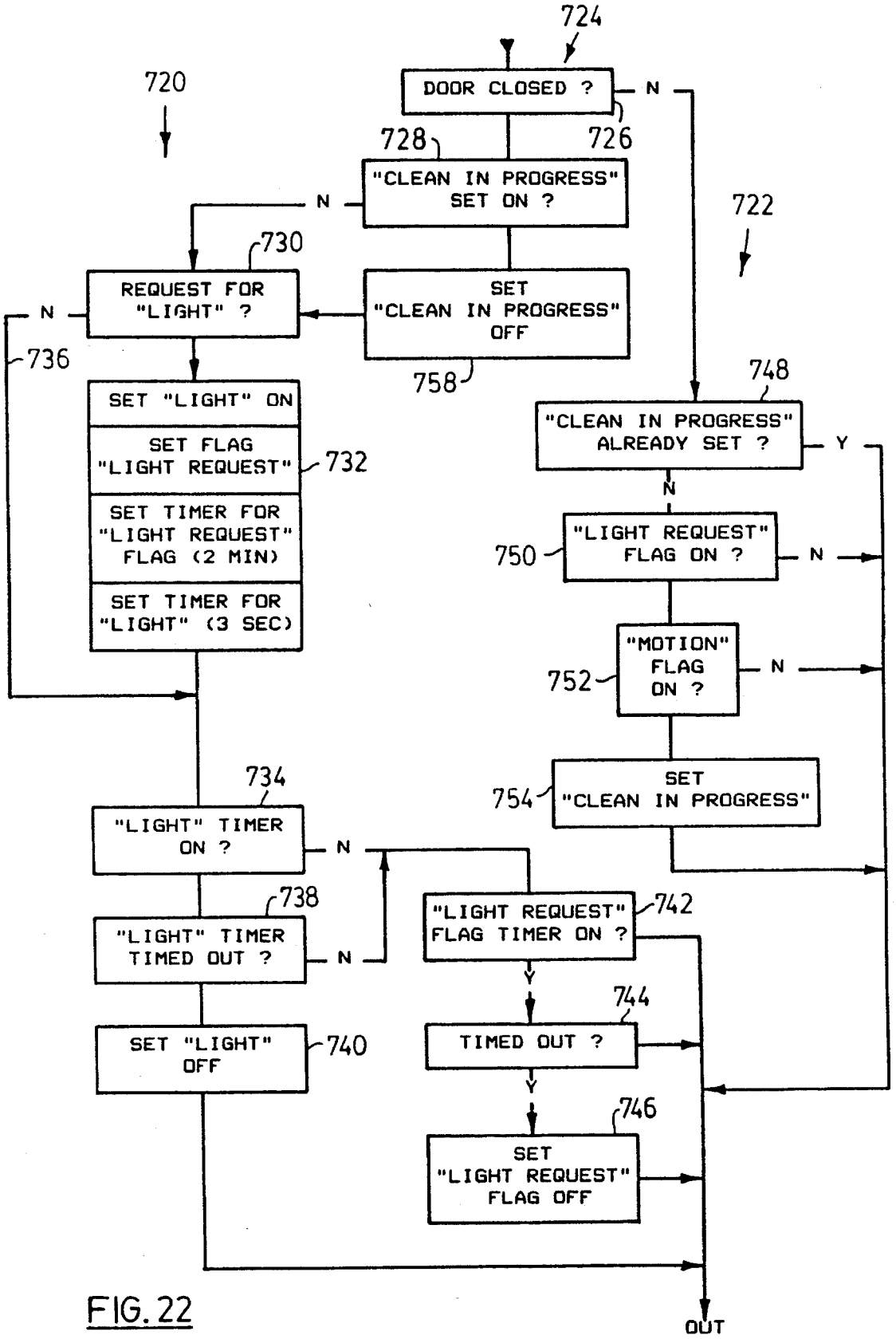
FIG. 22 is a logic flow chart for cleaning in progress.

Cleaning in Progress (FIG. 22)

Reference is next made to FIG. 22, which shows the flow chart for cleaning in progress. This is an important indication for a hotel front desk, since it allows the front desk to see at a glance, on a screen (as will be described) which rooms are in the course of being cleaned and also where at least some maids are at any given time.

With reference to FIG. 22, as a general overview, when the door is closed and the maid makes a request as to whether or not there is a person present in the room, the left branch 720 is taken. Then, when the maid comes in and begins to clean (in which case she invariably leaves the door open), the routine takes the right branch 722. When the maid leaves, and "clean in progress" is turned off, the routine takes the middle branch 724.

In more detail, assume that the door is closed (block 726) and the "clean in progress" indication has not been set on (block 728). The routine then takes branch 720. If there is a request by the maid for the red/green LED (block 730), then (see block 732) the appropriate LED is turned on; a flag is set for "light request"; a 2 minute timer is set for the light request flag; and a 3 second timer is set for the red/green LED. It will be noted that whenever there is a reference to a "flag", this simply means that a bit is set in memory representing a condition which has been detected.

After block 732, the next question is whether the light timer is on (block 734). If there has been no request for an LED during the cycle in question, then the routine moves directly via branch 736 to block 734. If the light timer is on, then the next question is whether it has timed out (block 738). If it has timed out, then the red/green LED's are turned off (block 740) and the routine cycles to "out". If the light timer is not on then the routine checks whether the light request flag timer is on (block 742). If the answer is no, the routine cycles to "out". If the answer is yes, then if the flag timer is timed out (block 744), the light request flag is set off (block 746). If the timer has not yet timed out, the routine cycles from block 744 to "out".

The 2 minute timer for the light request flag gives the maid two minutes to enter after she has requested an indication whether a guest is present or absent in the room. If the maid does not enter within the two minutes, the request light timer times out (block 744); the flag is set off as indicated (block 746), and any entry after that time is not declared to be the entry of the maid unless a fresh request for the red/green LED's 164, 166 is made.

Assume now that the maid has come in and is cleaning the room. In that case the door will be open and the routine moves to its right branch 722. Assume that this process has just begun so that the "clean in progress" indication (Block 748) is not yet set. The routine then asks whether the light request flag is on (block 750). If this flag is not on, the routine cycles to "out". If the flag is still on (i.e. it is within two minutes of the maid's entry), the routine next moves to block 752, i.e. is there any motion. If the answer is no, the routine cycles to "out". If the answer is yes, the "clean in progress" indication is set (block 754). This indication which will appear on a computer terminal screen wherever desired in the hotel (as will be described). The hotel will then know that the room is in the process of being cleared, and will also know where the maid is.

If the maid opens the door but does not enter the room because she is cleaning two or three rooms at the same time (which is not normally permitted but often occurs), then if she opens the door sufficiently to see into the room, her motion will be detected by the motion sensor 140 and will be recorded as motion, and the clean in progress indication will be set as indicated by branch 722.

Assume that the maid has now finished cleaning and leaves the room. In that case she closes the door, (block 726). Since the door is closed, the routine checks whether "clean in progress" is on (block 728). If the answer is no, the routine cycles through branch 736 to "out". If the answer is yes, then "clean in progress" is set off (block 758) since the cleaning has now been finished. (Not shown is a further feature which allows the maid while in the room to close the door for up to 15 seconds to clean behind the door, without this having any effect on "clean in progress".) The question of whether the cleaning was a "valid" cleaning will be next be addressed.

Figure 23:
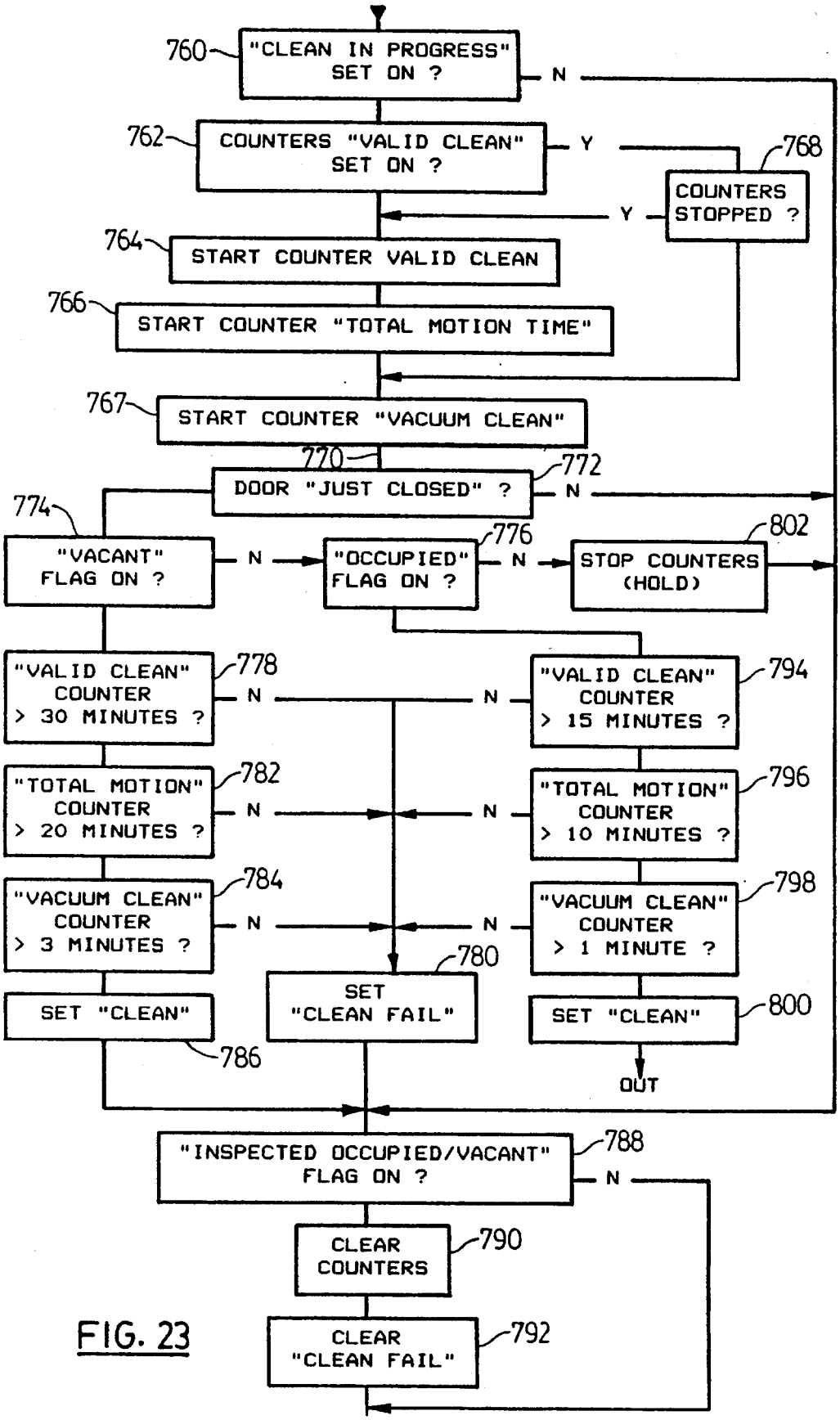
FIG. 23 is a logic flow chart for valid cleaning.

Valid Cleaning (FIG. 23)

Reference is now made to FIG. 23, which shows the sequence of steps which occurs to determine whether a cleaning process has resulted in a "valid" cleaning of the room. If the required tests are met, a valid cleaning will be deemed to have occurred and the room will be indicated as being "cleaned". If the required tests are not met, then the room will not be shown as "cleaned".

As shown in FIG. 23, the first step in the routine to determine valid cleaning is to see whether "clean in progress" is set on (block 760). The routine then asks if the counter "valid clean" been set on (block 762). If the answer is no, this counter is started (block 764) and in addition the routine starts a total motion time counter (block 766) and a vacuum cleaning counter (block 767). If the answer was yes, then the routine checks whether the counters are stopped (block 768) and then goes to point 770.

The valid clean timer confirms the minimum activity which is necessary adequately to clean a hotel room. In the example shown in FIG. 23, this time is 30 minutes for a newly checking in guest (20 minutes for the room and 10 minutes for the bathroom) and 15 minutes for a staying over guest (10 minutes for the room and five minutes for the bathroom). These times are of course adjustable, which is why counters rather than timers are shown.

The next question, at point 770, is whether the door has just closed (block 772). (As discussed, this indication occurs immediately after the door closes; the door is not registered as "closed" until several seconds have elapsed after the event.) If the answer at block 772 is yes (i.e. the maid has left the room and closed the door), then the routine checks whether the "vacant" flag or the "occupied" flag is on (blocks 774, 766). It will be recalled in the description of the room control unit 80 that it has two reed switches, one switch 384 on the left side of the unit and one switch 386 on the right side of the unit. When the maid has finished cleaning, she holds her magnetic key to one of these two switches, namely the right switch if the room is vacant (no luggage in the room) and the left switch if the room is occupied (luggage in the room). This sets the appropriate internal flag (vacant or occupied) and provides an indication on the terminal at the hotel front desk. (If she activates the right switch, a green LED lights on the unit; if she activates the left switch, a red LED on the unit lights.)

If the maid has held her key to the "vacant" reed switch 386, then the vacant flag will be on (block 774). The next question is whether the valid clean counter has counted for more than 30 minutes (block 778). If not, then since the maid has operated the reed switch, has closed the door and presumably will not do further cleaning, "clean fail" is set (block 780). If the valid clean counter has counted for more than 30 minutes, then the next question is whether the total motion counter (block 782) has counted more than 20 minutes. The total motion counter indicates the total time during which motion has occurred in the room. The total motion counter requires considerable activity. A motion must trigger the motion counter for five to six seconds, and then within such five to six seconds there should be another motion. However if the maid stops for a minute, additional time will accumulate on the next motion, provided that the door remains open (i.e. cleaning in progress continues). If the total motion counter does not accumulate at least 20 minutes, "clean fail" (block 780) is set as before.

If the total motion counter has accumulated at least 20 minutes, then the next question is whether the vacuum cleaning counter has operated for at least (for example) three minutes (block 784).

The operation of the vacuum cleaner is detected by analyzing the sound picked up by the speaker/microphone 158. Virtually all portable (not central) vacuum cleaners have highly distinctive sound patterns. Specifically, nearly all vacuum cleaners have highly audible harmonics at between 15.5 KHz and 19 KHz from their air inlets, at a sound pressure level between 82 and 84 db. Simultaneously they produce a similar sound pressure level (82 to 84 db) at a frequency of between 100 and 120 Hz from their air inlets. If sounds in this sound pressure level range are detected in the two frequency ranges while cleaning in progress is on in question, this indicates that the vacuum cleaner is operating. If the vacuum cleaner has operated for e.g. three minutes, then it is assumed that adequate vacuuming has occurred.

If the above three conditions are met, i.e. there has been cleaning for at least 30 minutes (block 778), total motion for at least 20 minutes (block 782), and use of the vacuum cleaner for at least three minutes (block 784), then "clean" is set (block 786). If any of the above conditions is not met, then "clean fail" is set (block 780). Both these messages are sent to the central computer and are displayed on terminals at the hotel front desk and otherwise where required.

It will be realized that the above tests for valid cleaning can be changed as desired. For example in hotels where vacuum cleaners are not always used, the vacuum cleaning requirement can be omitted.

Once "clean" or "clean fail" has been set, an inspectress may visit the room. If the inspectress finds that the room is satisfactory despite the "clean fail" indication, she will apply her key to the appropriate reed switch 384,386 and her key will be decoded to indicate that the room has been inspected vacant/occupied. If she has used her key to confirm the maid's message and then closes the door, this sets an inspected occupied or vacant flag (block 788). The counters will then be cleared (block 790) and any "clean fail" indication will be cleared (block 792) since if she has confirmed the maid's message, then it is assumed that the room is sufficiently clean despite the lack of sufficient cleaning time, motion time or vacuum cleaning time. However if she does not apply her key, then the room is not indicated as being inspected vacant or occupied, and any "clean fail" indication is left in place.

If before the maid left the room she applied her key to reed switch 384 to show that the room is occupied, then the cleaning tests are different. In this case, it is sufficient if the cleaning time has been 15 minutes, the total motion time has been 10 minutes, and the vacuum cleaning time has been one minute (simply to "touch up" the room). If these conditions are met (blocks 794, 796 and 798), then "clean" is set (block 800) and this message is displayed in the central computer and at the appropriate terminals. If the conditions are not met, then "clean fail" is set as before (block 780).

It may happen that the maid will leave the room during the cleaning process and close the door, e.g. because she is taking a break, or because she does not have sufficient towels or other supplies. If this occurs, then she will leave and close the door, without having set the vacant or occupied flags on. The answer at block 776 will then be "no" and all the cleaning counters will be held (block 802). Thus the counters which are accumulating time for valid clean, total motion time and vacuuming time will stop. Then, if the maid re-enters the room after requesting an indication of presence from lights 164, 166, clean in progress will be turned on again (block 760). Since the counter valid clean (block 762) is not on, it and the other counters will be restarted (blocks 764,766,767) and the counters will resume accumulating time. If the maid abandons the cleaning procedure for the room in question, then the inspectress would see this when she visits the room and would either ask the maid to complete the cleaning or would complete it herself (e.g. by completing the small remaining items needed) and would then clear the counters herself by activating the "inspected occupied/vacant" flag (block 788) by using her key on one of the reed switches 384,386.

Instead of a magnetic key the maids and inspectrixes may have small radio transmitting keys, each coded to indicate the identity of the person who has the key. In that case, it is unnecessary to use the occupied and vacant indications as a condition for setting a clean status. Instead, the presence of the maid or inspectress in the room can be determined by reading every few seconds (e.g. four seconds) that she is in the room and that the door is open. If this has occurred for e.g. 30 minutes, and there has been motion for 20 minutes and vacuuming for three minutes, then the room is set as cleaned (block 786) as before (or 15 minutes, 10 minutes and one minute respectively in the case of a stay over guest).

Figure 24:
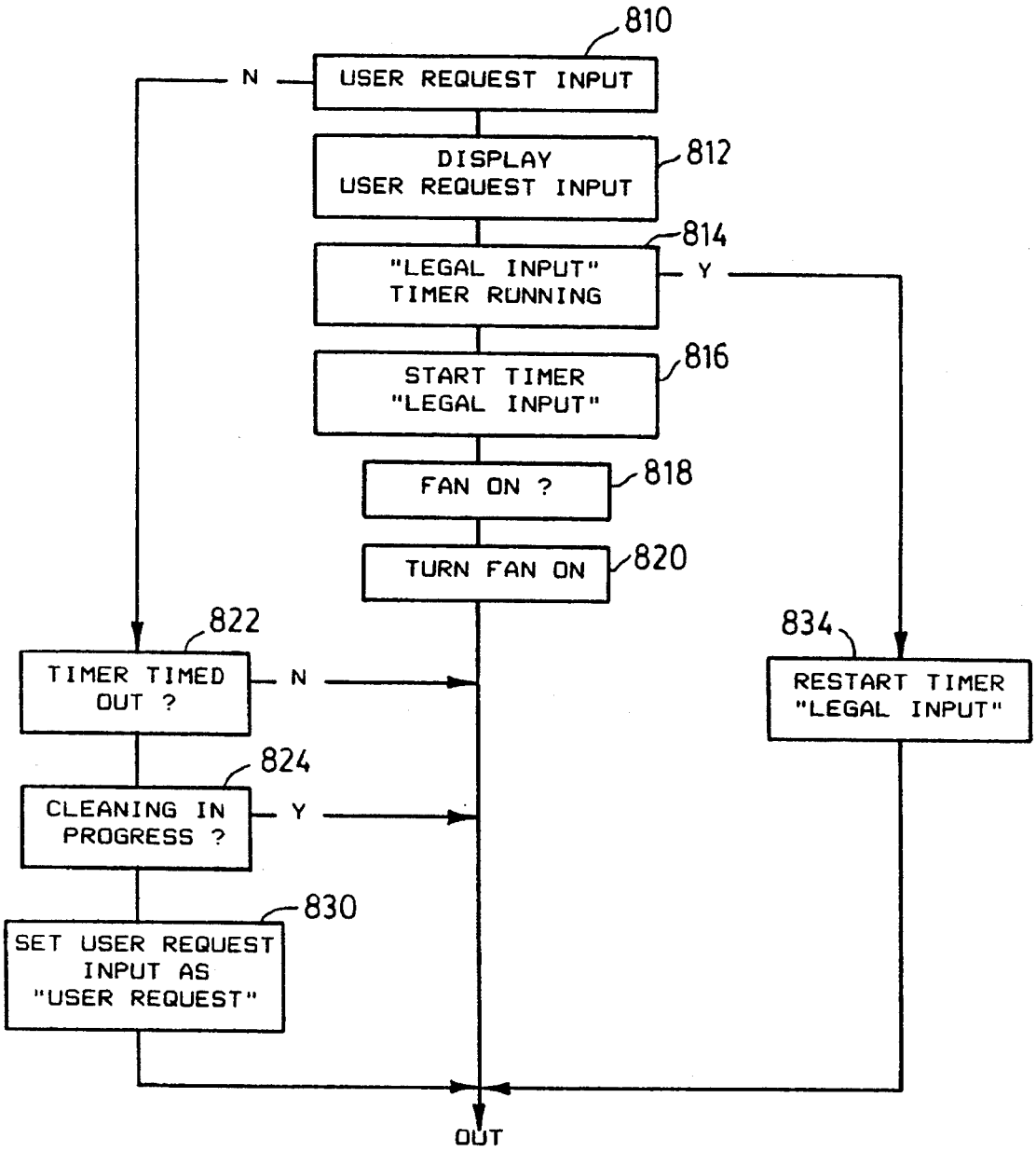
FIG. 24 is a logic flow chart for a user request input.

User Request (FIG. 24)

Reference is next made to FIG. 24, which shows the sequence of steps which occurs when the guest requests a temperature change in the room. Temperature change is requested by pressing the on button 88 if it is not already on, and then by pressing the temperature up or down buttons 92, 96 causing a user request input. As shown in FIG. 24, if a user request input is received (block 810), then it is displayed on the temperature scale 100 by lighting one of the LED's 102 to display the requested temperature (block 812). The next question is whether a "legal input" timer is running (block 814). If not, then it is started or set (block 816).

The legal input timer is a three to four second timer and prevents damage to sensitive HVAC units caused by inconsistent input requirements (i.e. by guests "playing" with the temperature up/down buttons). While no damage will usually be caused to the fan by turning it on and off repeatedly, the valves 46, 48 can be damaged by rapidly turning them on and off. If a compressor were used (for a room unit), it also would be damaged by turning it on and off rapidly.

After the legal input timer is started, a check is made as to whether the fan is operating (block 818). If the answer is no, the fan is turned on (block 820). Since the user's request is displayed on a LED and since the fan is turned on, the user will believe that his or her request has been satisfied and will not realize that the request may not be acted on, as will now be described. The routine then cycles to "out".

On the next pass through the routine, if the temperature up and down buttons have not been touched again, there will be no user request input (block 810).

The next question is whether the legal input timer has timed out (block 822). If not, then the routine goes to "out" for the next cycle. If the timer has timed out, then the next question is whether the cleaning in progress condition exists (block 824). It will be recalled that the cleaning and progress condition occurs (FIG. 22) when the maid has used her key at the outdoor (hallway) red/green lights 164, 166 to determine whether there is a guest present in the room and she has then opened the door and entered the room (block 754 of FIG. 22). If cleaning is in progress, then the user input is ignored in FIG. 24, since only guest inputs and not cleaning staff inputs are responded to. This prevents the maid from disturbing the guest setting. However if desired block 824 can be removed.

If there is no cleaning in progress condition (block 824), the temperature request input is assumed to be a guest input. Then the next step is to set the user request input as a user request (block 830). Normal fan/valve operation is then started as previously described.

If a user request input is received (block 810) and the timer is still running, then it is assumed that the guest is playing with the temperature up/down buttons, and the next step is to re- start the timer (block 834). The routine then cycles to "out" and continues to cycle through the routine.

When the user has finished playing with the buttons, or if the user has not played with them, eventually the legal input timer will time out (block 822) and the user request input will be entered as a user request as previously described (block 830) provided there is no cleaning in progress and the door is not open.

When the on-off button 88 is turned "off", this does not mean that the unit is off. It only means that any user requested temperature is not displayed on the LED's 102, and there is no user generated heating or cooling. However the system will still perform its various automatic functions, e.g. temperature set back (to be described).

Figure 25:
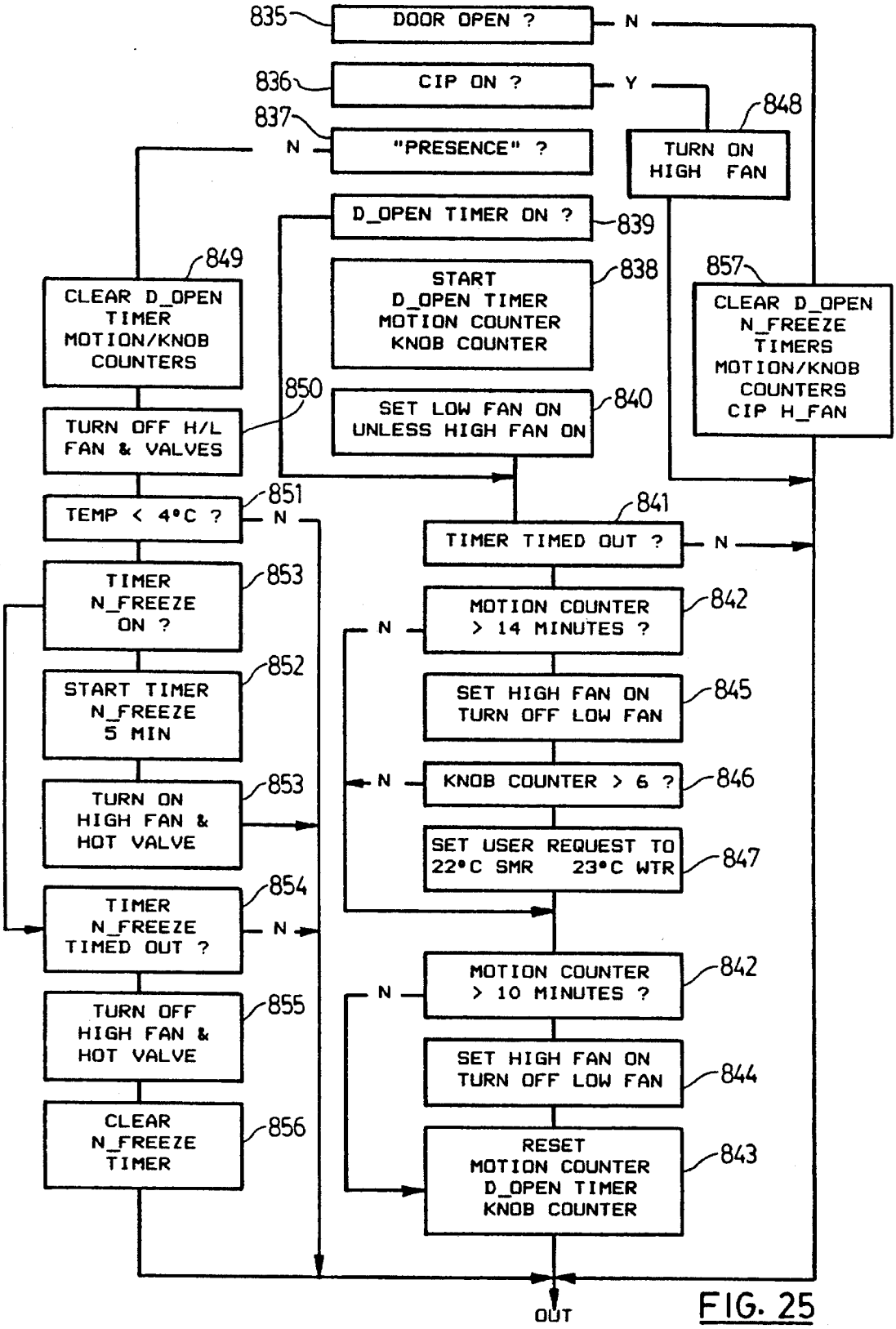
FIG. 25 is a logic flow chart showing operation of the HVAC open door mode.

HVAC In Door Open Mode (FIG. 25)

The open door mode of the HVAC unit is shown in FIG. 25. This deals with the situation that when the door is open, the HVAC may not be able to drive the unit to the requested temperature. In addition, the room may be in use for a meeting or a convention or may be in use to display goods which are being sold, in which case there will be great deal of activity in the room. In addition when there are many people in the room, inconsistent user requests will commonly be set, e.g. one person may request the warmest possible temperature and a few seconds later another person may request a much cooler temperature. Further, the temperature sensed may be affected by air entering from the hallway.

The routine in FIG. 25 deals with this by operating in 15 minute cycles. As will be explained, the first cycle is somewhat arbitrary and causes the low fan to be set on. However if at the end of the 15 minutes there has been motion for more than 10 minutes, a first step is taken by turning and keeping the high fan on. If during the 15 minute cycle there has been continuous motion for more than 14 minutes and the thermostat has been driven through more than six LED changes (each push of an on/off button causes a stepping of one LED along the column of LED's 102), then a standard "user request" temperature is set.

More specifically, assume that the door is open (block 835), that cleaning in progress is not on (block 836), and that presence is on (block 837). In that case a door open timer is started (block 838) if it is not already on (block 839). In addition the low fan is set on unless the high fan is already on (block 840).

The open door timer is (although it need not be) the same 15 minute timer as the open door presence timer (block 654) in FIG. 20. This timer times 15 minutes. If it has not timed out (block 841) the routine cycles to "out". When the timer times out, an assessment is made of whether the motion counter has counted motion for more than 14 minutes (block 842). If not, the next question is whether the motion counter has counted motion during the 15 minute cycle for more than 10 minutes (block 842). If not, the motion counter, door open timer and knob counter (to be described) are reset (block 843). If motion for more than 10 minutes has been counted during the cycle, then the high fan is set on and the low fan off (block 844) and then the counters and timer are reset as before (block 843) for the next cycle.

If the motion counter has counted more than 14 minutes of continuous motion during the cycle (block 842), then the high fan is set on (block 845). If the knob counter has counted more than "6" (block 846), meaning that the LED's 102 on the temperature scale have been stepped through more than six LED's, then a standard "user request" of 22° in summer and 23° in winter is set (block 847). The meaning of "summer" and "winter" will be discussed later with FIG. 29. The reason for the standard user request set in block 847 is that if there has been continuous motion for more than 14 minutes, then it is assumed that there are a number of people in the room, in which the case the room would tend to become warm. Therefore it is set to a relatively low temperature in summer, and even in winter the temperature is set relatively low since a large number of people in the room will tend to heat the room. In addition, excess activity at the knob cannot now affect the HVAC.

If cleaning in progress is on (block 836), then the high fan is turned on (block 848) and the routine cycles to "out".

If at block 837 there is no presence, the door open timer and motion and knob counters are cleared (block 849). The high and low fan and valves are also turned off (block 850). Then if the temperature is less than 4° (block 851), a timer "no freeze" is started (block 852) if it is not already on (block 853). The no freeze timer is simply a five minute timer to help prevent freezing when the door is left open. When the no freeze timer is started, the high fan and hot valve are turned on (block 853). When the timer times out (block 854), then the high fan and hot valve are turned off (block 855) and the no freeze timer is cleared (block 856).

When the door is closed, then the door open and no freeze timers and motion and knob counters are cleared (block 857). Cleaning in progress is also cleared at this time (as previously described) and the high fan is turned off.

Figure 26:
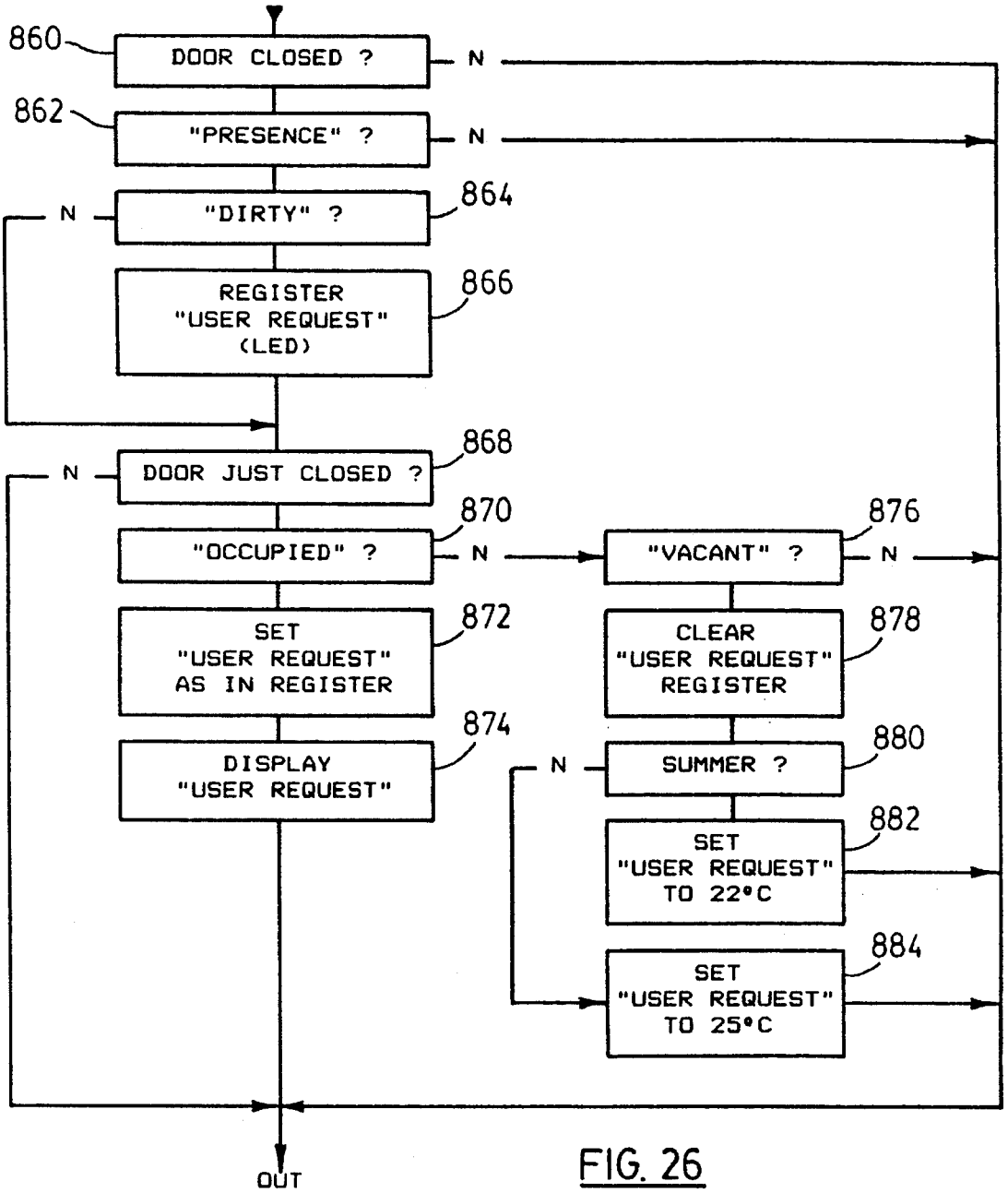
FIG. 26 is a logic flow chart showing auto setting of a user request input.

Automatic Setting of User Request (FIG. 26)

Reference is next made to FIG. 26, which shows the sequence of steps which occurs for automatic setting of a "user request". Often when a newly checked-in guest enters a room, the guest has important things to deal with and does not think of or wish to adjust the temperature immediately. In addition some guests may be handicapped and may not be capable of adjusting the temperature (e.g. very elderly people and children). The sequence of steps shown in FIG. 26 provides automatic adjustment of the room temperature to an average comfort temperature depending on whether the season is summer or winter.

As shown in FIG. 26, the first step is to see whether the door is closed (block 860). If the door is open, the routine cycles to "out". The same occurs if the door is closed and there is no presence (block 862).

If the door is closed, and there is presence in the room, the next step is to determine whether the room is in "dirty" condition (block 864). This condition will be described with reference to FIG. 34, but briefly, it occurs when a room has its door closed, presence has occurred for a predetermined period of time, and there is motion in the room. This indicates that the room has been used and is therefore "dirty", i.e. that a guest has checked in.

If the guest now operates the temperature up/down buttons, the user request is registered (block 866). If the door has not just closed (block 868), the routine cycles to "out" and there is no automatic setting of "user request". If the door has just closed, the next question is whether the room is occupied (block 870). Recall that "occupied" means that the maid has previously signalled that there is luggage in the room. If the room is occupied, then the previous user request (which is in memory) is set on the LED panel 102 and displayed (blocks 866,874) and the temperature is set to the last temperature which the guest had previously requested (block 872) before he or she left the room.

If the door is just closed (block 868) and the status of the room is "vacant" (block 876), this means that a "vacant" (no luggage) indication was previously sent by the maid or inspectress and that the present guest is checking into a previously vacant room. In that case any previous guest request in the memory register (block 866) is cleared (block 878), since the new guest may not like the temperature requested by the previous guest.

The next step is to note whether the "season" is summer (block 880). Only two seasons are used; if it is not "summer", it is "winter". The setting of the seasons will be described presently. If the season is summer, then the "user request" temperature is artificially set to 22° C. (block 882). If the season is not summer, i.e. it is winter, then the user request is artificially set to 25° C. (block 884). These temperatures are generally considered to be average or better than average comfort temperatures. This allows the new guest to deal with his or her other priorities before adjusting the temperature and avoids the need for handicapped or elderly people to adjust the temperature.

In summary, if the room is occupied, the routine sets the previous user requested temperature when the guest is present. (If the guest is not present there will be an appropriate set back as will be described.) Thus, every time the door just closes (in an occupied room), and there is presence, the routine goes to the last requested temperature. However if the room is vacant (no guest has checked into it), then the routine goes to a default temperature, e.g. 22° in the summer and 25° in the winter.

Figure 27:
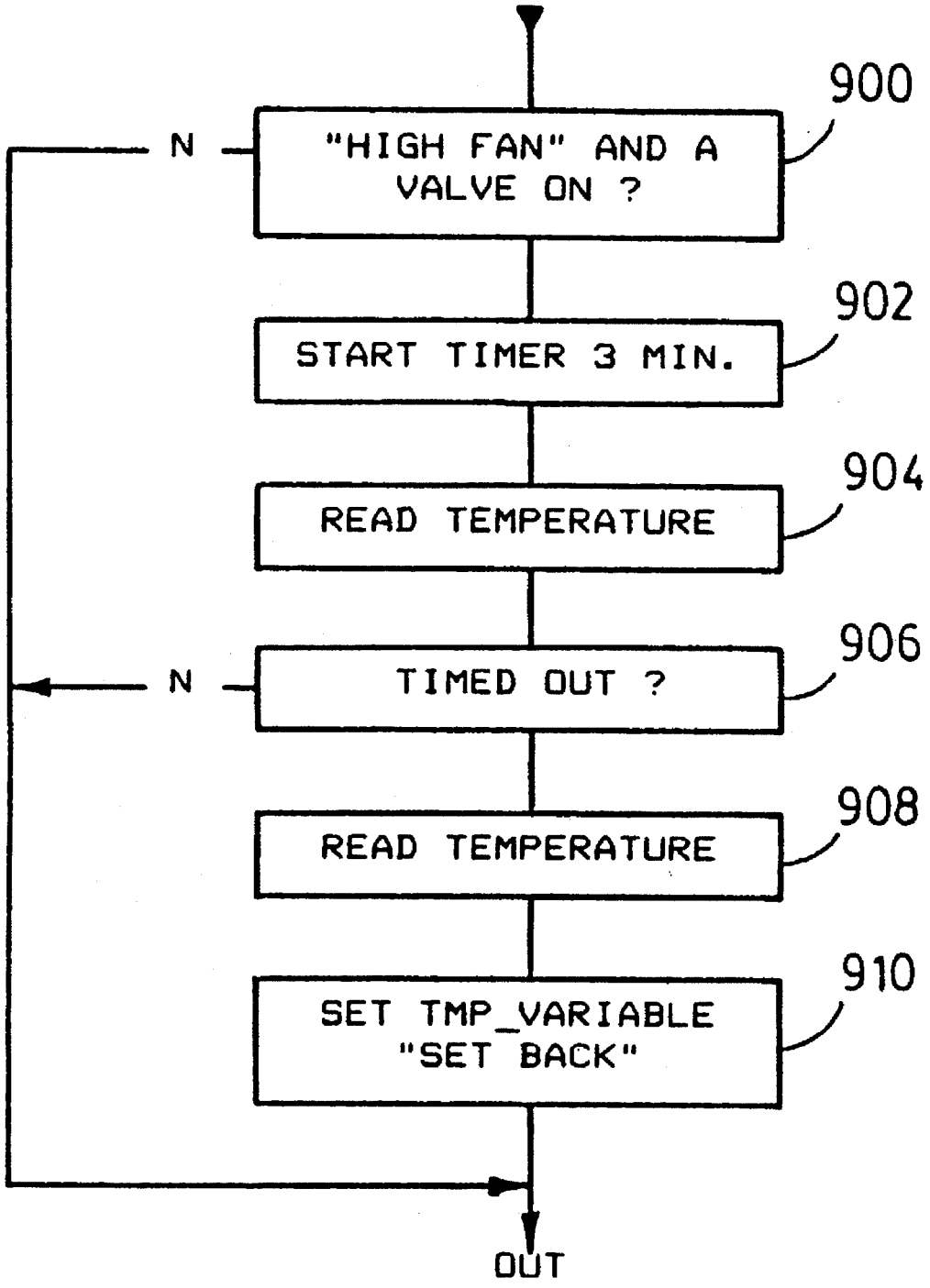
FIG. 27 is a logic flow chart showing establishment of the amount of set back for a room.

Amount of Set Back in Room (FIG. 27)

Figure 28:
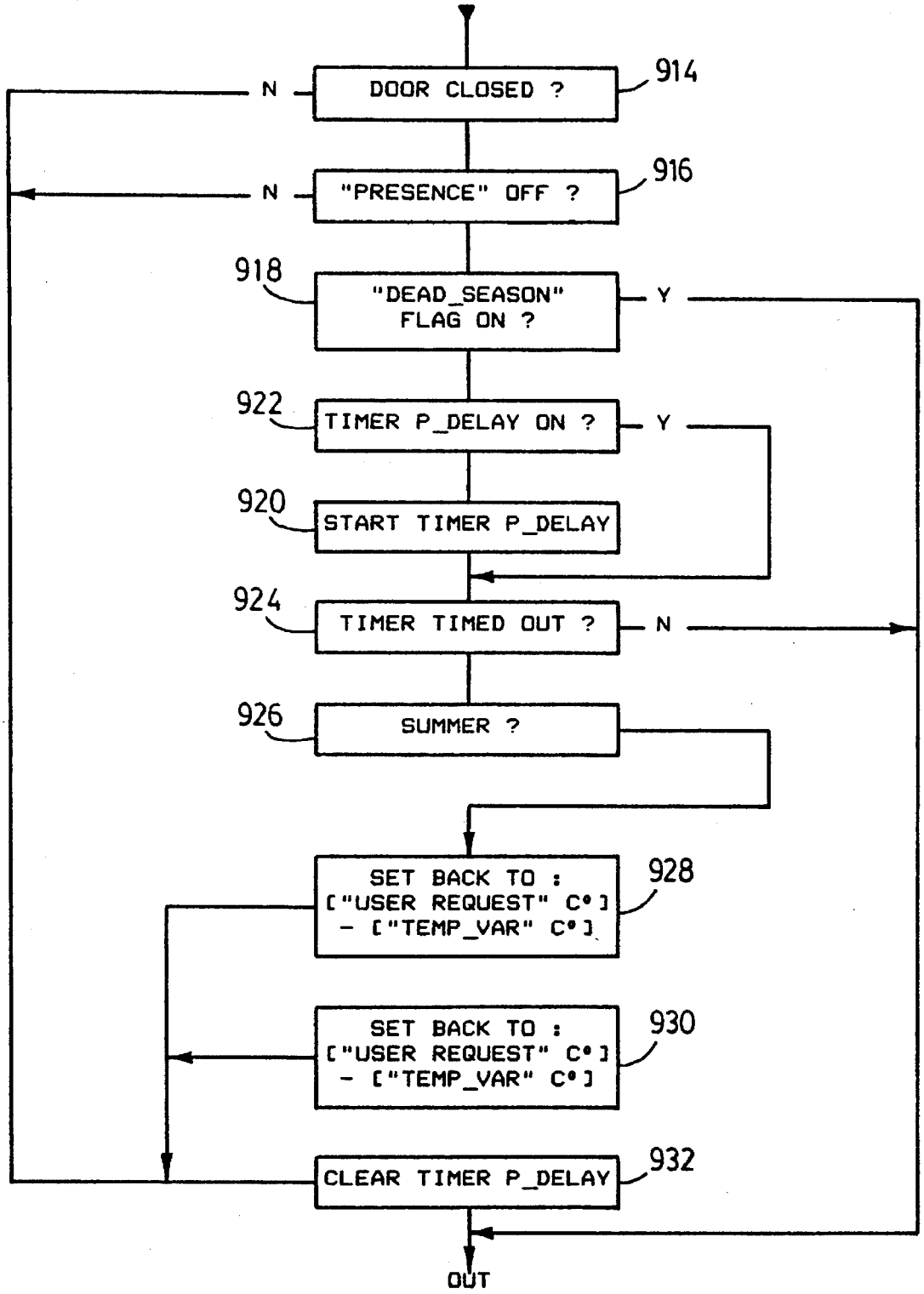
FIG. 28 is a logic flow chart for setting back the temperature in a room.

Reference is next made to FIGS. 27 and 28, which deal with setting back the temperature in a room when the person present leaves the room. This of course reduces energy costs. An important feature here is that the temperature is set back not by a fixed amount, but rather by a floating amount so that the room can recover to the previously set temperature within a predetermined period of time, typically three minutes. This period of time can of course be adjusted. This ensures that the room temperature will quickly return to the level requested by the guest upon his re-entry.

FIG. 27 shows the method of establishing the amount of the set back. FIG. 28 shows when the set back occurs, and FIG. 26 (previously described) shows when the set back is cancelled.

With reference to FIG. 27, which shows establishment of the amount of set back, the first step is to determine whether the high fan and valve are on (block 900). If the answer is yes, then a three minute timer is started (block 902). The temperature is at the same time read (block 904), i.e. at the time when the three minute timer started.

When the three minute timer times out (block 906), the temperature is read again (block 908). The difference is set or registered in memory (block 910) and constitutes the amount by which the room temperature can be set back so that it will recover within three minutes.

Since the amount of the set back is determined anew each time the High fan and valve come on, this routine solves the problem that the amount of set back which can be recovered in three minutes will vary depending on the heat loss characteristics of the room. On very cold winter days it will take longer to heat the room and on very hot summer days it will take longer to cool the room. The same effect occurs during a day as the sun or shade moves across a window. As shown, the amount of the set back will vary automatically, depending on these circumstances.

Setting Back a Room (FIG. 28)

FIG. 28 shows when the temperature in a room is set back. This is independent of whether the room is occupied or vacant. For set back, the door must be closed (block 914) and presence must be off (block 916). In addition the dead season flag (block 918) must be off. This is a flag (to be described later) which tags a room when the entire floor where the room is located is not in use (during low or dead season). In that case, the entire floor is already set back (as will be explained), so no further set back is necessary and the routine cycles to "out".

Once the door is closed and presence is off (and recall that presence does not go off until 15 minutes after the occupant has left, i.e. until after the search timer has timed out), a 10 minute timer "presence delay" is started (block 920) if it is not already on (block 922). The presence delay timer simply allows an entire 10 minutes before the temperature is set back, in case the guest is gone only a short while and returns to his or her room.

If and when the presence delay timer times out (block 924), then the next question is whether the season is summer (block 926). If the answer is yes, then an artificial user request input is set (block 928) equal to the previous user request input plus the amount of the set back established in block 910 of FIG. 27. If it is not summer, it must be winter (since it must be one or the other), and the routine then sets an artificial user request input (block 930) equal to the previous user request temperature less the amount of the set back established in block 910 of FIG. 27.

If at any time before the presence delay timer times out, the door opens (block 914) or presence is re-established (block 916), then this timer is cleared (block 932) and no set back occurs.

As shown in FIG. 26, the set back is cancelled whenever the door is just closed (block 868) and the room is occupied (block 870). Then the user request input is restored to its previous condition, which could be either that requested by the guest or an average or default summer or winter temperature as previously described.

Since the set back procedure requires no manual inputs and does not interfere with guest comfort, it can be used even in hotels where it is desired to pamper the guest as much as possible.

Figure 29:
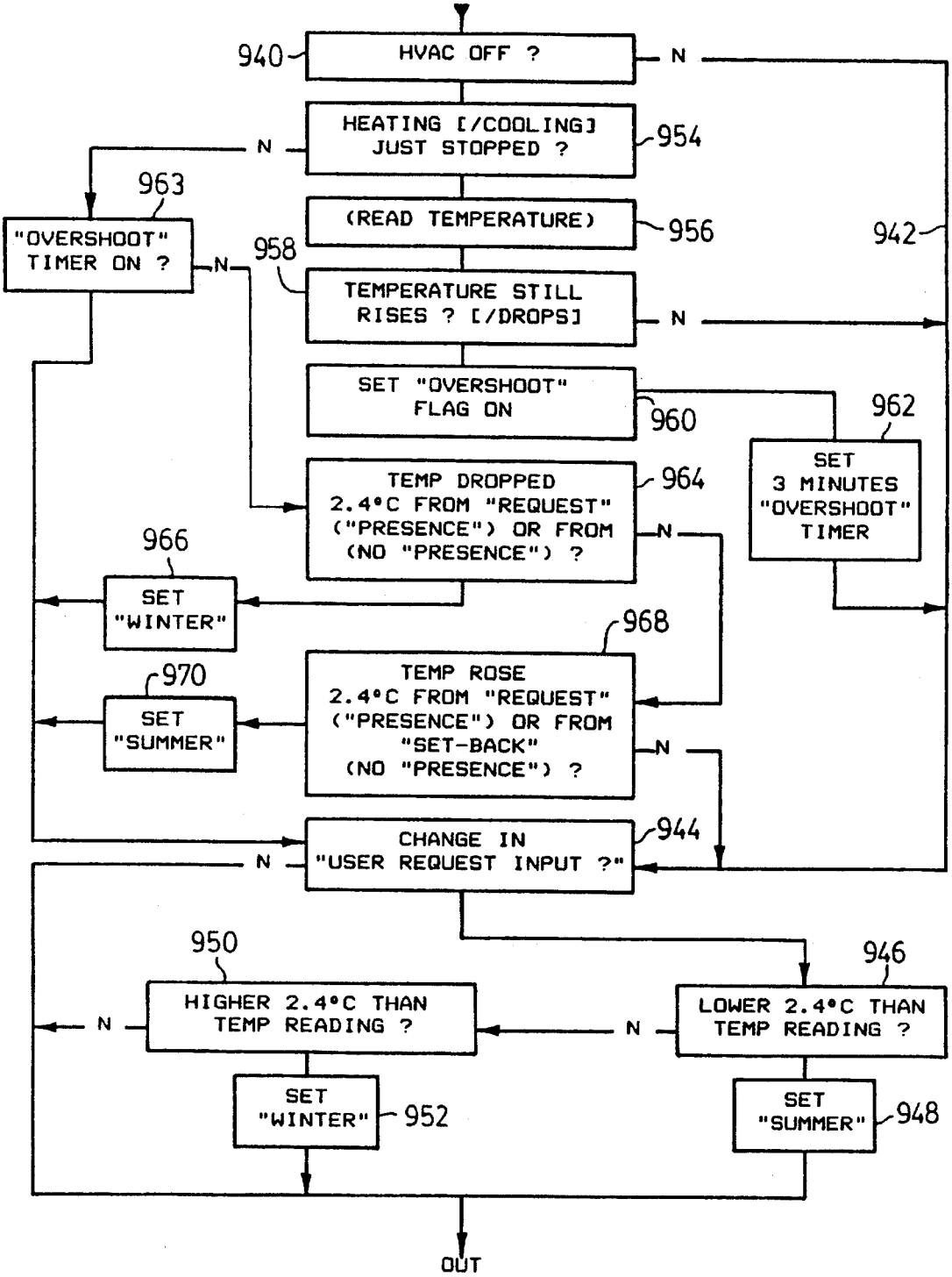
FIG. 29 is a logic flow chart for season setting.

Season Setting (FIG. 29)

As discussed in connection with automatic setting of "user request" (FIG. 26), the system must know whether it is summer or winter in order to know the average or default temperature to which the room should be set if there is no user request from a newly checked in guest. Knowledge of the "season" is also important in assessing HVAC operation to see if there has been a failure. The season is determined as shown in FIG. 29.

The first step in setting the season is to determine whether the HVAC is on or off (block 940). If it is on, then the routine moves via branch 942 to see whether there is a change in the user request input (block 944). If there is a change in the user request input, and if the user has requested a temperature more than 2.4° lower than the existing temperature reading at thermistor 154 (block 946), then the season is set as "summer" (block 948). If the user has set a temperature more than 2.4° higher than the existing temperature reading (block 950), then thee season is set as "winter" (block 952).

It will be seen that the user could fool the system as to whether it is actually summer or winter outdoors, e.g. by requesting, in the winter, a temperature more than 2.4° lower than the existing temperature reading and then leaving the room. In that case the system will set "summer" as described. However the error will soon be corrected, because as will now be described, the season is set not only by reading user requests, but also by determining, with the HVAC off, whether the temperature rises or falls.

Specifically, if the HVAC is off, and the heating or cooling has just stopped (block 954), then the temperature is read (block 956). As the routine cycles through the FIG. 29 flow chart, a determination is made (block 958) as to whether the temperature is still rising or falling (which would occur when the heating/cooling has just stopped since the heat exchange coil 44 will still be hot or cold). If the temperature is still rising or falling, then an overshoot flag is set on (block 960) and a three minute overshoot timer is set (block 962). This allows any overshoot, after the heating or cooling has just stopped, to be completed before the next step, namely checking to see whether the temperature is dropping or rising. (However there is usually little or no overshoot because of the low fan operation near the cross temperature.) However if during the time when the overshoot timer is on, there is a change in user request (block 944) which is more than 2° C. above or below the previous temperature setting, then summer or winter will be set as previously described.

If the HVAC is off, and the heating or cooling has not just stopped (block 954), then a check is made as to whether the overshoot timer is still on (block 963). If the timer is still on, then the routine looks for a change in user request input (block 944) as before and cycles to "out" if there is no such change. If the overshoot timer is not on, then the next step is to see whether the temperature has dropped 2.4° C. from the user request temperature (which can be the actual user requested temperature or can be the set back temperature if the guest is absent from the room). This check (block 964) is repeatedly made, and if and when the temperature has dropped 2.4°, then the season "winter" is set (block 966). If the temperature does not drop but instead rises 2.4° (block 968) from the "user requested" temperature (which can be either the actual guest requested temperature or the set back temperature), then the season "summer" is set (block 970). If the temperature neither rises nor falls with the HVAC off, then the next step is to wait for a change in user request to set the season. However normally if there is a substantial difference between the indoor and outdoor temperatures, the room temperature will in time rise or fall by 2.4°, thereby causing the season to be set. This setting can of course be confirmed or reversed by a change in a user request input (box 944).

Thus, while a user may fool the routine initially by setting the temperature lower in winter or higher in summer, the routine will normally in time set the correct season.

Figure 30A:
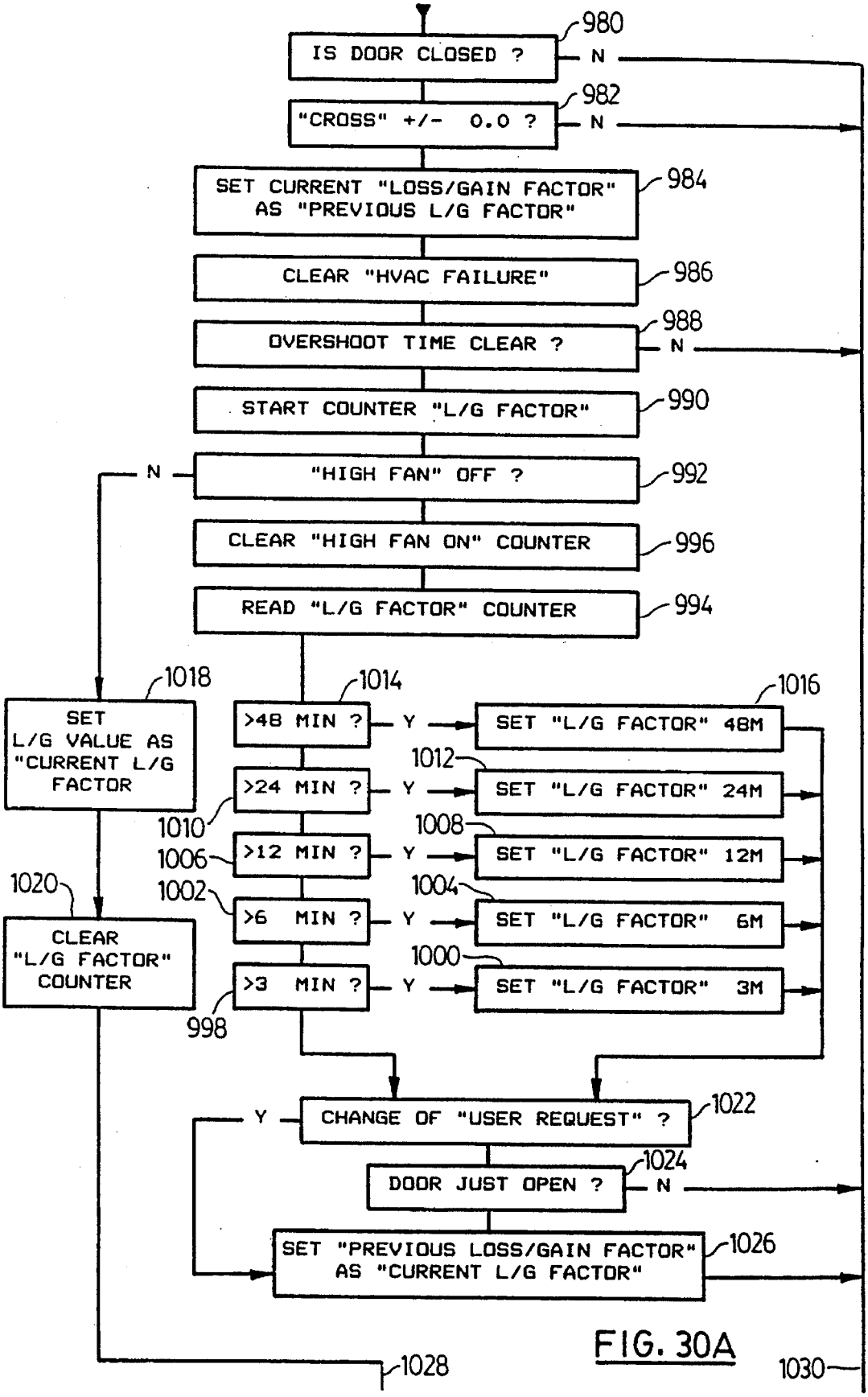
FIGS. 30A and 30B together are a logic flow chart showing determination of the loss/gain characteristic of a room and HVAC failure.
Figure 30B:
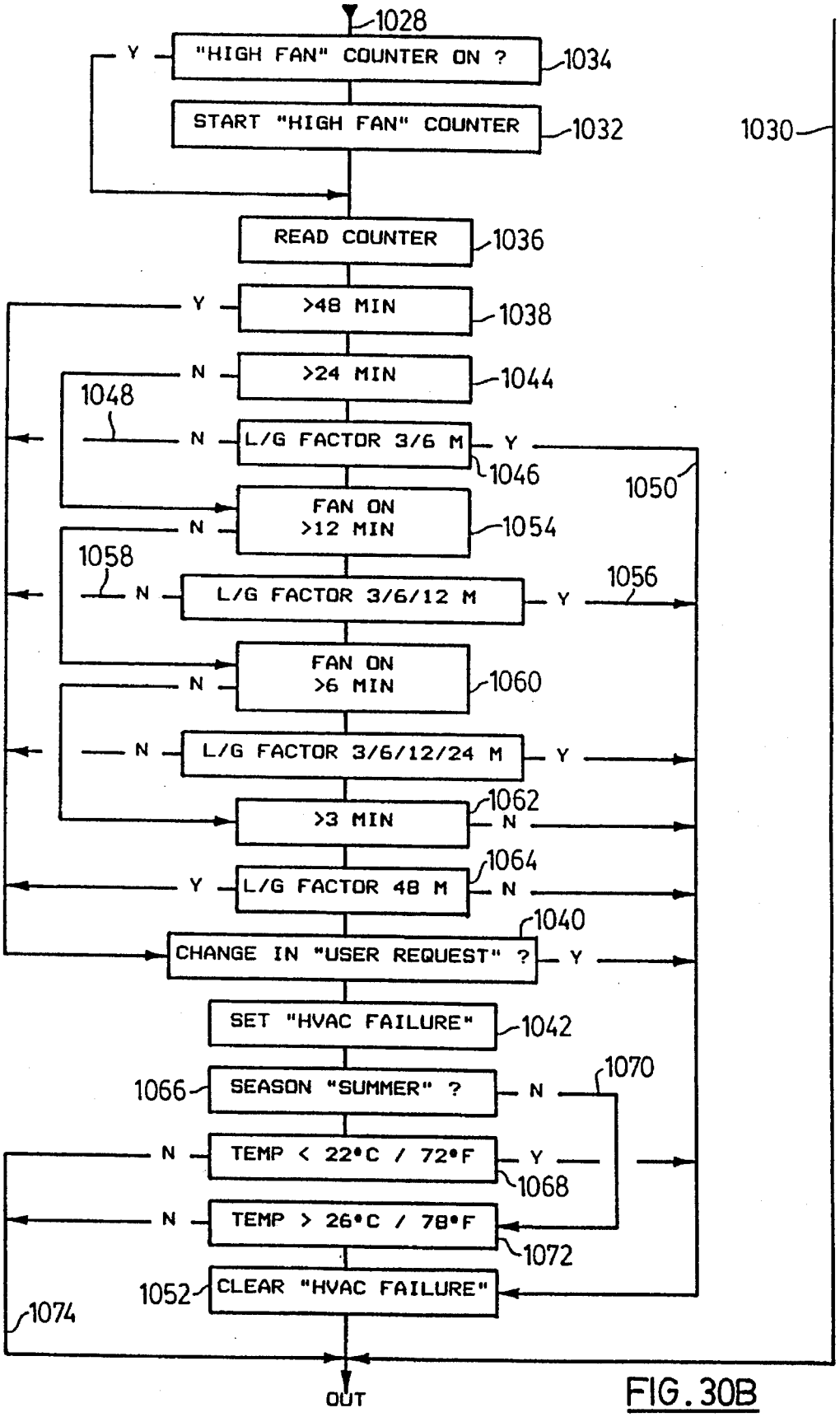

HVAC Failure (FIGS. 30A, 30B)

Reference is next made to FIGS. 30A, 30B, which deal with the sequence of steps taken to determine whether there is an HVAC failure. The sequence of operations described in connection with FIG. 30A, 30B also sets the "loss/gain factor" or "l/g factor" for each room. This factor is not only used for determining whether there has been an HVAC failure, but also it is used to group rooms having similar l/g factors and hence to determine whether there has been an environment failure, as will later be described.

With reference to FIG. 30A, assume that the door is closed (block 980) and that a "cross" is present, i.e. that the temperature previously requested (by a guest, or the set back temperature) is the same as the temperature actually prevailing in the room (block 982). In that case the current l/g factor is set the same as the previous l/g factor (block 984). In addition any previous setting of HVAC failure is cleared (block 986). If and when the overshoot timer shown at block 962 in FIG. 29 is clear (block 988), meaning that the temperature is no longer rising or falling due to residual heat or coolness in the heat exchange coil 44, then the counter "l/g factor" is started (block 990).

The time taken for the temperature to fall or rise by 2° from the cross is now determined by the counter "l/g factor". It will be recalled that wren the temperature falls or rises by 2°, then the high fan comes on (FIG. 19 block 607 or 613). The time between the cross and when the high fan comes on is therefore the time taken for the room to lose 2° (provided that there is no user interruption, artificial or real).

Therefore so long as the high fan is off (block 992), the l/g factor counter is read (block 994). In addition the high fan counter (which counts while the high fan is on, as will be explained) is cleared (block 996). As the l/g counter is read, when the time on it exceeds three minutes (block 998), the l/g factor is set as three minutes (block 1000). When the l/g counter counts onward and exceeds six minutes (block 1002), the l/g factor is set as six minutes (block 1004). When the l/g counter exceeds 12 minutes (block 1006), the l/g factor is set as 12 minutes. When the l/g counter exceeds 24 minutes (block 1010), the l/g factor is set as 24 minutes (block 1012). When the l/g counter exceeds 48 minutes (block 1014), the l/g factor is set at 48 minutes (a maximum).

Then, when the high fan comes on (block 992), the value set in blocks 1000, 1004, 1008, 1012 or 1016 is set as the current l/g factor (block 1018). This is a measure, digitized as either 3, 6, 12, 24 or 48 minutes, of how long it took the room to lose 2°. The l/g factor counter is now cleared (block 1020).

If at any time during this process there is a change of user request (block 1022), or if the door opens (block 1024), then the l/g factor which is being established will likely be wrong. Therefore if either of these events occurs, the previous l/g factor is set as the current l/g factor (block 1026).

Now that the l/g factor of the room has been established, the next step, now that the high fan is on (block 992) is to see how long the room takes to gain or lose heat to a point at which the high fan turns off. It will be recalled from FIG. 19 that the high fan turns off at 0.8° C. below or above the cross temperature. The procedure is as follows, with reference to FIG. 30B. Branches 1028, 1030 in FIG. 30A join correspondingly numbered branches in FIG. 30B.

When the high fan comes on, a high fan counter is started (block 1032) if it is not already on (block 1034). The high fan counter is continuously read (block 1036) and if the high fan is on for more than 48 minutes (block 1038), without any change in user request (block 1040) then "HVAC failure" is set (block 1042). This is because the high fan should not need to be on so long.

If the high fan is on for less than 48 minutes, meaning that it has turned off (block 992 in FIG. 30A), then further assessments of how long it has been on having regard to the l/g factor of the room are made. If the high fan is on too long, having regard to the l/g factor (i.e. the heat loss characteristics) of the room, then an HVAC failure will be declared (subject to an override to be described).

Specifically, if the high fan has been on for more than 24 minutes (block 1044) and the l/g factor of the room is more than 6 minutes (block 1046), then the routine takes branch 1048 and (if there is no user request change) sets an HVAC failure (block 1042). However if the l/g factor of the room is 3 or 6 minutes, which is high, then it is reasonable that the HVAC system has run between 24 and 48 minutes in view of these large losses, and therefore the routine takes branch 1050 and clears any previous indication of HVAC failure (block 1052).

If the high fan was not on more than 24 minutes, the next question is whether it was on more than 12 minutes (block 1054). If it was on more than 12 minutes, then if the l/g factor was 3, 6 or 12 minutes, the high fan on time of 12 minutes was reasonable and the routine takes branch 1056 to clear any previous HVAC failure. If the l/g factor was more than 12 minutes, then 12 minutes of high fan time was too long having regard to this, and the routine takes branch 1058 to declare an HVAC failure (if there is no user request change).

Similar determinations are made depending on whether the high fan was on for more or less than six minutes (block 1060), and whether it was on for more or less than three minutes (block 1062). It will be noted that if the l/g factor is 48 minutes, then high fan operation for more than three minutes (blocks 1062, 1064) is considered to be an HVAC failure.

When the high fan goes off, the high fan counter is cleared (block 996 in FIG. 30A) as previously described.

When an HVAC failure is set, a further optional check is made. Firstly, if the season is summer (block 1066), and if the temperature is less than 22° C. (72° F.) (block 1068), then the HVAC failure is cleared (block 1052) since if the system can achieve a temperature in the summer of 22° C., it is considered not to have failed, even though it may be under powered.

If the season is not summer, then it is considered to be winter (branch 1070). Then, if the temperature is more than 26° C. (78° F.) (block 1072), the HVAC failure is again cleared (block 1052) since if the system can achieve a temperature this high in winter, it is considered to be operative though possibly under powered. These overrides are optional. If the required temperature is not achieved (blocks 1068, 1072), the HVAC failure is not cleared and the routine cycles (branch 1074) to "out".

From the above description it will be seen that establishing the loss/gain or l/g factor of the room provides a bench mark against which the performance of the HVAC system can be measured. Thus a failure can be recorded if the HVAC system takes too long to restore the room temperature, having regard to the current l/g factor of the room. As will be seen, the l/g factor also enables the rooms to be grouped for determination of environment failure, and it is also utilized in predicting when equipment will fail, as will be described.

FIGS. 30A, 30B show two ways in which, an HVAC failure, once set, can be turned off. As shown in FIG. 30A, the HVAC failure indication is cleared every time a temperature cross occurs (block 986). As shown in FIG. 30B, the HVAC failure is also cleared every time there is a change (real or artificial) in a user request (blocks 1040, 1052). This helps to ensure that any HVAC failure signal will be relatively fresh, so it will not be ignored by maintenance personnel. The room may of course declare an HVAC failure several times a day (and this can be recorded on a print-out of signals sent by each room).

Figure 31:
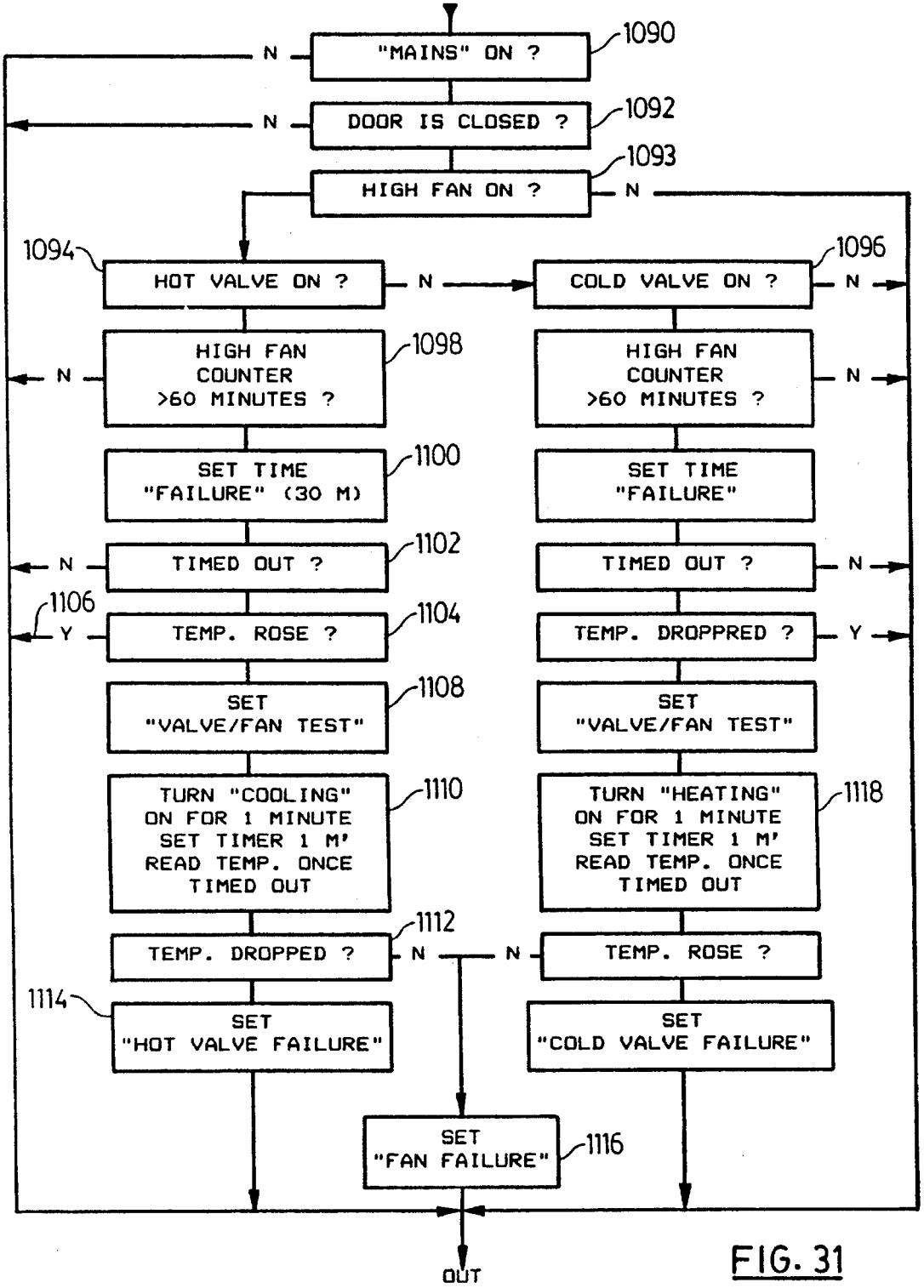
FIG. 31 is a logic flow chart for fan/valve failure.

Fan/Valve Failure (FIG. 31)

Reference is next made to FIG. 31, which shows how a fan or valve failure is detected. Assume that the electric power mains are on (block 1090), that the door is closed (block 1092), and that the high fan is on (block 1093). The next question is whether the hot or cold valves are on (blocks 1094, 1096). Assume that the hot valve 46 is on and that it has been on continuously for more than 60 minutes, so that the high fan counter has accumulated more than 60 minutes (block 1098). A 30 minute failure timer is then set (block 1100). When this timer times out (block 1102), a check is made to see whether the temperature has risen (block 1104). If the temperature has risen, then the fan and valve must be operative and the routine moves on branch 1106 to "out". If the temperature did not rise, then the valve/fan test is set (block 1108). Once this test is set, "cooling" is turned on for one minute (i.e. the cold valve 48 is set and the hot valve 46 is turned off), a one minute timer is set, and this temperature is read once the timer has timed out (block 1110). If the temperature has dropped (block 1112), this indicates that the fan is working and that the problem must have been with the hot valve 46, and a "hot valve failure" is set (block 1114). If the temperature did not drop, then since it is extremely unusual for two valves to fail at the same time, it is assumed that the fan is not working and "fan failure" is set (block 1116).

Exactly the same procedure is used if the cold valve is on, except that in the valve/fan test at block 1118, the hot valve 46 is turned on for one minute and the cold valve 48 is turned off. Since in many hotels and other buildings fans are repaired by electricians and valves are repaired by plumbers, the above routine can save considerable expense since the building staff will now have a better ability to call the correct trade for repairs.

Figure 32:
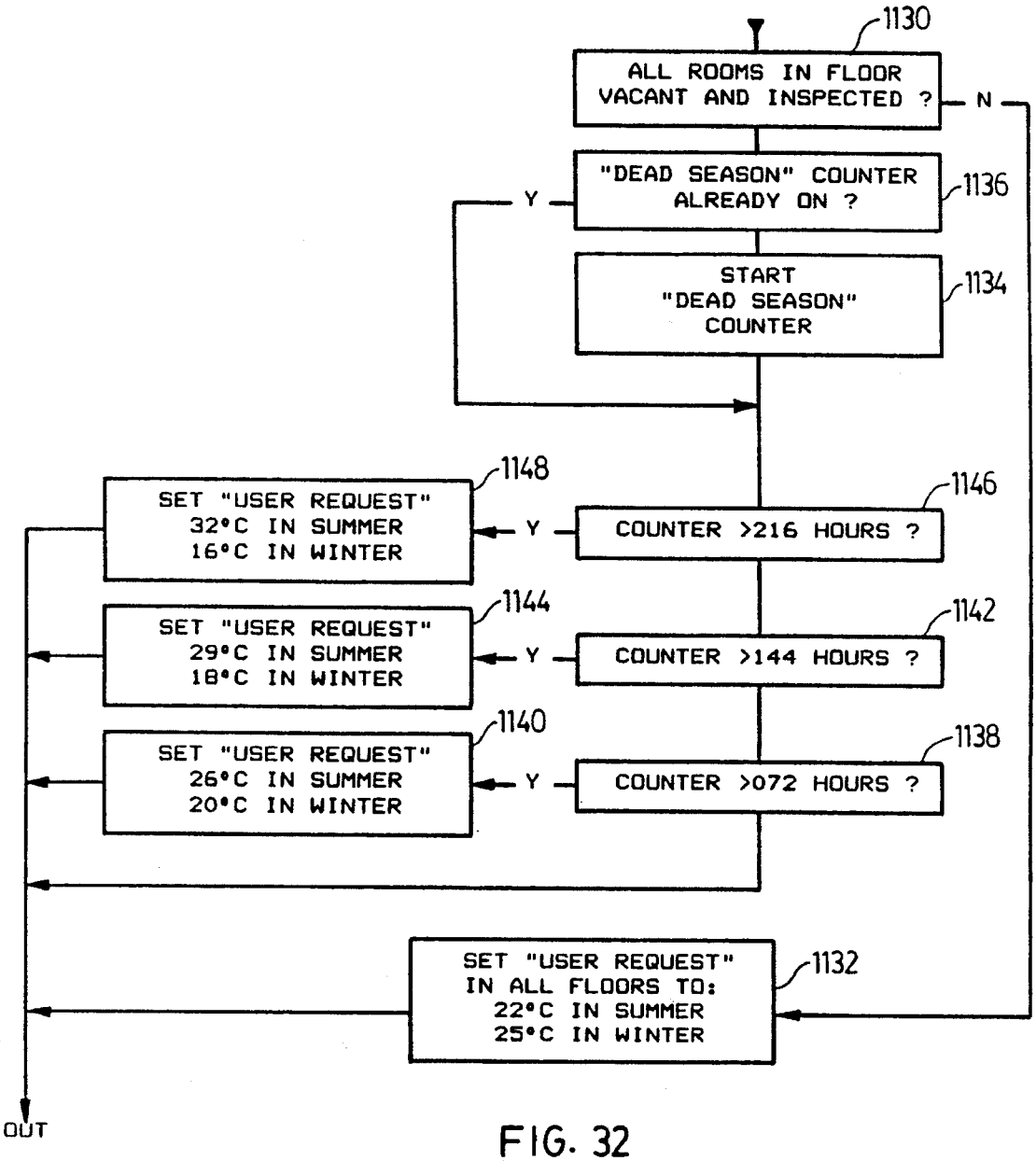
FIG. 32 is a logic flow chart for seasonal vacancy.

Seasonal Vacancy (FIG. 32)

Reference is next made to FIG. 32, which shows a routine which detects seasonal slow-down in hotels by floors, and reduces the energy consumption in an unoccupied floor. However as soon as a room is occupied on the floor, normal operation will be restored. This procedure is automatic without any human intervention.

As shown in FIG. 32, the first step is to determine whether all rooms on the floor are vacant and inspected (block 1130). If not, then the standard comfort temperature or artificial "user request" of 22° in summer and 25° in winter is set (block 1132), subject to the setback previously described and also subject to any user request.

If all rooms on the floor are vacant and inspected, then a "dead season" counter is started (block 1134) if it is not already on (block 1136). When this counter counts past 72 hours (block 1138), then an artificial "user" request is set to 26° in summer and 20° in winter (block 1140). This is slightly more energy saving than the standard user request in block 1132. Once the dead season counter counts past 144 hours (block 1142), then a further setback is made to 29° in summer and 18° in winter (block 1144). Once the dead season counter counts past 216 hours (block 1146), then a third and final setback is made to 32° in summer and 16° in winter (block 1148). However it will be seen that as soon as one room on the floor ceases to be vacant, then the artificial "user request" will be restored to 22° in summer and 25° in winter (block 1132).

During the setbacks indicated at blocks 1140, 1144, 1148, the fan and valves are nevertheless periodically operated as previously described, to prevent them from ceasing or plugging.

Figure 33:
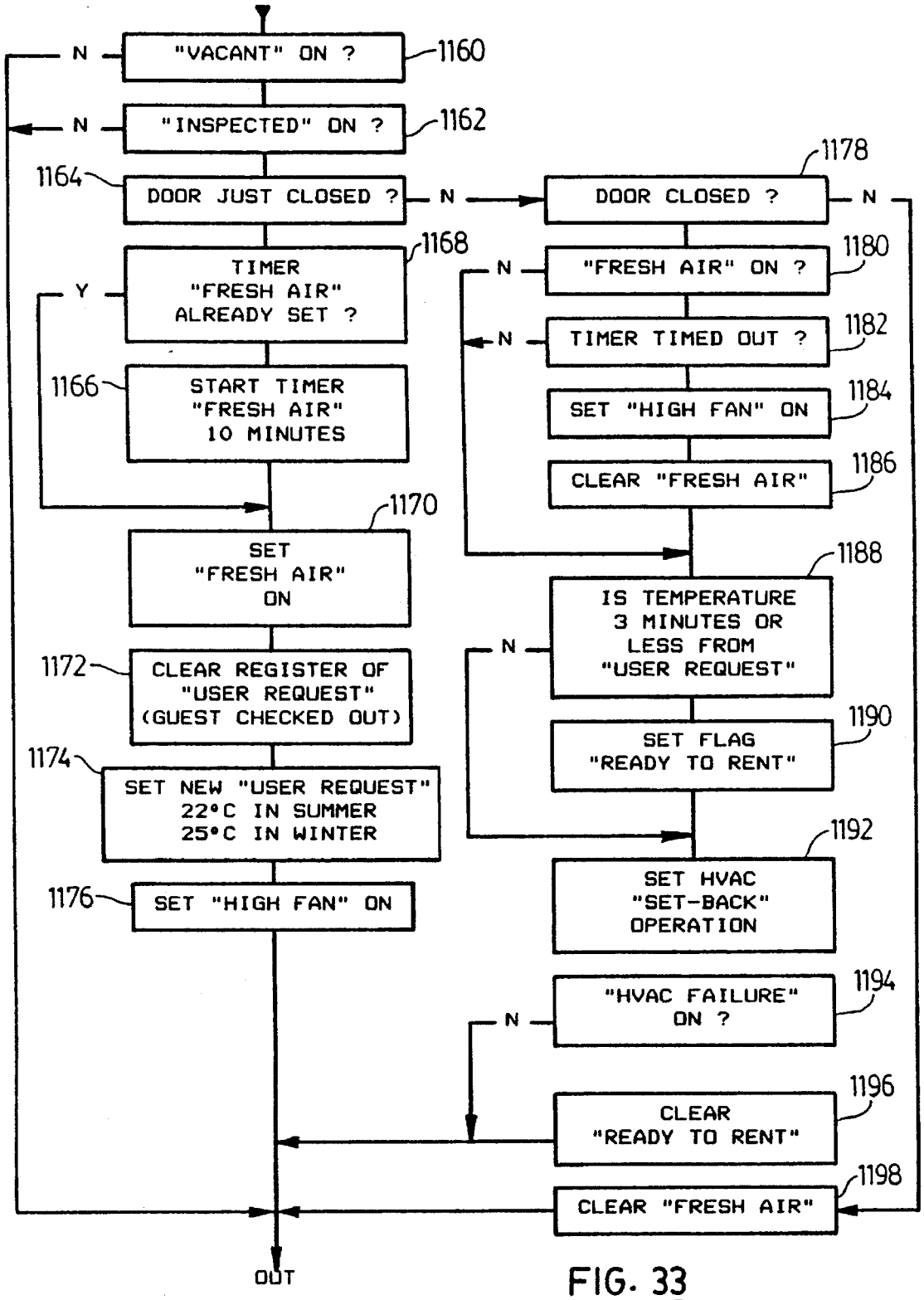
FIG. 33 is a logic flow chart for a room which is ready to rent.

Room Ready to Rent (FIG. 33)

Reference is next made to FIG. 33, which shows the sequence of operations which occurs when a room is ready to rent. This indication is shown on a terminal at the front desk of the hotel so that the front desk clerk will know immediately which rooms are available to rent to incoming guests.

The first questions are whether the room is vacant and inspected (blocks 1160, 1162). If so, the next question is whether the door has just closed (block 1164) meaning usually that the inspectress has just left. If the door has just closed, then a timer "fresh air" is set (block 1166), if it is not already on (block 1168). The timer "fresh air" is a 10 minute timer to allow smoke, odor and the like to be cleared from the room.

When the fresh air timer is started, fresh air is set on (block 1170). The fresh air mode means simply that if there is a solenoid damper 76 in the fresh air duct 74 bringing air into the room, the solenoid damper 76 is set to a position to allow the maximum amount of fresh air into the room. Alternatively, if there is a room air conditioner, the "fresh air" on condition sets it to a fresh air mode. If these items do not exist, then the "fresh air" mode has no effect of itself.

The next step is to clear the register, i.e. the memory, in the room control unit of any temperature request made by the previous user who has now checked out (block 1172). Then the usual standard "user request" temperature of e.g. 22° C. in summer and 25° C. in winter is set (block 1174). The high fan is then set on (block 1176) and the routine cycles to out.

The high fan operation, together with the fresh air mode if available, continues for 10 minutes, to help clear the room air. This mode of operation overrides the normal fan/valve operation and setback operation while the timer 1168 is on.

As the routine cycles repeatedly through the sequence of steps shown in FIG. 33, it will be found at all times past a few seconds after the door has been closed, that the answer for the "door just closed" block 1164 is "no" (because it is now closed longer than "just closed"). Assuming that the door is still closed (block 1178) and that the fresh air mode is on (block 1180), the next question is whether the fresh air timer has timed out (block 1182). If the answer is "yes", then the high fan is set off (block 1184) and the fresh air mode is cleared (block 1186). If the fresh air mode does not exist, blocks 1170, 1180, 1186 would be removed.

The next question is whether the temperature is within three minutes or less from the standard "user request" temperature which has been set (block 1188). If the temperature in the room is within three minutes from that standard temperature, then the flag "ready to rent" is set (block 1190). Next, the standard HVAC setback operation is set (block 1192) and is in any event set if the temperature is not within three minutes from the standard request. The setback operation is the same as that described in connection with "Setting Back A Room" (FIG. 28). Of course the temperature from which the setback now occurs is a standard temperature set by the system instead of the actual temperature set by the guest.

The next step is to determine whether there is an HVAC failure on (block 1194) If the answer is "yes" then "ready to rent" is cleared (block 1196). If the answer is "no", then the ready to rent flag (block 1190) is left in place if it has been set. If it has not yet been set, then the routine cycles through the sequence of operations until the temperature is within three minutes from the standard user request (block 1188) and the ready to rent flag is then set.

If at any time during the sequence of steps described above the door is opened (block 1178), then the fresh air mode is cleared (block 1198) since there is no point in operating the high fan with the door open.

Figure 34:
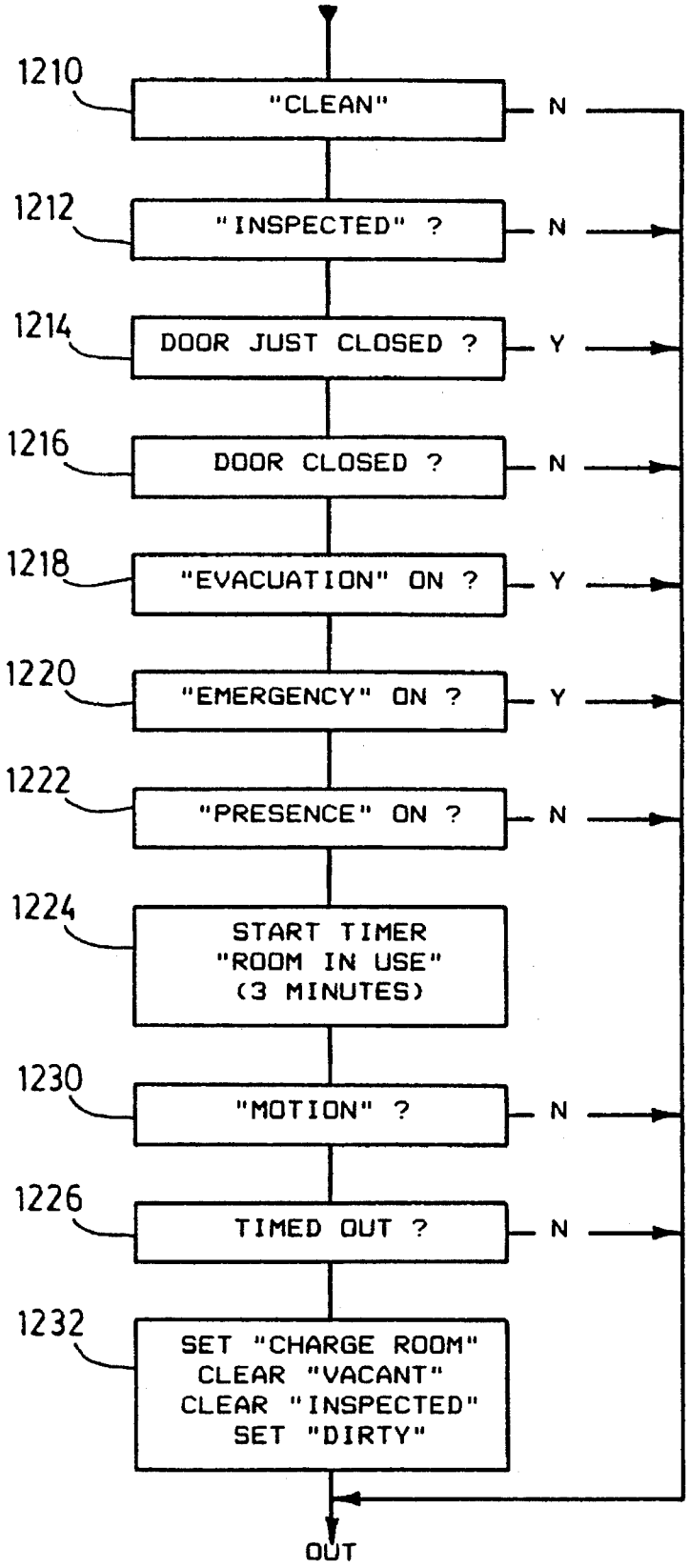
FIG. 34 is a logic flow chart showing when a room should be charged for use.

Charge for Use (FIG. 34)

Reference is next made to FIG. 34, which shows the sequence of steps taken to determine that a room is in use and that it should therefore be charged.

The first step is to determine whether the room is clean (block 1210) and inspected (block 1212). If the room is neither cleaned nor inspected, then the routine cycles to "out". In addition if the door has just closed (block 1214) or if the door is not closed (block 1216), the routine cycles to "out".

Further, if there is either an evacuation or an emergency condition on (blocks 1218, 1220), the routine cycles to "out". (These conditions will be explained in connection with "Fire Alarm".)

If the appropriate answers are given in the previous steps, then the next question is whether "presence" is on (block 1222). If presence is on, indicating that a person is in the room with the door closed, then a three minute timer "room in use" is started (block 1224). This is to allow for the possibility that a person has entered the room only briefly (e.g. to see if he or she likes it) but has not dirtied it.

If at the end of the 3 minute "room in use" timed period, there is motion in the room (block 1230), then the routine can check to see if the timer has timed out (block 1226). If the timer "room in use" has timed out, then the condition "charge room" (block 1232) is set. It will be seen that there must be motion at the end of the three minute timed period before the routine can get to block 1226 and hence "charge room". In addition the room's vacant status and its inspected status are now cleared and it is set as "dirty" (block 1232).

As shown, it is preferred that not only presence but also motion be on for more than three minutes before the room is charged. (The actual time can be adjusted depending on the requirements of any particular hotel.) The requirement for motion as well as presence indicates that the room is actually being used before it is charged.

Figures 35A, 35B:
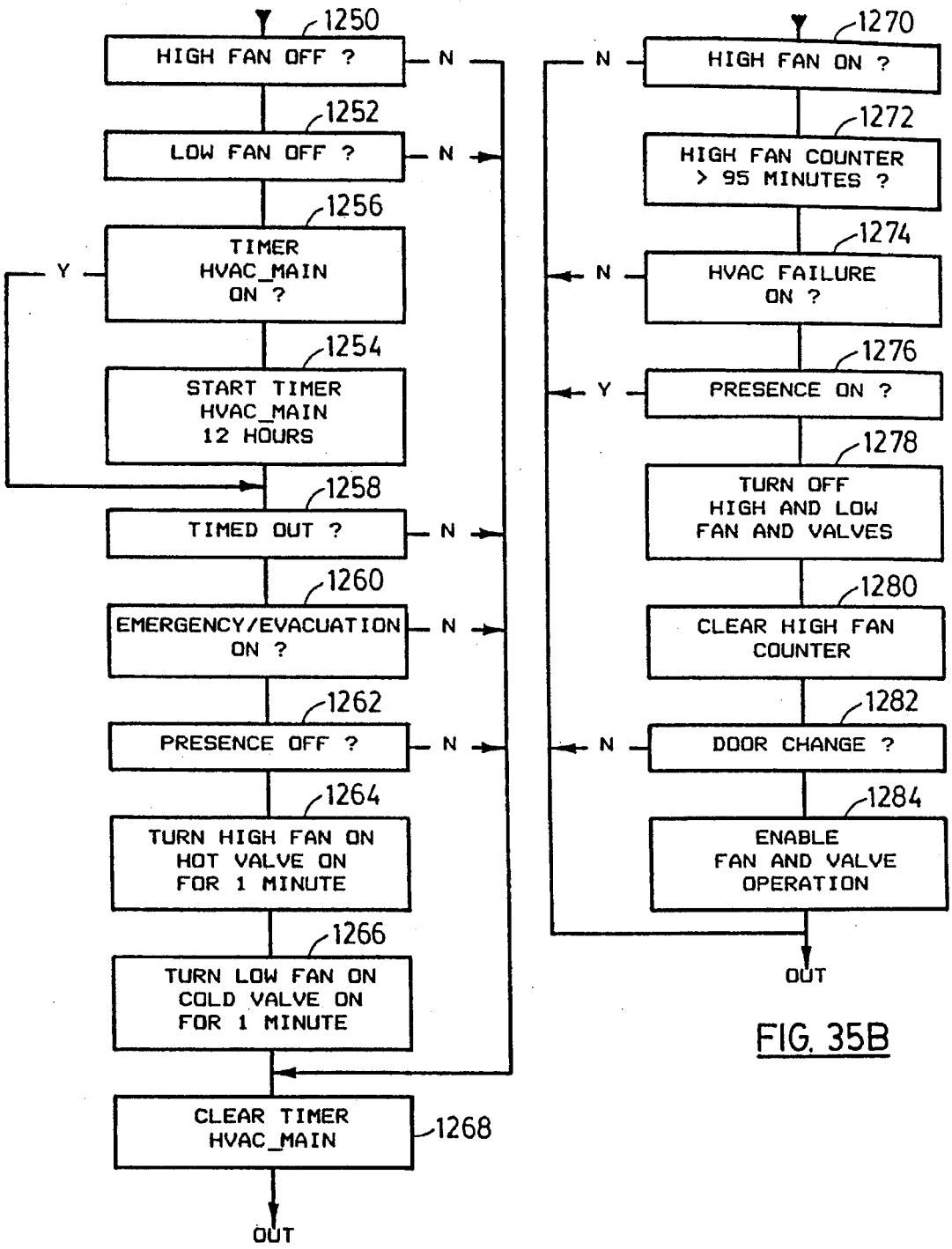
FIGS. 35A and 35B are logic flow charts showing a routine for preservation of the HVAC.

Preservation of HVAC (FIGS. 35A, 35B)

Major damage is often caused to the HVAC, and particularly to the valves, if the HVAC system is not operated for long periods of time. It is found that the valves corrode and plug, and when eventually they are called upon to operate, a failure occurs.

FIG. 35A therefore shows a routine for ensuring that the HVAC is operated for a short time every 12 hours. As shown, the first question is whether the high and low fan are both off (blocks 1250, 1252). If they are both off, then a timer "HVAC main" is started (block 1254) if it is not already on (block 1256).

When the timer times out (block 1258) a check is made to determine whether an emergency or evacuation hondition is on (block 1260) and whether presence is off (block 1262). This is because it is preferred not to cycle the HVAC during an emergency or evacuation situation. In addition if presence is on, i.e. a person is in the room, it is preferred not to disturb or alarm them by automatically operating the HVAC.

If there is no emergency, evacuation or presence, then the high fan is turned on and the hot valve is turned on and off repeatedly (i.e. oscillated) for one minute (block 1264). After this has occurred, the low fan is turned on, and the cold valve is turned on and off repeatedly (i.e. oscillated) for a further one minute (block 1266). After this, the timer "HVAC main" is cleared (block 1268) and the cycle repeats.

The reason why the hot and cold valves are oscillated, rather than simply turned on and off once, is because one turn on each 12 hours may not be sufficient to clear particles and rust adhering to the valves.

FIG. 35B is a short routine to prevent a situation where, if a fan or valve has failed, the HVAC will attempt to run forever to achieve a user requested (whether real or artificial) temperature. As shown, if the high fan is on (block 1270), and if the high fan counter (previously described) exceeds 95 minutes (block 1272), then the next question is whether there is an HVAC failure on (block 1274) as previously described (block 1042 of FIG. 30B). However even if the above conditions exist, if presence is on (block 1276), then the routine cycles to "out" since it would be disturbing to the person to turn off the HVAC.

If there is no presence, at block 1276, then the high and low fan and valves are all turned off (block 1278) and the high fan counter is cleared (1280).

The routine then watches for a door change (block 1282). So long as the door does not open or close, the high and low fan and valves are kept off. If there is a change in the door status, then fan and valve operation is enabled (block 1284) since this means that a person may have gone into the room who can see if there is a problem with the HVAC.

Figure 36:
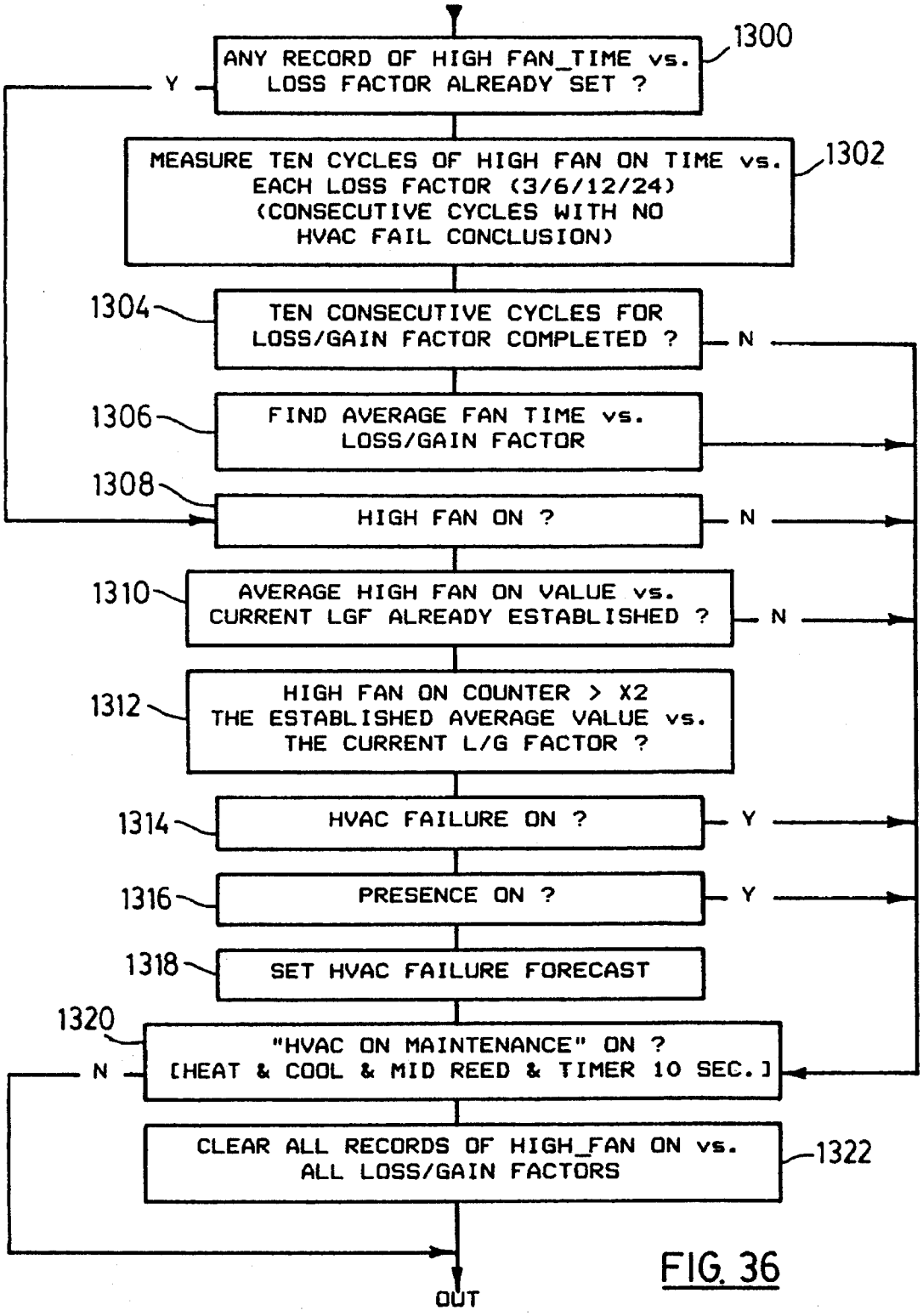
FIG. 36 is a logic block diagram showing failure forecasting.

HVAC Failure Forecast (FIG. 36)

It will be recalled that FIGS. 30A and 30B described determining when an HVAC failure has occurred. Generally, an HVAC ,failure is declared when the high fan is on too long in relation to the lg factor of the room.

FIG. 36 illustrates a method of forecasting HVAC failures, i.e. of determining that the HVAC is "on its way" to a failure. Essentially, this is accomplished by determining how long the high fan is normally on, as an average, in relation to the current lg factor of the room, and then forecasting an HVAC failure if the average time which the high fan is on in relation to the current lg factor of the room becomes double the previously established average high fan on time. This procedure is carried out when the HVAC is in its set back mode (described in connection with FIGS. 27, 28), in order not to interfere with a person who may be in the room.

As shown in FIG. 36, the first question is whether any record has been set in memory of the high fan "on" time versus (i.e. in relation to) the lg factor of the room in set back mode (block 1300). For convenience these forecast records are normally placed in the memory of the central computer.

If no such record has been set, then ten cycles of the high fan "on" time are measured for each lg factor of the room.

From FIG. 30A, the possible lg factors are 3 minutes (if the room lost 2° C. in 3 to 6 minutes), 6 minutes (if the room lost 2° C. in 6 to 12 minutes), 12 minutes (if the room lost 2° C. in 12 to 24 minutes), and 24 minutes (if the room lost 2° C. in 24 to 48 minutes). The lg factor of the room will vary depending on the difference between the indoor and outdoor temperatures. Therefore normally the system will over sufficient time have an opportunity to measure ten cycles of high fan "on" for each lg factor, although several months may be required for all the measurements. The cycles must of course be consecutive cycles with no HVAC fail indication interrupting the process since the "on" time no longer represents standard operation.

If during the measuring time the room does not have a given lg factor, then there will simply be no failure forecast with respect to that lg factor.

After 10 cycles of high fan on time for any given lg factor have been measured (block 1302) and completed (block 1304), then the 10 cycles for such lg factor are averaged (block 1306). In other words, the average high fan "on" time is found for each lg factor (block 1306).

Then, each time the high fan is on in set back mode (block 1308), a check is made to see whether an average high fan "on" time has been established (as just described) for whatever the current lg factor of the room may be (block 1310). If the answer is yes, then determination is made of whether the high fan "on" time exceeds this average "on" time for the current lg factor of the room by a multiple of at least 2 (block 1312). For example, assume that the current lg factor of a room is 6 minutes (an lg factor of between 6 and 12 is fairly typical for hotel rooms). Assume that the average high fan "on" time for the lg factor 6, as determined at block 1306, is 5 minutes for the room in question but has now increased to 10.5 minutes. In that case, since the high fan "on" time for the lg factor 6 has now exceeded the average value by a multiple of more than 2, an HVAC failure forecast is set (block 1318) if it is not already on (block 1314) and provided that there is no presence in the room (block 1316). As discussed, the failure forecast is displayed only in the set back mode and therefore is not displayed when a person is present in the room. The forecast is displayed in an appropriate manner on a screen map of the rooms, as will be explained in connection with the screen descriptions.

Note that if the average high fan "on" time in relation to the current lg factor of the room has not been established (block 1310), then a failure forecast will not be given at times when the room has that lg factor.

The kind of failure predicted by the failure forecast procedure is typically that the filter 66 is becoming plugged. When this occurs, the HVAC draws progressively less air from the room and more from the hall until an HVAC failure occurs. The failure forecast will also occur if a valve is gradually becoming plugged.

Once an HVAC failure forecast has been set, it can be cleared in various ways. Typically, if a repair man is working on the HVAC, he will place it on maintenance. (He can do so by pressing both temperature up and down and by placing a magnetic key to the central check reed switch all for 10 seconds.) If the HVAC is placed on maintenance, then this will change the performance of the system, and therefore all records of the high fan "on" time in relation to the loss/gain factor of the room are cleared (block 1322) and fresh averages are established as previously described.

It will be noted that the procedure does not determine exactly when the HVAC will in fact fail. It only indicates that the performance of the HVAC has in effect fallen by 50% from its previous average performance and therefore that it is "on its way" to failing.

Figure 37:
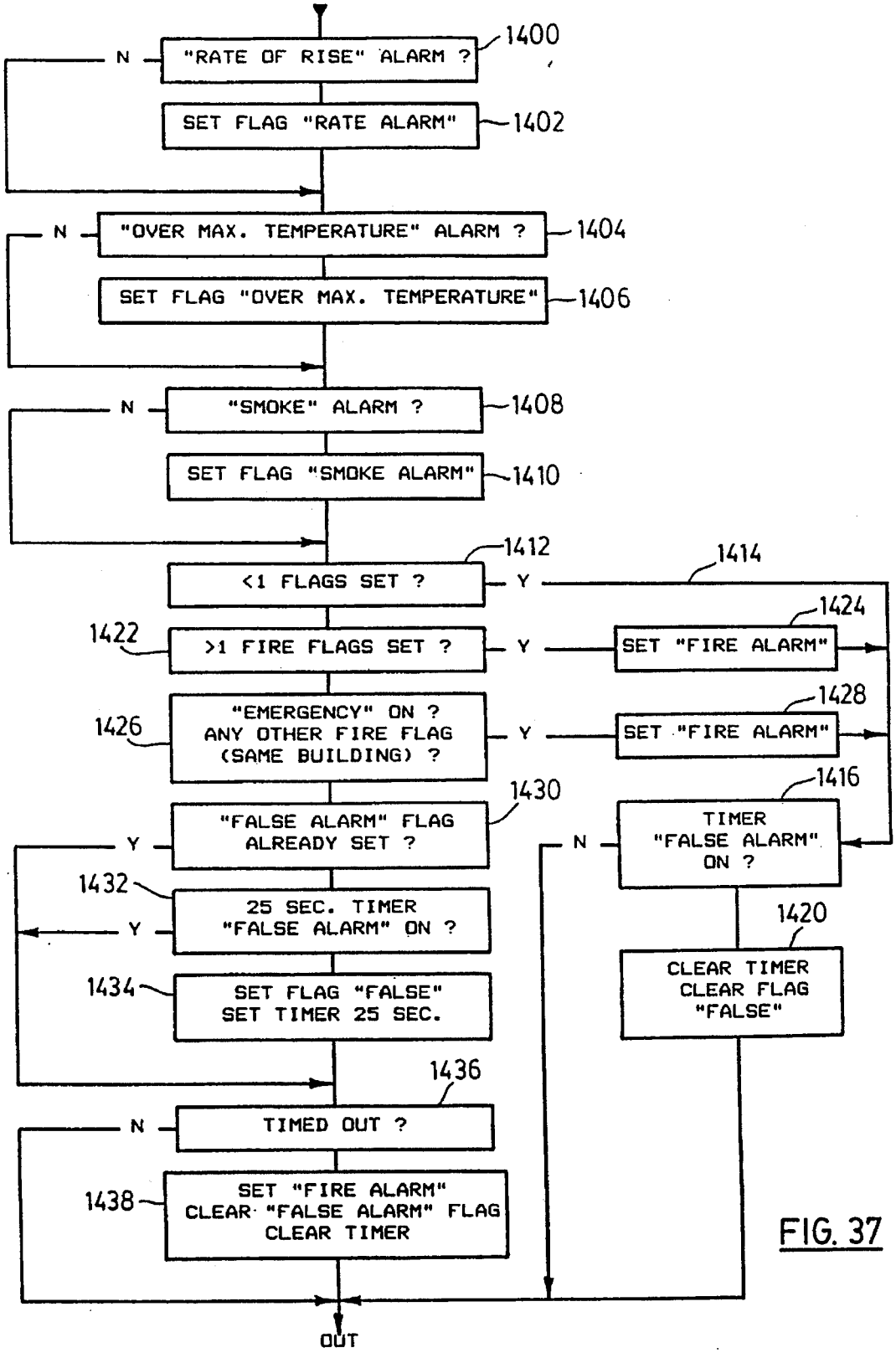
FIG. 37 is a logic flow chart for a fire alarm.

Fire Alarm (FIG. 37)

Reference is next made to FIG. 37, which shows the operation which produces a fire alarm. As shown, the first step is to determine whether there is a rate of rise alarm (block. 1400) produced by the thermistor 154. If so, a flag "rate alarm" is set (block 1402). A rate of rise alarm occurs when the temperature measured by the thermistor rises more than 5° C. in 90 seconds. The scanning is always of the last 90 seconds. However if the temperature rises more than 15° C. in the last seconds, then a tamper message is produced instead of a rate of rise alarm.

The next step is to determine whether there is an "over maximum temperature" alarm (block 1404). This occurs when the room temperature as measured by the thermistor exceeds 42° C. If such an alarm exists, a flag for it is set (block 1406). (This value is adjustable and in fact is raised to 45° C. if the door is open and there has been more than 14 minutes total motion for two 15 minute cycles, as described for FIG. 25. This occurs only if the room is very crowded and may reduce false alarms.)

The next question is whether there is a smoke alarm, as indicated by the smoke detector 156 (block 1408). If there is, a flag "smoke alarm" is set (block 1410).

Next, a determination is made as to whether less than one (i.e. no) flags have been set (block 1412). If the answer is yes, i.e. no flags have been set, then the routine goes on branch 1414 to check whether the false alarm timer is on (block 1416). This is a 25 second timer to reduce the likelihood of false alarms. If the false alarm timer is not on, the routine cycles to "out". If the false alarm timer is on, it is cleared and the flag indicating that it is on is also cleared (block 1420).

If at block 1412 at least one flag has been set, then the next question is whether more than one fire flag (i.e. rate of rise, over maximum temperature or smoke) has been set (block 1422). If the answer is yes, then the fire alarm is set immediately (block 1424), whether or not the false alarm timer is on.

If the answer at block 1422 is no, meaning that only one flag has been set, then the next question is whether there is an emergency condition on (i.e. more than one fire alarm in other parts of the building) or any other fire flag in the same building (block 1426). If the answer is yes, then again the fire alarm is set immediately (block 1428) whether or not the false alarm timer is on.

If the answer at block 1426 is no, then the next question is whether the false alarm flag is already set (block 1430). If not, then the next question is whether the false alarm timer is on (block 1432). If not, then this timer is set and the false alarm flag is also set (block 1434). If the timer is on, then the question is whether it has timed out (block 1436). If it has not timed out, then the routine cycles to out. If it has timed out, then the fire alarm is set, and the false alarm timer and false alarm flag are cleared (block 1438).

This arrangement reduces the likelihood of false alarms if a guest playfully aims a hairdryer at the room control unit for 10 or 15 seconds. However if there is more than one fire flag set, or if there is a fire or emergency situation in any part of the same building, then the fire alarm is immediately set without waiting.

Figure 38:
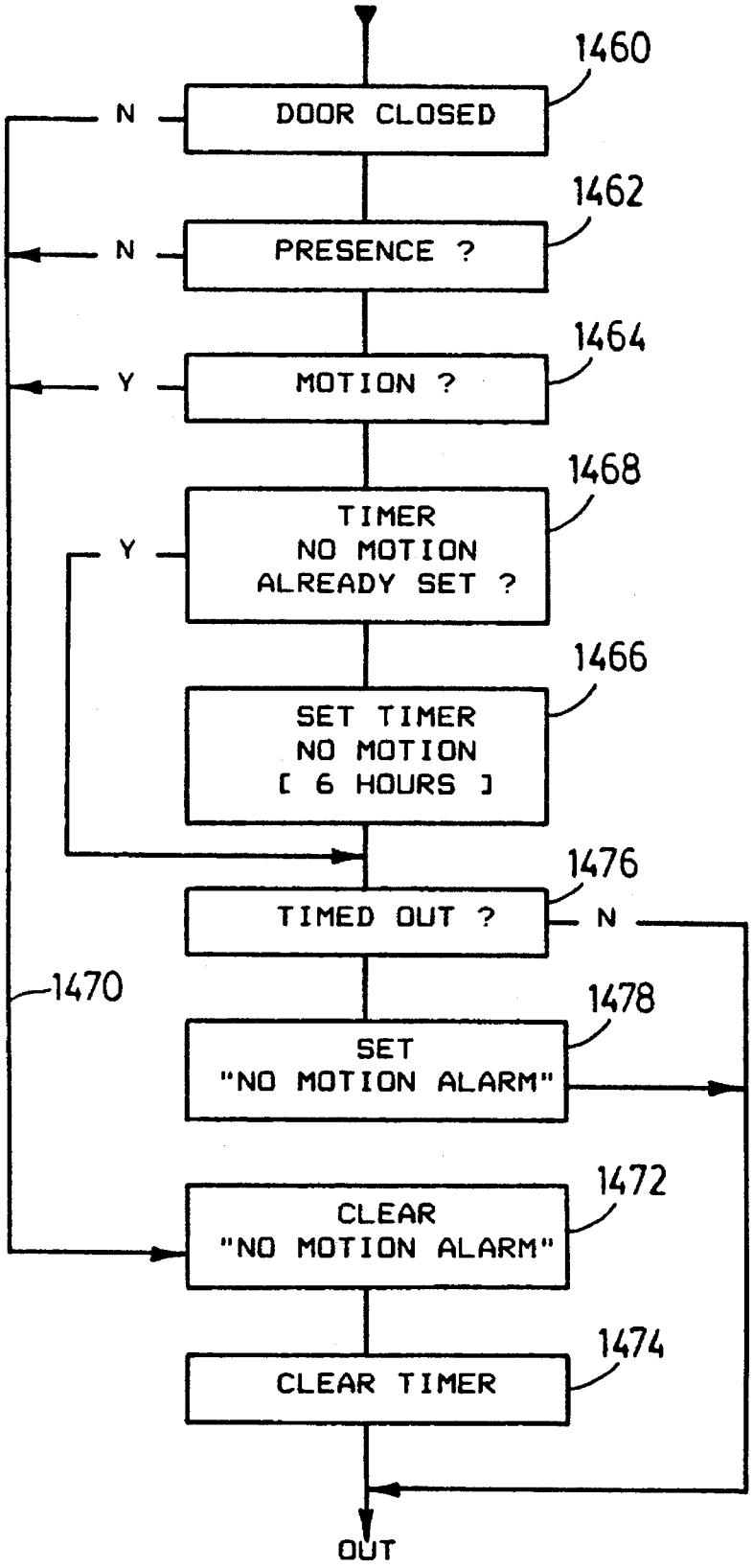
FIG. 38 is a logic flow chart for a no motion alarm.

No Motion Alarm (FIG. 38)

Reference is next made to FIG. 38, which shows a routine for creating an alarm if a guest is present in a room for a sufficient period of time but does not move. As shown, the initial questions are whether the door is closed (block 1460), whether there is presence (block 1462), and whether there is motion (block 1464). If the door is closed and there is presence but no motion, then a "no motion" timer is set (block 1466) unless it was already set (block 1468). This is a six hour timer but is cleared (branch 1470) and block 1472) whenever the door opens or there is presence or mot ion occurs. The term "no motion" is then also cleared (block 1474). If the timer times out (block 1476), then a no motion alarm is set (block 1478) and can be used to indicate to the front desk that there is a problem in the room.

It should be noted that the motion sensor 140 is extremely sensitive and will detect small movements, even those which constantly occur when a person is sleeping. Therefore if a person in normal health is in the room, the normal movements of such a person will usually always be detected and will usually repeatedly clear the no motion timer (block 1474) before it accumulates six hours. Of course if the door is opened and closed, and no presence follows, this means that the occupant has left the room, and since there is no presence (block 1462), the no motion timer will not be started.

Figure 39A:
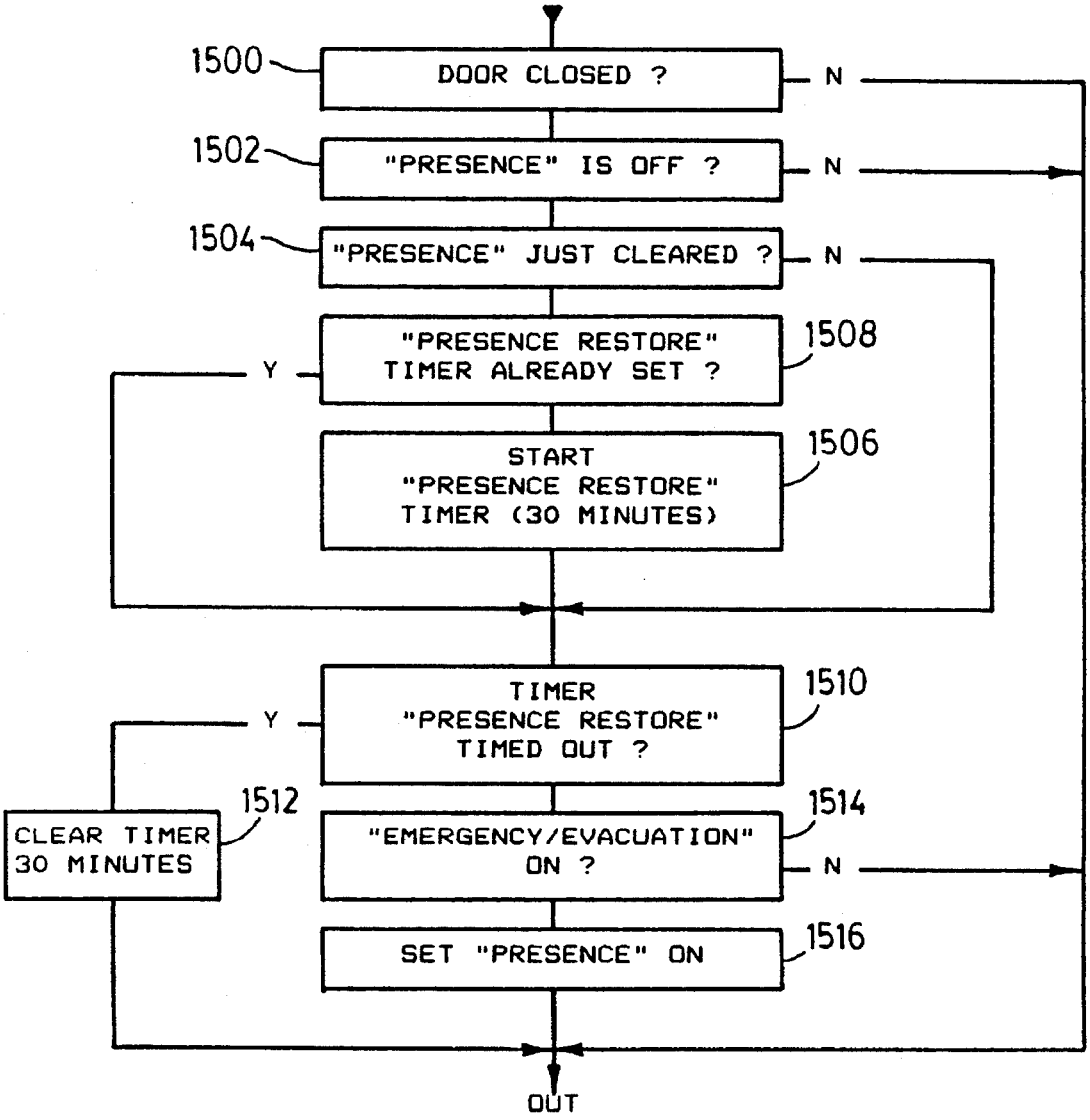
FIG. 39A is a logic flow chart showing restoration of a presence indication.

Restore Presence (FIG. 39A)

Reference is next made to FIG. 39A, which shows a sequence of steps which generates an additional safety margin beyond that of the intensive presence search and related timers. Under this routine, if an emergency or evacuation situation occurs within 30 minutes of clearing a presence, then the presence is restored.

The first steps are to determine whether the door is closed and presence is off (blocks 1500, 1502). If the answers to both questions are yes, and if presence has just been cleared (block 1504), then a 30 minute "presence restore" timer (block 1506) is set if it has not already been set (block 1508). When this timer times out (block 1510), it is cleared (block 1512). However if before it times out an emergency or evacuation condition occurs (block 1514), then presence is set on again (block 1516). While this may create a few false "trapped" warnings during an emergency, it helps to ensure that the presence of a guest trapped in a room will not be overlooked. Since a fire usually takes 15 to 45 minutes to start spreading seriously, this will indicate the presence status in the hotel when the event started.

Figure 39B:
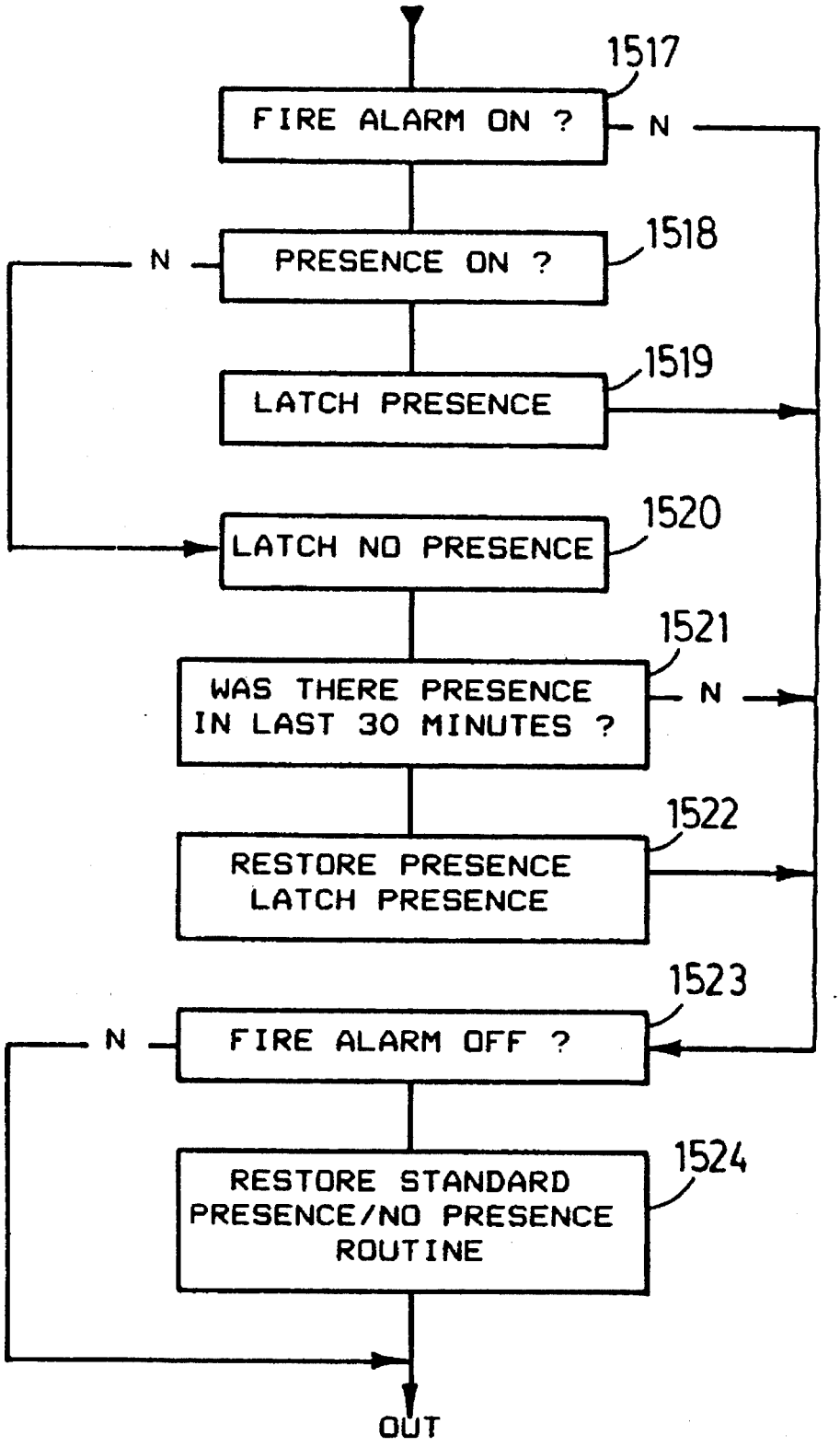
FIG. 39B is a logic flow chart showing latching of a no presence indication.

Latch No Presence (FIG. 39B)

When there is an actual fire in the room, i.e. flames in the room, the moving radiation or motion of the flames may saturate the infrared motion sensor, resulting in a false "presence" indication. If there are fires in several rooms and the firemen enter to fight the fires, it is undesirable that new presence indications be given. FIG. 39B shows a simple routine for dealing with this situation.

The routine starts with the question whether a fire alarm is on in the room (block 1517). The fire alarm must be an absolute temperature alarm (i.e. the temperature in the room is over the maximum allowed temperature) with or without another alarm.

Then, if presence is on at this time (block 1518), the presence indication is latched (block 1519). The latch is simply a software latch and can be disabled by a bit provided by the central computer transmitting to the room units in each cycle, the bit being that if there is no evacuation, emergency or fire, then the latch is disabled.

If presence is not on (block 1518), then the no presence indication is latched (block 1520). This will prevent a false indication of presence from being given if there are flames in the room or if a fireman then enters. However if there was presence in the room within the last 30 minutes (block 1521), then presence is restored (as explained in connection with FIG. 39A) and latched (block 1522).

The next question is whether the fire alarm has turned off (block 1523). If so, then the standard presence/no presence routine is restored (block 1524).

It should be noted that the thermistor in each room control unit is extremely sensitive and can provide a fire alarm even when the room next door is on fire. Therefore if a fire is spreading to the room in question, it is likely that an over maximum temperature fire alarm will be produced (block 1517) before there are flames in the room which can saturate the mot ion sensor. Therefore, if there was no one in the room, no presence can be latched before flames or the entrance of a fireman into the room give a false indication of presence.

Figure 40A:
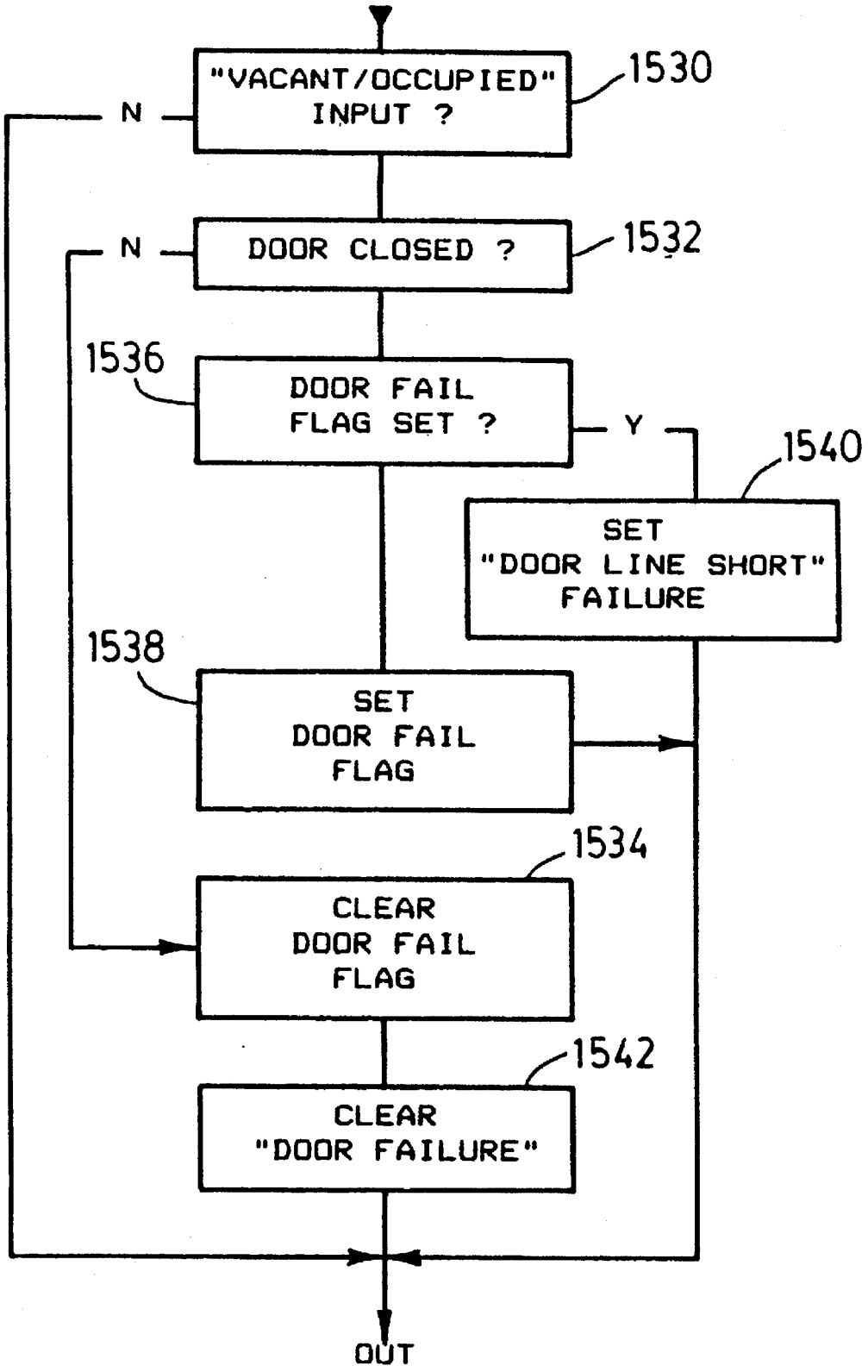
FIGS. 40A and 40B are logic flow charts showing detection of a door sensor failure.
Figure 40B:
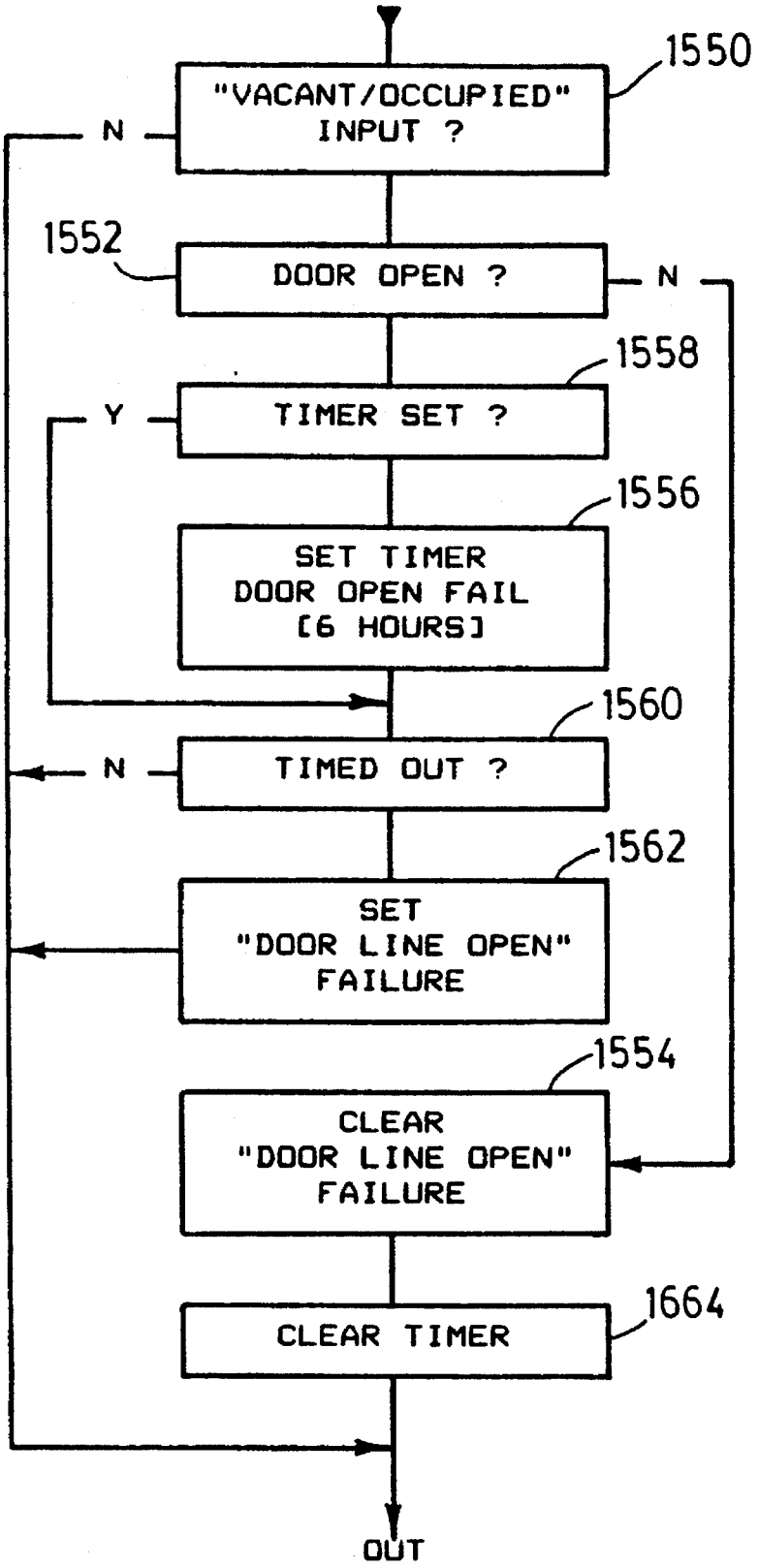

Door Failure (FIGS. 40A, 40B)

Reference is next made to FIGS. 40A and 40B, which shows how a door sensor failure is detected. FIG. 40A deals with a shorted door sensor 110. The first question is whether there is a vacant/occupied input (block 1530) by the maid or inspectress signalling that there is a presence or absence of luggage in the room. If the answer is "yes", the door should not be closed (block 1532) since cleaning staff always leave the door open while working. If the door is not closed (i.e. open), then any door failure flag is cleared (block 1534). However if the door is closed, then the next step is to see whether the door failure flag is set (block 1536). If this flag is not set, then it is set (block 1538) and the routine cycles to "out".

Then, the next time a maid or inspectress signals a vacant or occupied status, and if the door is still closed (block 1532) and if the door failure flag has been set (block 1536), then "door failure" (snorted line) is set (block 1540). This routine requires at least two repetitions of the vacant/occupied input with the door closed before the door failure is set. If after the flag is set, there is a vacant or occupied input with the door open (block 1532), then the door failure indication (shorted line) is cleared (block 1542).

The door sensor 110 can also fail in an open condition. This is dealt with by the test shown in FIG. 40B. The test begins when there is a vacant/occupied input from the maid or inspectress (block 1550). If such an input has occurred, and if the door is thereafter closed (block 1552), then any open line door failure is cleared (block 1554). However if the door is open, then the open door failure timer is set (block 1556) if it is not already set (block 1558). The open door failure timer is six hours. If it times out (block 1560), then "door failure" (open line) is set (block 1562). If at any time during the six hours the door is sensed as closed, the timer is cleared (block 1664) and any open line door failure is also cleared (block 1554).

While not shown in FIG. 40A or B, the system also provides that a continuous indication of presence, with no door closed and no door open during any timed 24 hour interval, also signals a door failure.

Figure 41A:
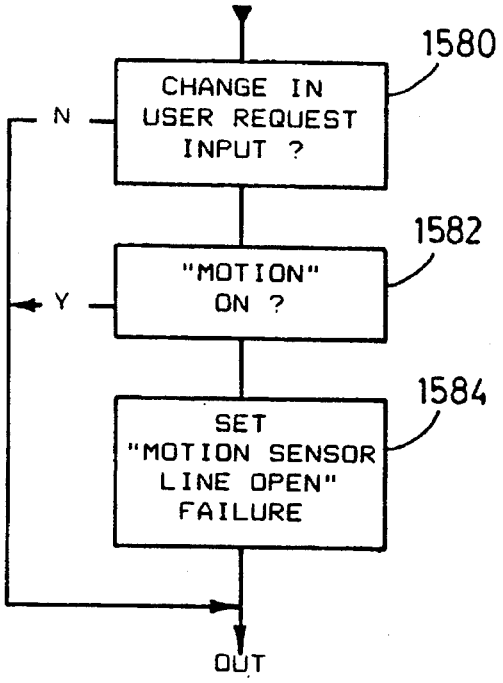
FIGS. 41A and 41B are logic flow charts showing detection of a motion sensor failure.
Figure 41B:
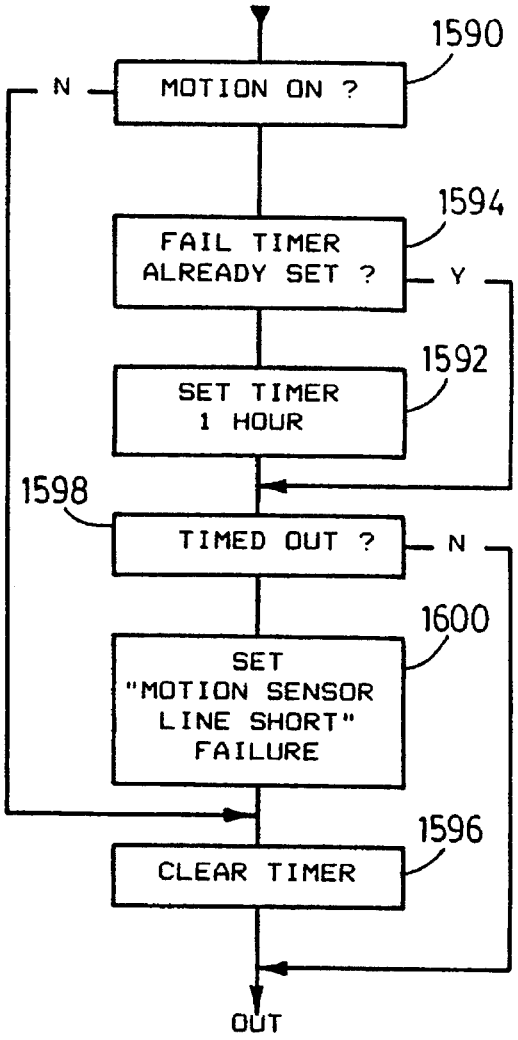

Motion Sensor Failure (FIGS. 41A, 41B)

FIGS. 41A, 41B show how a motion sensor failure is detected. The motion sensor 140 can fail in an open or shorted condition. FIG. 41A shows the detection of an open line failure. Here, if there is a change in user request input (block 1580), e.g. a temperature button is operated or a light is turned on creating a change at the light sensor 150, then if there is no motion (block 1582), a motion sensor failure (open line) is set (block 1584).

The test for a shorted motion sensor is shown in FIG. 41B. If motion is on (block 1590), then a failure timer is set (block 1592) if it is not already on (block 1594). The timer is one hour. If there is any cessation of motion during this hour, then the timer is cleared (block 1596). If the timer times out (block 1598) and there has been non-stop motion for the entire hour (which is normally highly unlikely), then a motion sensor failure (Shorted line) is set (block 1600).

Similar tests are provided to detect the failure of a knob (if the knob is "on" for more than one hour, it is declared as having failed), and to detect the failure of a light sensor (if there are more than three cycles of the room being clean and dirty without a light change being detected, then the light sensor is declared as having failed).

Figure 42:
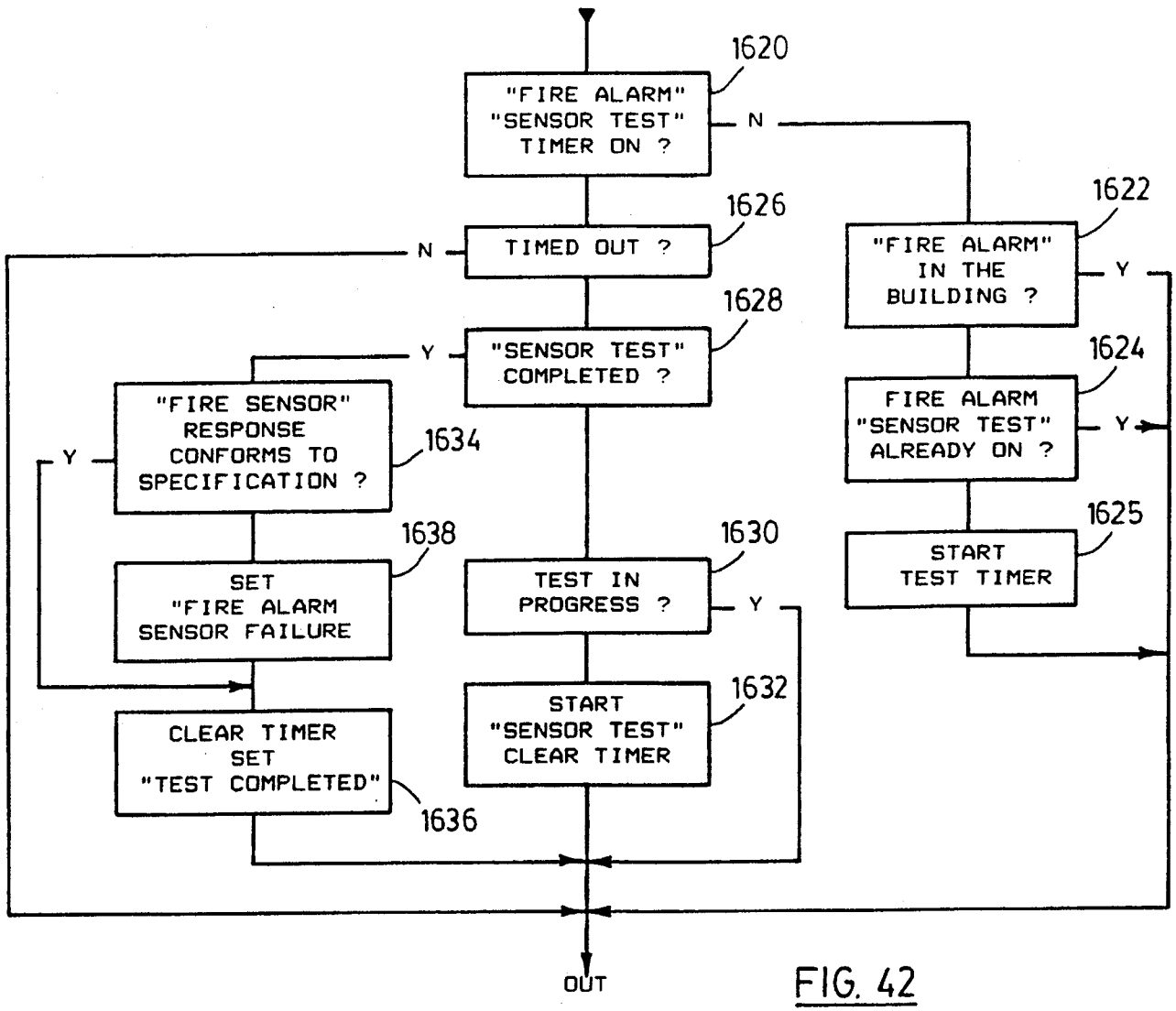
FIG. 42 is a logic flow chart showing a fire sensor test.

Fire Sensor Test (FIG. 42)

Reference is next made to FIG. 42, which shows how the fire alarm sensor, i.e. the thermistor 154, is periodically tested. As shown, the first question is whether the fire alarm sensor test timer is on (block 1620). If not, then the next question is whether there is a firm alarm in the building or a fire alarm sensor test already on (blocks 1622, 1624). If the answers to both questions are no, then the test timer is started (block 1625).

If the test timer has timed out (block 1626), and if the sensor test is not completed (block 1628), and if there is no test in progress (block 1630), then the sensor test is started (block 1632) and the timer is cleared to re-start.

Eventually, when the sensor test is completed (block 1628), a check is made to see whether the fire sensor conforms to specifications (block 1634). If the answer is yes, the timer is cleared and the test is indicated as completed (block 1636). If the fire sensor does not conform to specifications, then a "fire alarm sensor failure" is set (block 1638). The specifications are that four seconds of heating should produce a temperature reading increase of at least 1° C.

As previously described, the test consists of passing a current through a resistor adjacent to the thermistor 154 to heat it to a known extent, so that its response can be measured and checked. The test is repeated e.g. once per hour.

Figure 43A:
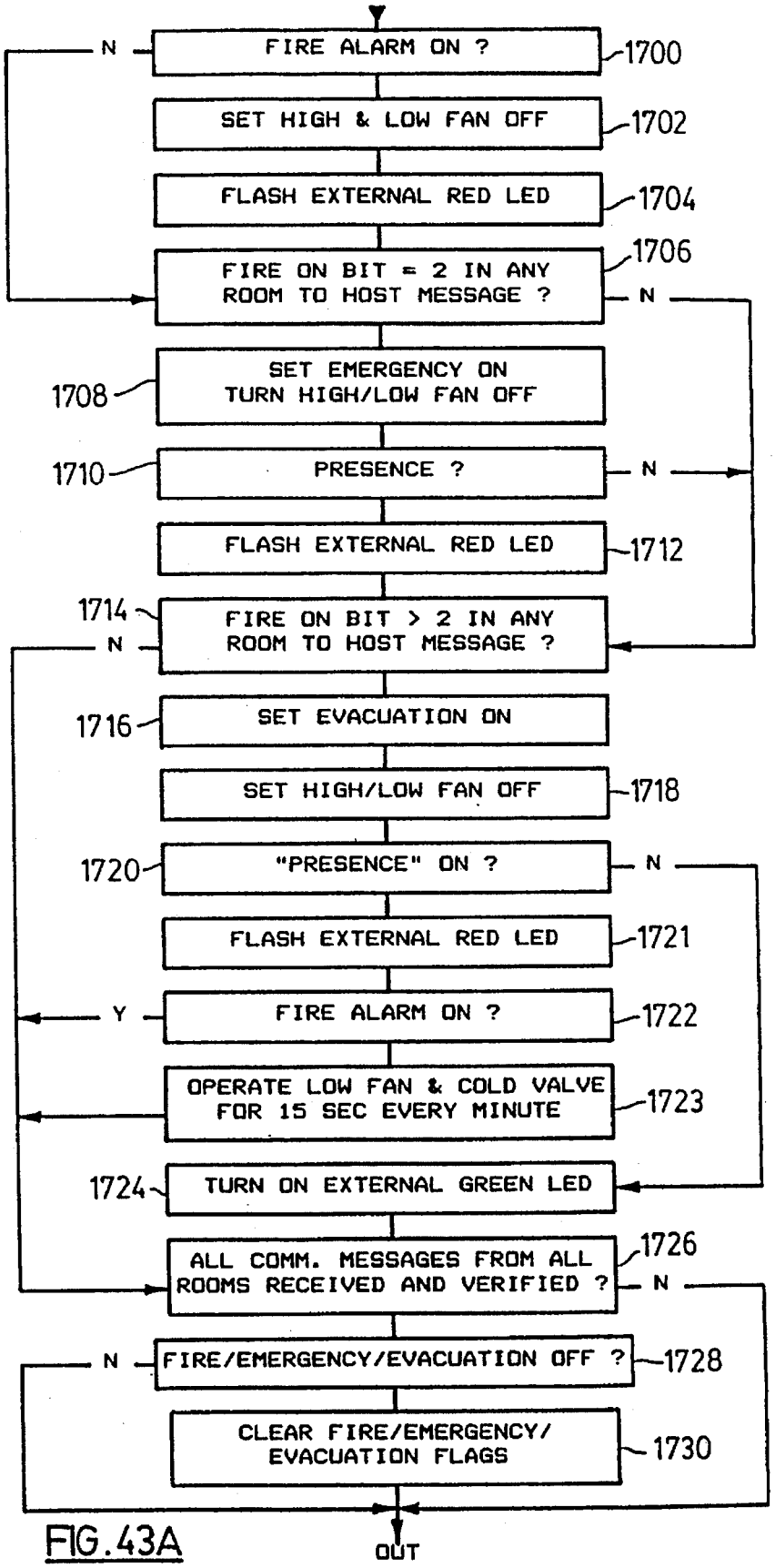
FIG. 43A and 43B are logic flow charts showing control of air flow to a room on fire.
Figure 43B:
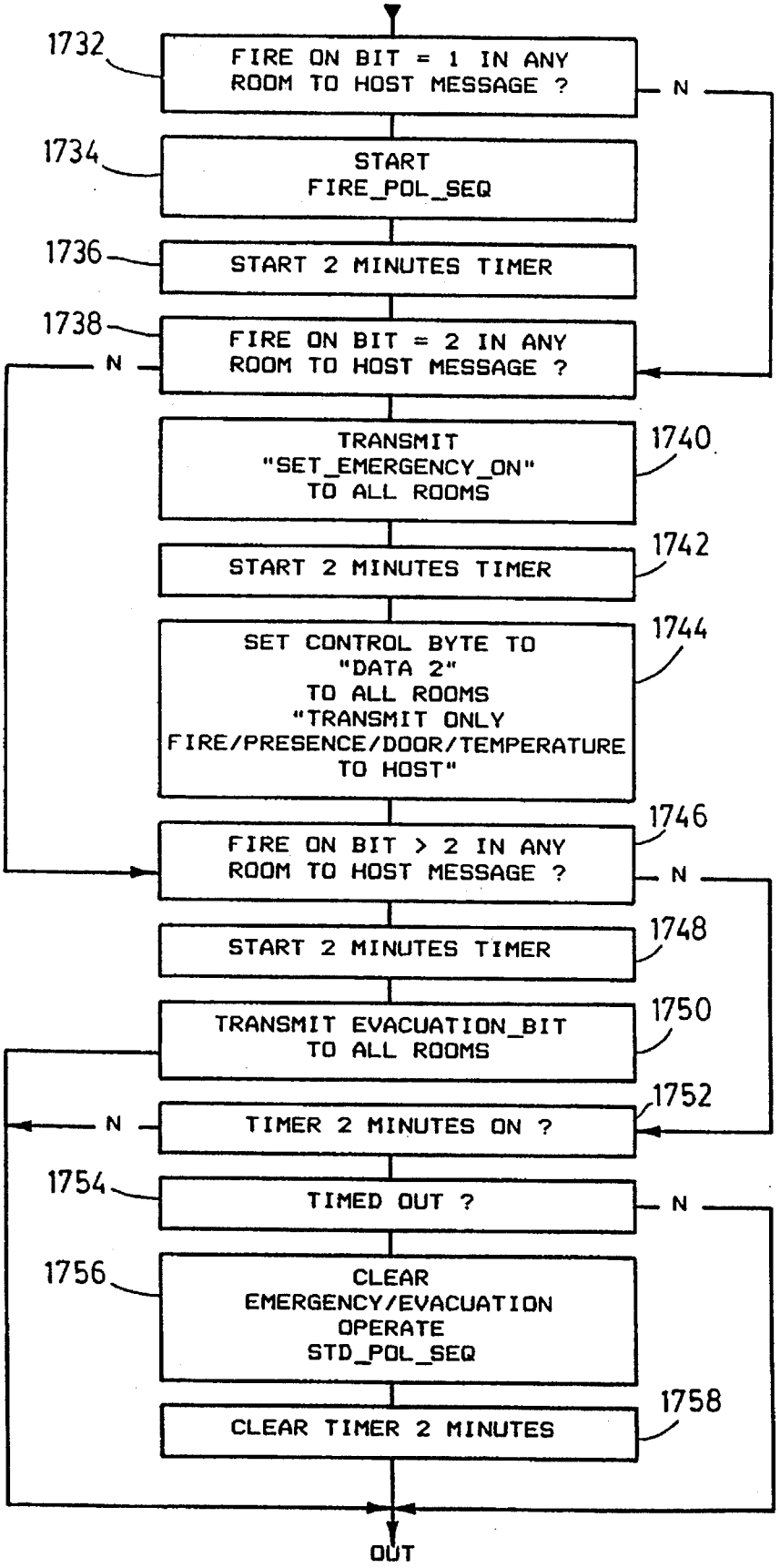

Limiting Flow of Air to Rooms on Fire (FIGS. 43A, 43B)

When a room is on fire, flow of fresh air to that room is cut off, to reduce spreading of the fire. In addition, if three or more rooms in the hotel are on fire, air flow to all the rooms is cut off, to reduce the rate of spread of the fire. However an exception is made in that a limited flow of air to a room is provided if a person is in the room and the room is not on fire. FIG. 43A shows the routine for this at the room level, and FIG. 43B shows the routine at the central or host computer level.

As shown in FIG. 43A, the first question is whether the fire alarm is on in the room (block 1700). If so, the high and low fan is set off in the room (block 1702) and the exterior red LED 164 is flashed (block 1704).

The next question is whether there is a "fire on bit=2" in any room to host message (block 1706). It will be recalled that all of the rooms transmit messages to the central or host computer, and that these messages are received by all of the rooms. A fire on bit=2" simply means that there are two fires in the building, either in the room in question and one other room, or in two other rooms. In that case emergency is set on and the high and low fan are turned off (block 1708). (If there had been no fire in the room in question, then the routine goes directly from block 1700 to block 1706.)

From block 1708, the next question is whether a person is present in the room (block 1710). If a person is present, then again the exterior red LED 164 is flashed (block 1712).

The next question is whether the fire on bit is greater than 2 in any room to host (i.e. central computer) message (block 1714). If the answer is yes, this means if there are three or more rooms on fire (either the room in question and two other rooms, or in three other rooms). This is considered to be a global event, rather than a local event as in the case of two fires. Evacuation is then set on (block 1716) and the high and low fan in the room in question are set off (block 1718).

The next question is whether a person is present in the room (block 1720). If yes, the exterior red LED 164 is flashed (block 1721). Then, if there is no fire in the room in question (block 1722), the low fan and cold valve in that room are operated for 15 seconds every minute (block 1722). This provides a limited flow of cool fresh air to the person in the room. (This same procedure could have been used to provide limited air flow to rooms not on fire with a person present in the case of two fires in the building.) If no person had been present, then block 1723 is by-passed and instead the exterior green LED 166 is turned on (block 1724).

Once the above process has occurred, the next question is whether all communication messages from all of the rooms have been received and verified (block 1726). If there is no fire in the room in question and no fire message from any other room, then the routine cycles directly from block 1700 to blocks 1706, 1714, and 1726.

If all communication messages nave been received and verified, the next question is whether the fire or emergency or evacuation condition is now off (block 1728). If so, then the fire and emergency and evacuation flags are cleared (block 1730) and the routine cycles to "out".

Reference is next made to FIG. 43B, which illustrates communication between the rooms and the central computer in the event of fire. As shown, if the fire on bit=1 in any room to host message (block 1732), then the fire polling sequence is started (block 1734). The fire polling sequence is a special way of polling rooms in order to monitor any spread of the fire more quickly and will be described in connection with FIG. 44. A two minute timer is then started (block 1736).

The next question is whether the fire on bit= 2 in any room to host message (block 1738). If so, then a message "set emergency on" is transmitted by the central computer to all of the room control units (block 1740) since there are two fires on. The two minute timer is again started (block 1742). In addition the control byte is set to "data 2" to all rooms, and the room control units 80 are instructed to transmit only fire/presence/door/temperature information to the central or host computer (block 1744). The reference to "set control byte to data 2" deals with the fact that the system may take relatively long to poll all of the rooms, partly because the standard message from each room can be quite long. When the control byte signals data or message type 2, then the room control units remove several bytes (e.g. 4 bytes) out of their messages, so that the message sent by each room is snorter and the time taken to poll all of the rooms will be reduced. For example, unnecessary information such as the clean status of a room is not at this time sent to the central computer.

The next question is whether the fire on bit is greater than 2 in any room to host message (block 1746). If so, the two minute timer is re-started (block 1748) and an evacuation bit is transmitted to all of the rooms (block 1750). (This instructs the rooms, for example, to flash their red LED's if a person is present and to turn on their green LED's if no person is present.)

If there is no fire in one room (block 1732), or in two rooms (block 1738) or in more than two rooms (1746), then the two minute timer will not be on (block 1752) and the routine cycles to "out". If there was a fire in one or two rooms but not in more than two rooms, then the next question is whether the two minute timer is on (block 1752). If so, and it has not timed out (block 1754), the routine cycles to "out". If it has timed out, this indicates that there are no longer any fires which would have re-started the timer, and the emergency and evacuation flags are now cleared and the standard room polling sequence is resumed (block 1756). (The room polling sequence will as indicated be described with FIG. 44.) The two minute timer is then cleared (block 1758).

It should be noted that fire decisions override all counter decisions in the system at all times. Fire decisions and signals always receive priority.

Figure 44:
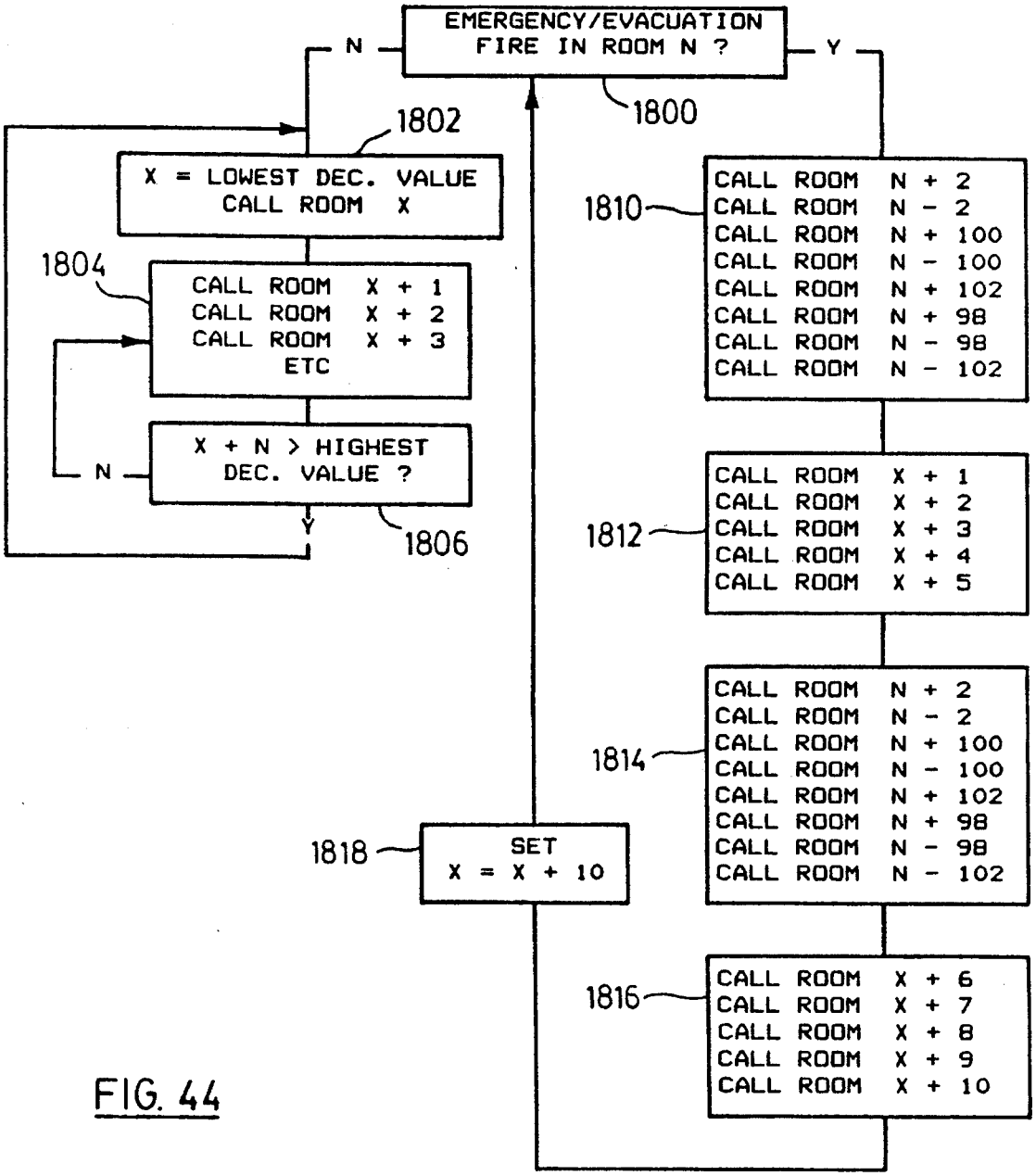
FIG. 44 is a logic flow chart showing the sequence of polling rooms when a room is on fire.

Polling Sequence (FIG. 44)

Reference is next made to FIG. 44, which shows the sequence in which the central computer polls or calls rooms normally and if there is a fire, emergency or evacuation condition on.

If there is no fire condition in room N (block 1800), then the central computer first calls the lowest number room X (block 1802) and then calls rooms X+1, X+2, X≠(block 1804). The polling ends when X+N is greater than the highest number room (1806), and the polling then begins anew with room X (block 1808).

If there is a fire in room N with an emergency or evacuation condition, then the polling routine changes as shown at the right hand side of FIG. 43. The routine first calls all the neighbours of room N (block 1810), namely rooms N+2, N−2, N+100, N−100, N+102, N+98, N−98, N−102. The neighbours are of course all the rooms on the same side of the building adjoining room N.

The routine then calls five rooms in normal sequence, namely rooms X+1 to X+5 inclusive (block 1812).

The routine then goes back and calls the neighbours of room N again (block 1814), after which it calls the next fire rooms in normal sequence (block 1816). After this, X is set equal to X+10 (block 1818) and the routine repeats.

It will be seen that by repeatedly calling the neighbours of the room where there is a fire, any spread of the fire to neighbouring rooms will be more quickly monitored than if the routine polled all of the rooms in the normal sequence shown at the left hand side of FIG. 44.

If there is a fire in more than one room, then the routine will call the neighbours of the first room on fire, then five rooms in regular sequence, then the neighbours of the other room which is on fire, then five rooms in regular sequence, etc.

Figure 45:
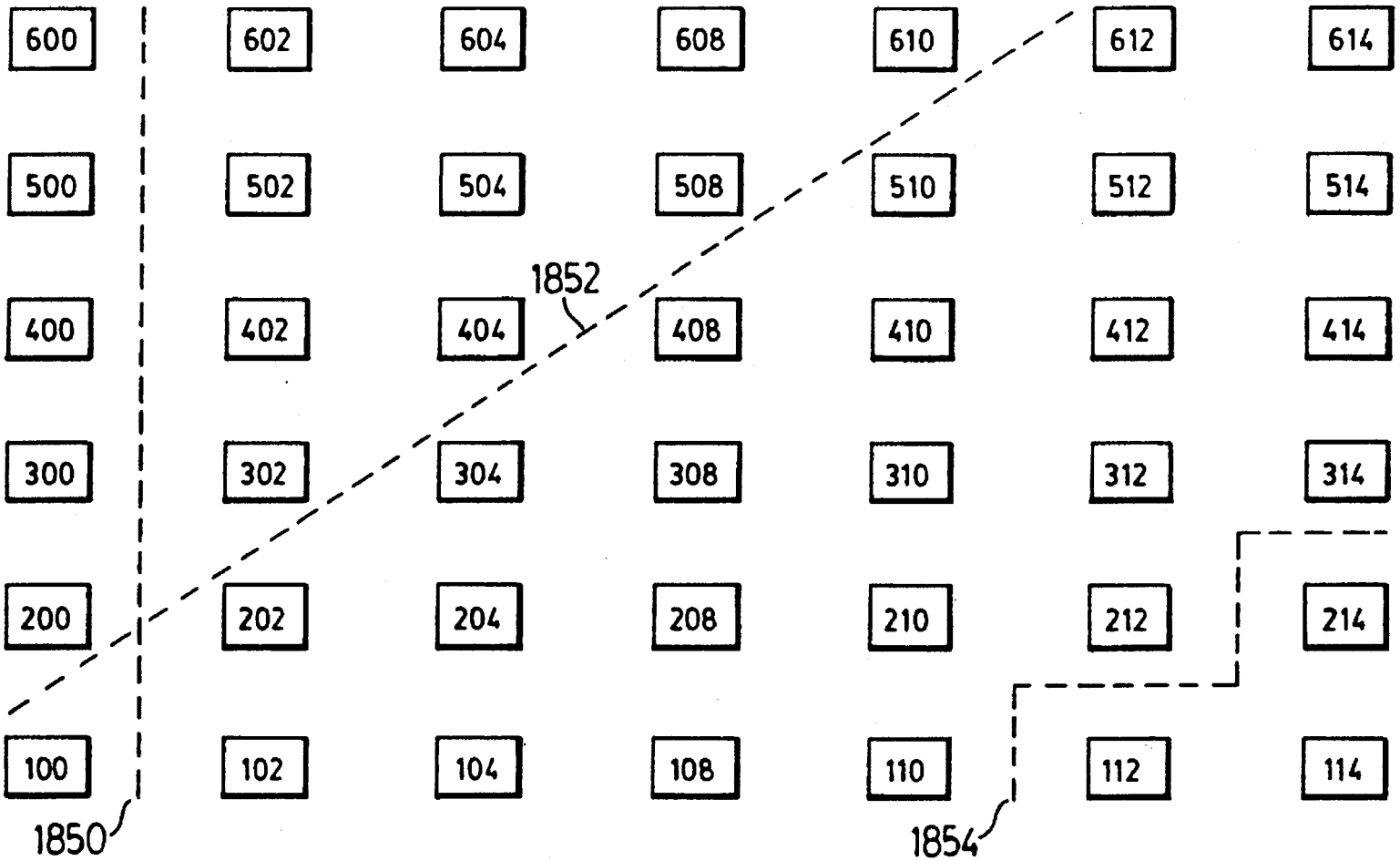
FIG. 45 is a map of rooms.
Figure 46A:
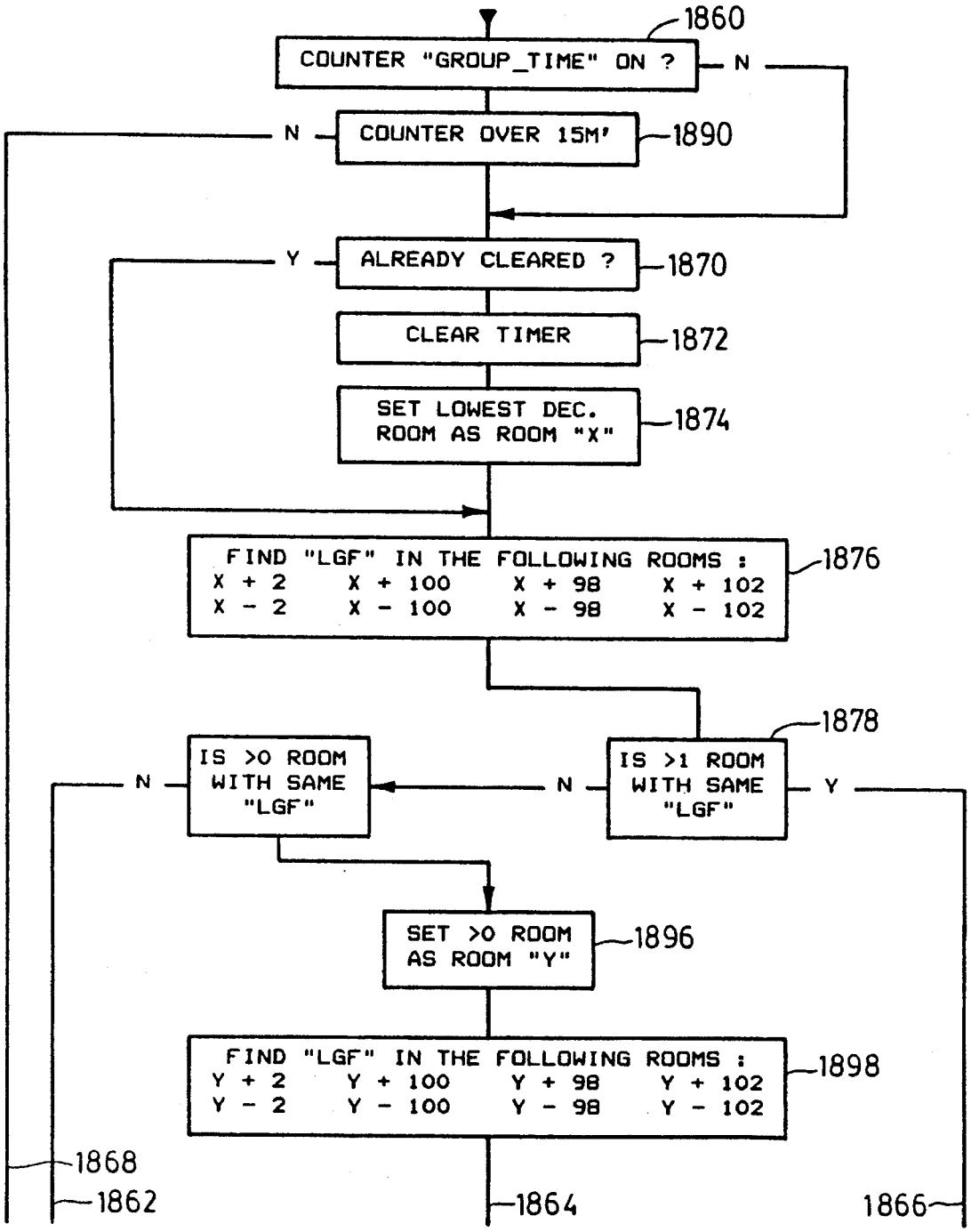
FIG. 46A and 46B are a logic flow chart for grouping rooms to test for environment failure.
Figure 46B:
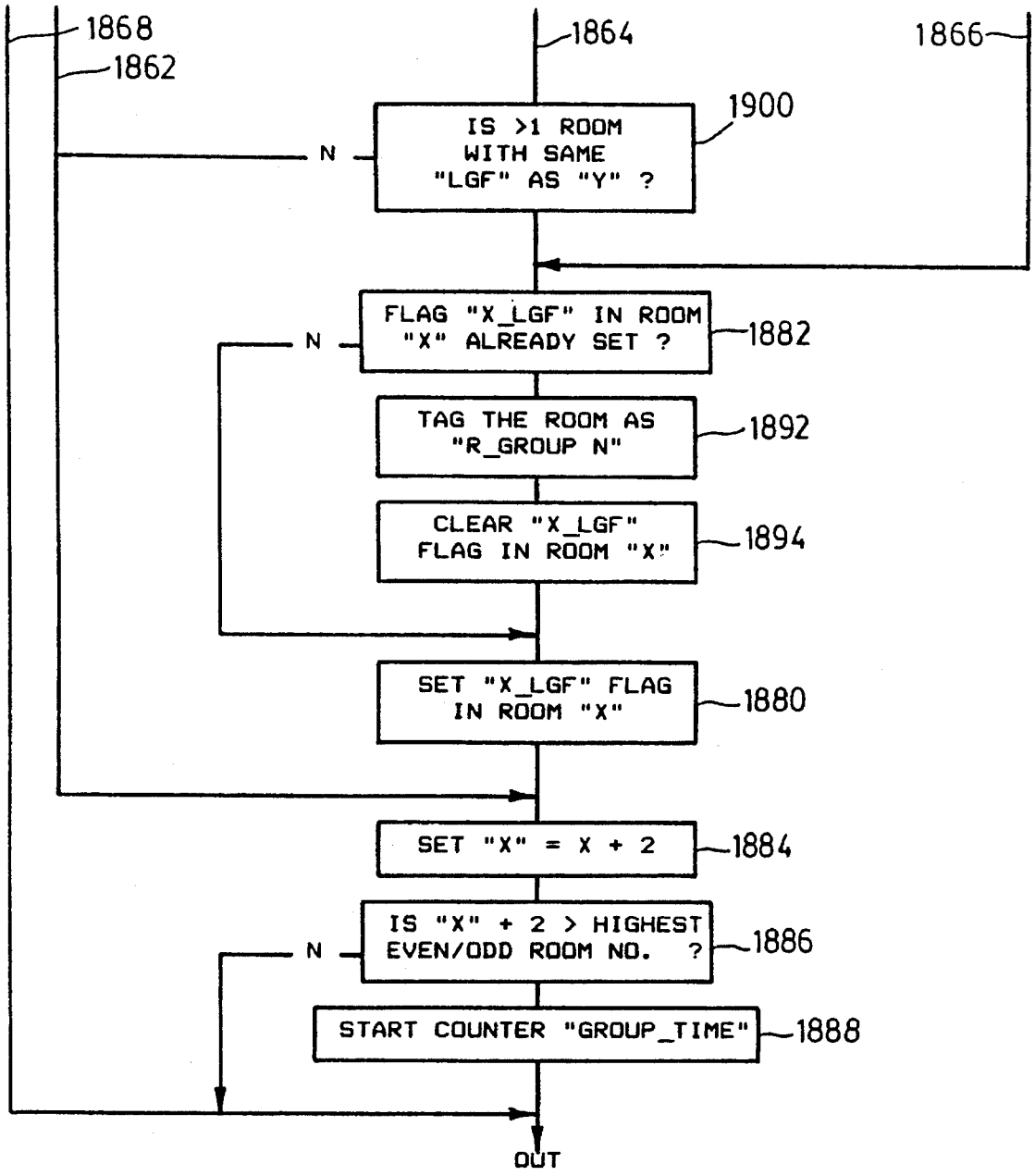

Environment Failure FIGS. 45, 46A, 46B)

This procedure looks at the loss/gain factor (lg factor or lgf) of the rooms on each side of the hotel and forms into groups those rooms which have similar lgf's. Then, if the lgf of one of the rooms in a group deviates from those of the other rooms in the group, and if the lgf of such room is too high, environment failure in that room will be declared. An environment failure is indicative of such problems as a broken window, missing caulking on a window, a hole in a room, or the like. The procedure is automatic, and while not foolproof, will in most cases eventually give an indication of an environment failure.

The method used is as follows, with reference to FIG. 45. FIG. 45 shows even numbered rooms, i.e. those on one side of a hotel. It is assumed that there are eight rooms on the side in question and that there are six floors, so that the room numbers range from 100 to 114 on the first floor, 200 to 214 on the second floor, up to 600 to 614 on the sixth floor.

It will be noted that there are three categories of rooms. There are corner rooms which have only three neighbours. Room 100 is an example of this; its only neighbours are rooms 102,202 and 200. This will be called a type A room.

Secondly, there are rooms other than corner rooms but which are on the top floor, the bottom floor, the bottom floor, or on the side of the building. These rooms have five neighbours. Room 400 is an example of this; its neighbours are rooms 300, 302, 402, 502 and 500. Room 106 is another example; its neighbours are rooms 104,204,206,208 and 108. Rooms with five neighbours will be called type B rooms.

Finally, rooms not on the top, bottom or edge of a building have eight neighbours. Room 406 is an example of this. Rooms having eight neighbours will be called type C rooms. Whether a room is a type A, B or C room is contained in a look-up table in the memory of the main computer.

It will be seen having regard to FIG. 45 that different rooms even on the same side of the building can have different lg factors. This commonly occurs when some rooms are shaded and others are in the sun. For example assume in FIG. 45 that rooms 102 and all those to the right of line 1850 are shaded and rooms 100 to 600 are in the sun. In that case rooms 100 to 600 can form one group and the remaining rooms can form another group. Of course sun and shade normally form more complex patterns, as will be discussed.

The next step, therefore, is to see whether a room is part of a group all having the same lg factors. If it is part of such a group, then no environment failure will normally be declared. If it is not part of a group having the same lg factor, and if its lg factor is too high, then an environment failure will be declared. The comparison is made firstly by checking the neighbours of a room to see whether the neighbours have the same lg factor as the room being checked. A neighbour which has the same lg factor as the room being checked will be called a "similar neighbour" or "SN".

The rules for forming groups are then as follows, with reference to the following equations. Assume that it is desired to determine whether room X is a member of a group. The test is—if room X satisfies any of the following equations, it can be tagged as being a member of a group:

1. X→SN→2SN.
2. X→SN→SN→2SN.
3. X→SN→SN→SN→2SN.

In addition, if room X is a type C room (eight neighbours), then it can be tagged as being a member of a group if it simply has two similar neighbours, i.e. X→2SN. (In these equations, room X cannot itself be one of the similar neighbours.)

Examples of the use of these equations are as follows. Assume as before that the rooms to the left of line 1850 in FIG. 45 are in the sun and that the rooms to the right of this line are in the shade. Then assuming that there are no environment failures, room 100 will have a similar neighbout (room 200) which has a similar neighbout (room 300) which has two similar neighbours (rooms 200 and 400). A group of four rooms is thus formed (equation 2), and room 100 can therefore be tagged or defined as being a member of a group.

Consider room 400, which is a type B room. This room has a similar neighbour (e.g. room 300) which has a similar neighbour (e.g. room 200) which has two similar neighbours (rooms 100 and 300). Room 400 is therefore also tagged as being a member of a group.

As the day elapses and the sun moves, eventually line 1850 will move either to the left or to the right, and the room groupings will change. Room groupings are established every 15 minutes, but it is preferred that two cycles without change occur before a new room map is established.

As another example, assume that rooms above and to the left of diagonal line 1852 are in the sun and that rooms to the right and below this line are shaded. Take room 406 as an example. Room 406 has at least two similar neighbours (in fact rooms 304, 306, 308,408 and 508 are all similar neighbours to room 406 if there is no environment failure). Room 406 can therefore be tagged as being a member of this group.

Assume that the shade follows a zig-zag line as shown at 1854 in FIG. 45, so that rooms 112, 114 and 214 are in the shade and all of the remaining rooms are in the sun. In that case none of rooms 112, 114 or 214 will fit any of the equations listed and will not be defined as being part of a group. However as the day elapses, line 1854 will move either to shade more rooms or to place rooms 112, 114 and 214 in the sun. Either way, these rooms will subsequently become part of a group.

FIGS. 46A and 46B together show a typical flow chart showing the sequence of steps taken to group together type C rooms. In this chart there is a reference to counter "group time" (block 1860). This counter simply establishes a 15 minute recycle time. The lg factors for all of the rooms are polled in a few mill:seconds, but the rooms are assigned to groups only once every 15 minutes. However preferably the room mapping is actually changed only every two cycles, i.e. every 30 minutes. This helps to deal with the possibility that some rooms may be in half sun and half shade.

in FIGS. 46A, 46B, lines 1862, 1864, 1866, 1868 in FIG. 46A continue as the same lines in FIG. 46B. With reference to these Figs., assume that the counter group time (block 1860) is not on and is not already cleared (block 1870) so that it is now cleared (block 1872). Then the lowest room number is set as room X (block 1874).

Next, the lg factor or lgf is found for all of the neighbours of room X. Since room X is a type C room (eight neighbours), it is found for all eight of such neighbours (block 1876).

Assume that more than one (i.e. at least two) of the neighbours have the same lgf as room X (block 1878), and that this is the first time that this has occurred. Then the routine takes branch 1866 and a flag "X_lgf" is set for room X (block 1880). This flag simply means that room X has sufficient neighbours with the same lgf to qualify for a group. Since this is the first time that room X has had this particular lgf, the flag "X_lgf" was not set previously (since previously room X had a different lgf) and therefore the answer at block 1882, i.e. was flag X_lgf in room X already set, is no.

The routine then checks the lgf for the next room, here shown as X+2 (block 1884). However it may be expedient to check the rooms by moving vertically from the bottom to the top floor in columns, and then to move back and start at the next room number on the bottom floor. In that case the next room to be checked would be X+100.

If the highest number room has not been checked, the answer at block 1886 is no, and the polling of the rooms for their lgf's continues. Once the number of the next room to be checked is higher than the highest number room existing, the answer at block 1886 is yes, and the 15 minute counter "group time" is started (block 1888).

So long as the group time counter is on and not over 15 minutes (block 1890), the routine will not check rooms further and will cycle to "out" on branch 1868. Once the counter is over 15 minutes, it is cleared as previously described (block 1892) and the rooms are checked again.

Assume that the result for room X on the next cycle is the same as that just described for the last cycle, i.e. it has the number of neighbours with the same same lgf for two cycles. Then, since the flag X_lgf in room X was set on the last cycle, the answer at block 1882 is now yes. Therefore room X is now "tagged" as being a member of group "n" since it has been a remember of a permitted group for two cycles (block 1882). The flag "X_lgf" is now cleared from the room (block 1894) so that another two cycles of the same lgf for the room will be needed before the grouping of the room will be reconfirmed or re-assigned.

If in FIG. 46A there is only one room (i.e. SN) with the same lgf as room X, then this SN room is set as room Y (block 1896) and the lgf is found for its neighbours (block 1898). The neighbour of a type C room may be a type A, B or C room, but block 1898 shows that the lgf is found for all eight of its neighbours if they exist.

If there is more than one room with the same lgf as room Y (block 1900), this satisfies equation 1, and the routine moves to block 1882 as before. If equation 1 is not satisfied, checks in the same manner as shown will be made to see whether a room satisfies equations 2 or 3, so that it can be tagged as being a member of a permitted group.

Figure 46C:
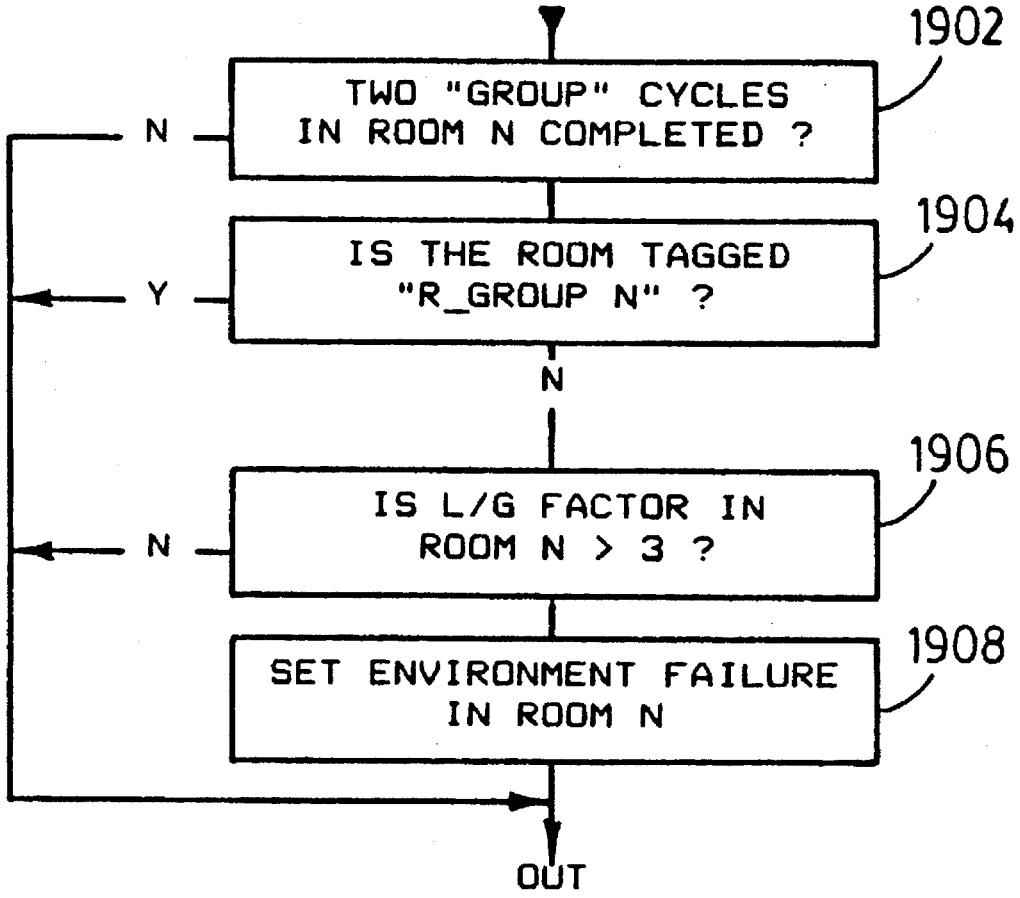
FIG. 46C is a logic flow chart showing declaration of an environment failure.

When the grouping is completed, most or all of the rooms will be shown as being members of a group. Those which are not members of a permitted group for two successive cycles will be shown as having an environment failure if their lg factors are too high. A simple routine for this is shown in FIG. 46C. As there shown, the first question for the room in question is—have 2 cycles per room been completed (block 1902)? If yes, then the next question is whether the room was R grouped, i.e. grouped with its neighbours (block 1904) as previously discussed. If the answer is yes, then the next question is whether the room's lgf is less than 3 (block 1906), i.e. does it lose or gain 2° in less than 3 minutes. If the answer is yes, "environment fail" is set (block 1908) and is sent to be printed out as a report and/or to appear on a screen of one of the terminals 174. This routine is repeated for each of the rooms.

The block 1906, i.e. checking to see if the lgf of the room is too high, is optional (to reduce the likelihood of erroneous findings of environment failure) and can be removed if desired.

Note also that the use of equations 1, 2 and 3 above is not essential. However these equations are useful to group rooms which would otherwise be difficult to group because they are on a corner, side, top or bottom of a building. Without them more cycles would often be needed to determine whether or not an environment failure exists. The equations allow a conclusion to be reached more quickly.

It will be realized that other methods of grouping rooms may be used. In addition in some buildings, e.g. round buildings, there will be no corner or edge rooms (though there will still be top and bottom rooms). The important factor is that in all cases, the heat loss (positive or negative) characteristics (i.e. the lg factor) of each room are determined periodically; such lg factor is compared with those of the room's neighbours (and the neighbours can be defined in any appropriate manner), and if fewer than a selected number of neighbours have lg factors similar to that of the room being analyzed, then an environment failure is declared for the room being analyzed. Optionally, as mentioned, the finding of an environment failure for a room is over-ridden (i.e. prevented) if the room does not itself have an excessive lg factor, regardless of how it compares with its neighbours.

The System State Screens (FIGS. 47–60)

Figures 47, 48:
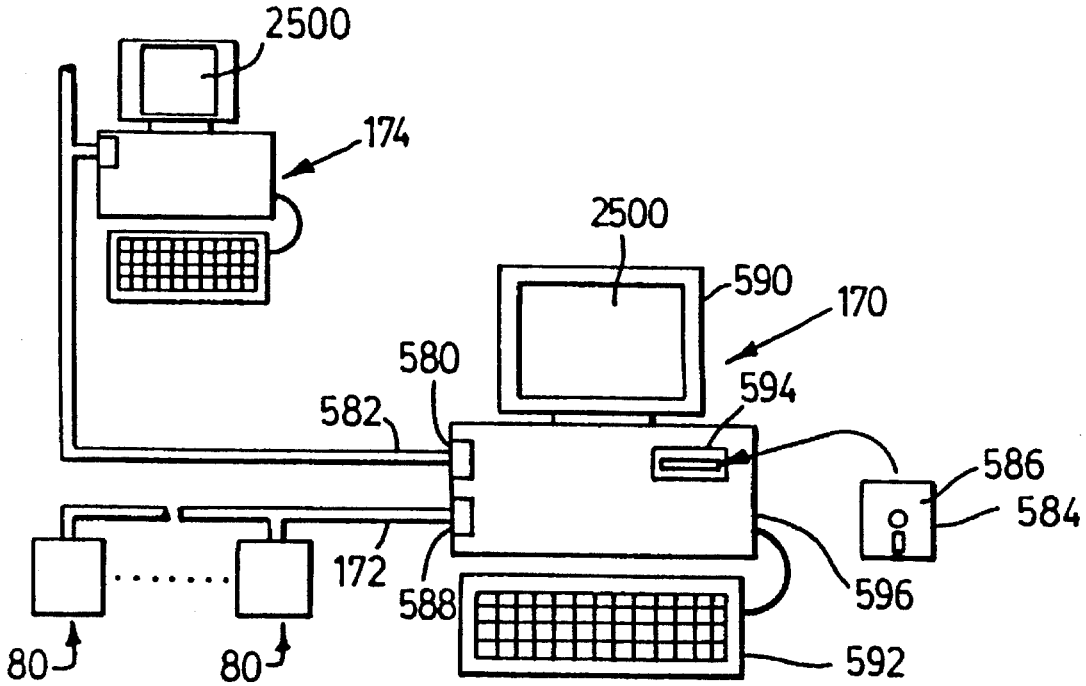
FIG. 47 is a schematic block diagram showing the central computer, its peripherals, and a remote terminal.
FIG. 48 is a diagrammatic representation of a message packet.

Referring to FIG. 47, the central computer 170 includes a display monitor 590, a keyboard 592, a disk storage unit 594, a central processing unit ("CPU") 596, a first communication port 588, a second communication port 580 and internal random access memory ("RAM") 598. As shown in FIG. 47, the central computer 170 can interface to one or more remote terminals 174 through the port 580 and a communication link 582.

The central computer 170 also includes a control program 586 which can be stored on a floppy diskette 584. The control program 586 performs four principal functions. First, the program 586 integrates all the room control units 80 into an environmental control system for the building. Second, the program oversees the communication between the central computer 170 and the room control units 80, and between the central computer 170 and the remote terminals 174. Third, the control program 586 receives and decodes room environment information from the control units 80. The program interprets this information and uses it to construct screens which are displayed on the monitor 590. Fourth, the control program 586 encodes and transmits environment control parameters to the control units 80.

The control program 586 uses the port 580 together with the link 582 to connect and communicate with one or more remote terminals 174. By connecting remote terminals 174 to the central computer 170, room information can be accessed and displayed in remote locations within the building such as the maintenance department, the front desk and the house-cleaning office. Using the communication link 582, the central computer 170 updates the one or more remote terminals 174 with the current room information. A suitable device for the central computer 170 and the remote terminals 174 is any personal microcomputer which is AT (trade mark) compatible.

Referring still to FIG. 47, the central computer 170 connects and communicates with a plurality of room control units 80 via the link 172. The link 172 provides two-way communication between the computer 170 and the room control units 80. As previously discussed, the link 172 utilizes the RS-485 communication protocol.

Figure 49A:
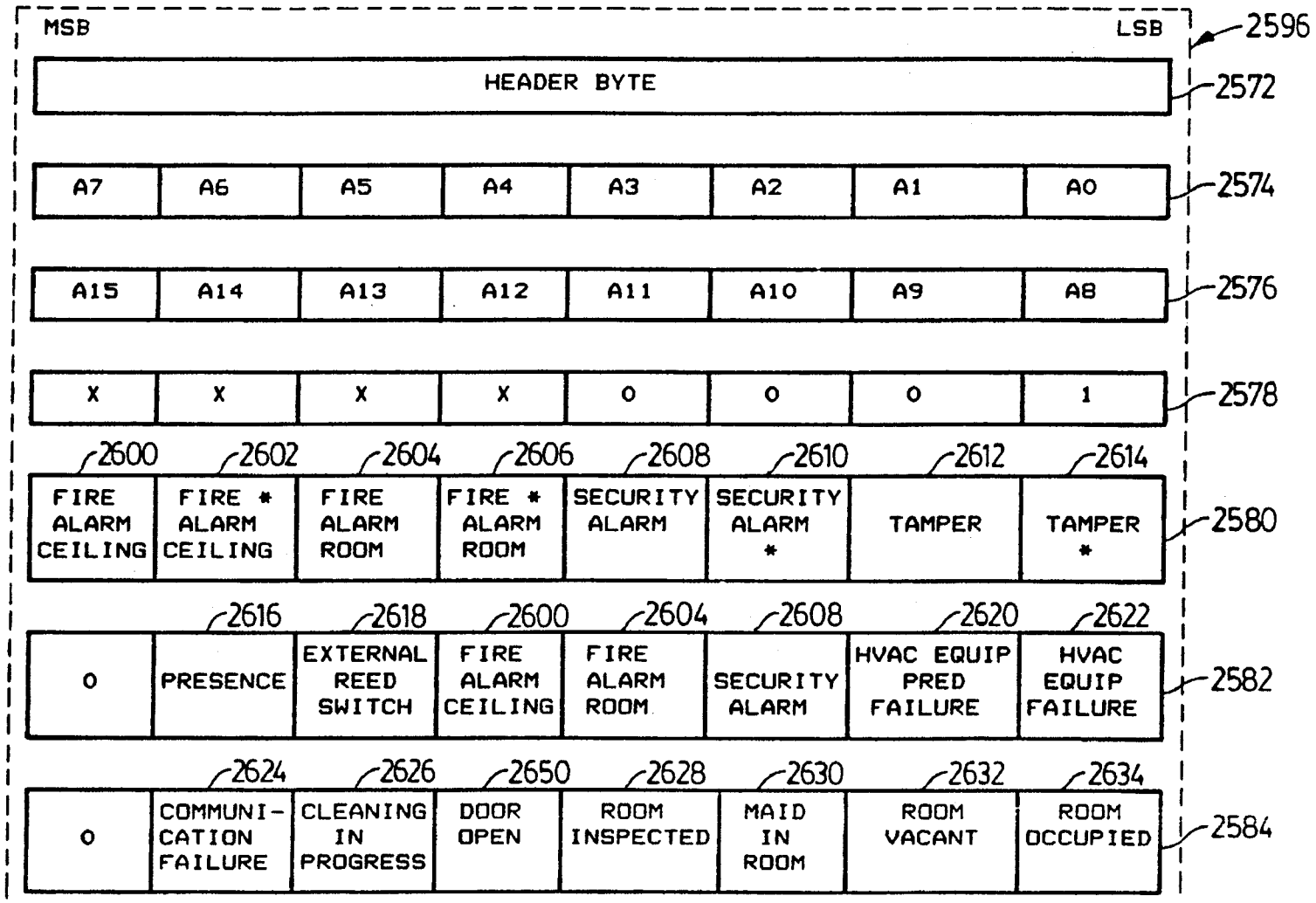
FIG. 49A*i* and 49A*ii* is a diagrammatic representation of a response message.
Figure 49B:
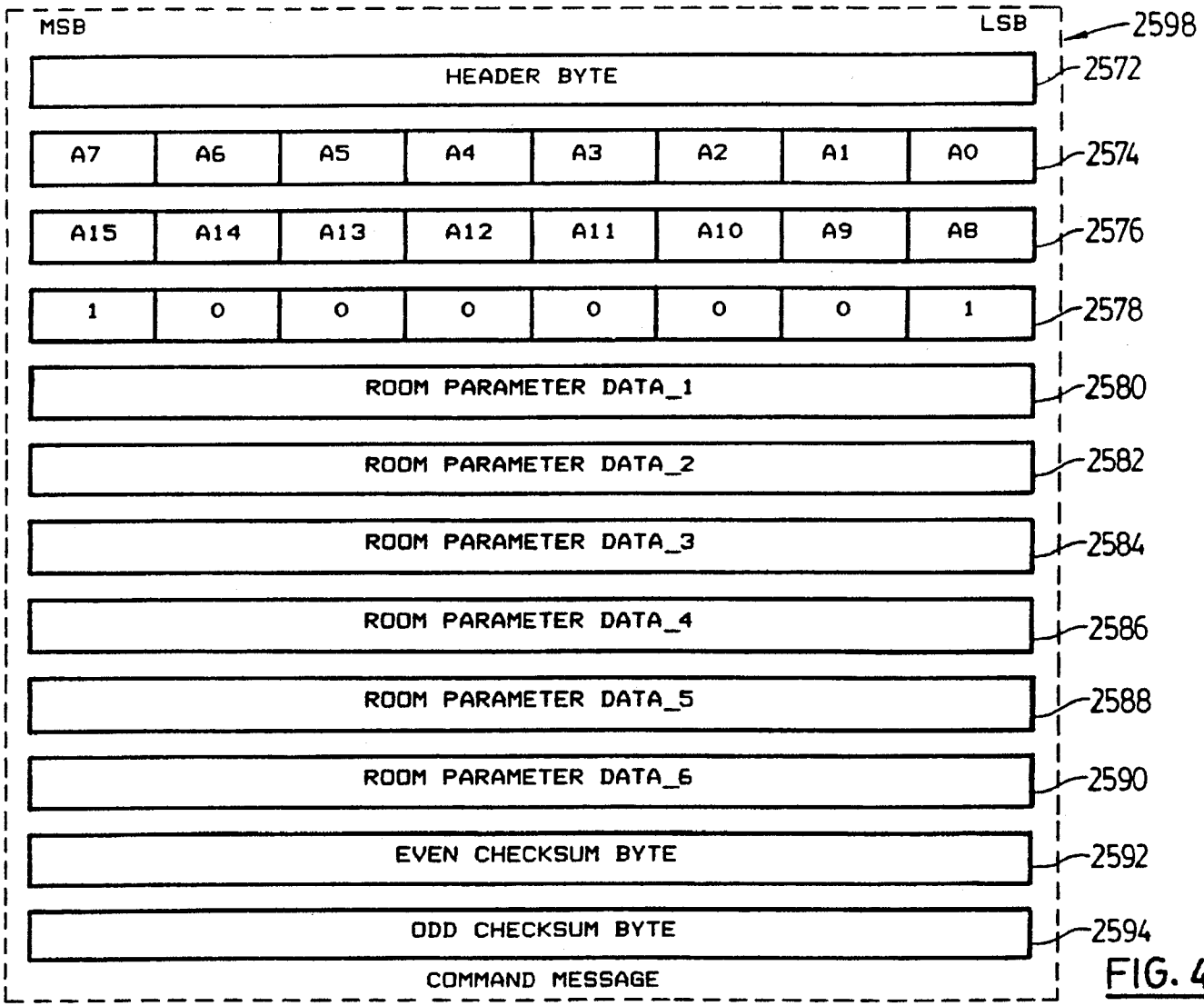
FIG. 49B is a diagrammatic representation of a command message.

Referring to FIG. 48, the central computer 170 uses a standard message packet 2570 to communicate in both the downstream and upstream directions. In the downstream direction, the computer 170 sends the control unit 80 a command message 2598 (FIG. 49B). Conversely, in the upstream stream direction, the control unit 80 sends the computer 170 a response message 2596 (FIG. 49A).

As shown in FIG. 48, the message packet 2570 consists of 12 bytes. They are a header byte 2572, a lower address byte 2574, an upper address byte 2576, a command code byte 2578, six room parameter data bytes 2580, 2582, 2584, 2586, 2588, 2590, an even checksum byte 2592, and an odd checksum byte 2594.

The header byte 2572 is standard for both the response message 2596 and the command message 2598. The next two bytes 2574,2576 contain the address of the particular control unit 80. As previously discussed, the address of the control unit 80 is hard-wired on the address board 168 and read by the MCU 210. Since the address of each control unit 80 is unique, the address bytes 2574,2576 can be used to identify the source of response messages 2596 and the destination of command messages 2598.

The two types of messages, command 2598 and response 2596, are distinguished using the command code byte 2578. As shown in FIG. 49A, the code byte 2578 for a response message 2596 contains 01 hexadecimal. Whereas, the code byte 2578 for a command message 2598 contains 81 hexadecimal as shown in FIG. 49B.

The command message 2598 is encoded by the central computer 170 as shown in FIG. 49B. The computer 170 uses the command message 2598 to send various system parameters to the room control units 80. The computer 170 encodes the system parameters into the data bytes 2580, 2582, 2584, 2586, 2588, 2590 of the message 2598. Typical system parameters include the timer period for HVAC failure, the timer period for resetting the first fire alarm, and the motion count for determining cleaning in progress. When a control unit 80 receives a command message 2598, the message 2598 is decoded and the appropriate parameters are updated.

Conversely in the upstream direction, a plurality of room environment indicators are encoded in the response message 2596 as shown in FIG. 49A. The room environment indicators include a room ceiling fire alarm 2600, a room fire alarm 2604, a security alarm 2608, a tamper alarm 2612, a presence status 2616, an external reed status 2618, a predicted HVAC failure indicator 2620, a HVAC failure indicator 2622, a communication failure indicator 2624, a cleaning-in-progress status 2626, a door status 2650, a room inspected status 2628, a maid-cleaning indicator 2630, a vacant room status 2632, an occupied room status 2634, the room temperature byte 2586, a security switch failure indicator 2636, an external reed failure indicator 2638, a door switch failure indicator 2640, and a motion detector failure indicator 2642. As shown in FIG. 49A, all of the previously mentioned room environment indicators, except the temperature byte 2586, are bit-mapped in the respective data byte of the message 2596. To accommodate the full range of temperatures that may occur in a room 10, the temperature reading occupies one byte or 8 bits.

Referring still to FIG. 49A, critical room environment indicators are both duplicated and also encoded as the complement of their active logic state. The additional encoding provides an error-checking redundancy mechanism which assures the integrity of the response message 2596. The complement bit-mapped codes (shown with an asterisk "*") used are a room fire alarm* 2606, a room ceiling fire alarm* 2602, a security alarm* 2610, and a tamper alarm* 2614.

As shown in FIGS. 48,49A,49B, each message packet 2570 also includes two checksum bits 2644, 2646 and the two checksum bytes 2592,2594. Byte 2592 contains the checksum of the even bytes in the packet 2570, and byte 2594 contains the checksum of odd bytes in the packet 2570. The checksum bytes 2592,2594 together with the redundant and logic complemented bit-map provide a reliable error-checking mechanism without adding substantial overhead to the packet 2570.

Once a response message 2596 is received by the computer 170, the control program 586 decodes the room environment indicators and translates them into data structures 2760. The data structures 2760, which are stored in memory, are used to construct state screens 2500 which are displayed on the monitor 590.

Since each control unit 80 continuously reads its sensors, response messages 2596 are rapidly transmitted to the computer 170. This message transmission allows the control program 586 to update the state screen 2500 in real-time. Real-time processing is essential to critical functions such as fire alarms and security breaches, so that the authorities can be alerted without delay. As will be discussed below, various state screens 2500 are used to convey the emergency and normal conditions of all the rooms 10 to the authorities, the building staff and other personnel.

Figure 50:
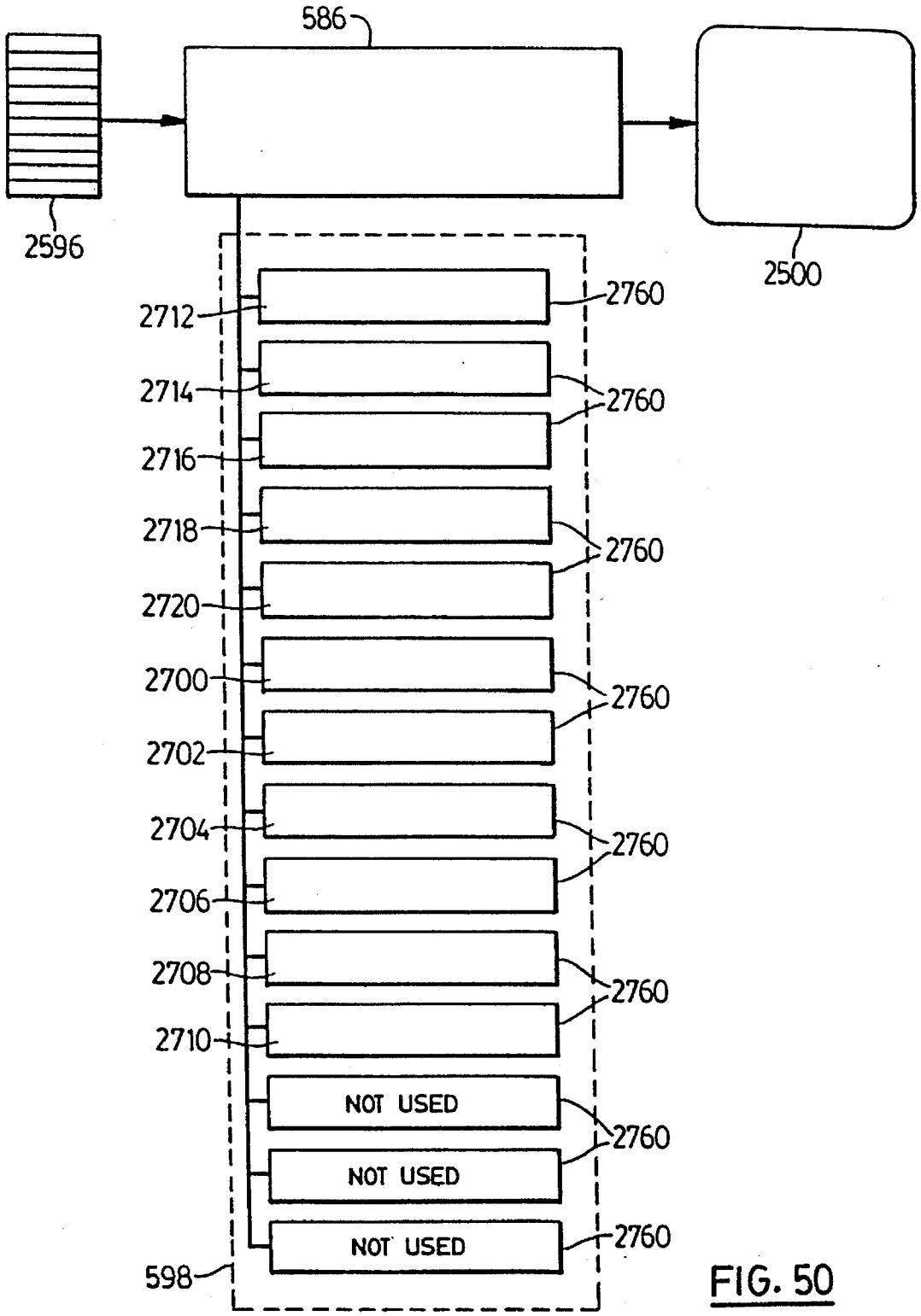
FIG. 50 is a block diagram of the control program utilized by the central computer.

Referring to FIG. 50, the control program 586 can construct a series of state screens 2500 corresponding to an environment mode by using the data structures 2750 stored in memory. The state screens 2500 are displayed on the monitor 590. The state screens 2500 are designed to convey maximum information which can be easily interpreted by the authorities and building staff. This is accomplished by using distinctive graphic shapes and a multi-color display format.

A suitable monitor 590 for displaying the state screens 2500 is a high-resolution multi-color monitor which utilizes video graphics array technology ("VGA"), such as the industry known NEC Multisync (trade mark) VGA color monitor.

Using data structures 2760 stored in memory 598, the control program 586 has the capability to compile fourteen different environment modes to describe the rooms 10 in a building. In the present embodiment, only eleven environment modes are being utilized. The eleven environment modes are room temperature 2700, room temperature range 2702, occupied rooms 2704, vacant rooms 2706, room cleaned 2708, guest presence 2710, fire alarm 2712, security alarm 2714, HVAC equipment failure 2716, predicted HVAC equipment failure 2718, and user request 2720. To display a particular environment mode, the control program 586 uses the corresponding data structure 2760 to construct the state screen 2500 which is then displayed on the monitor 590.

Under the control program 586, there is a further classification of environment modes into two types: emergency mode, and normal mode. Emergency mode, which consist of fire alarm mode 2712 and security alarm mode 2714, is given priority for processing and display over the normal environment mode. In addition, there is an internal priority in emergency mode which allows a fire alarm mode 2712 to override a security alarm mode 2560.

Figure 51:
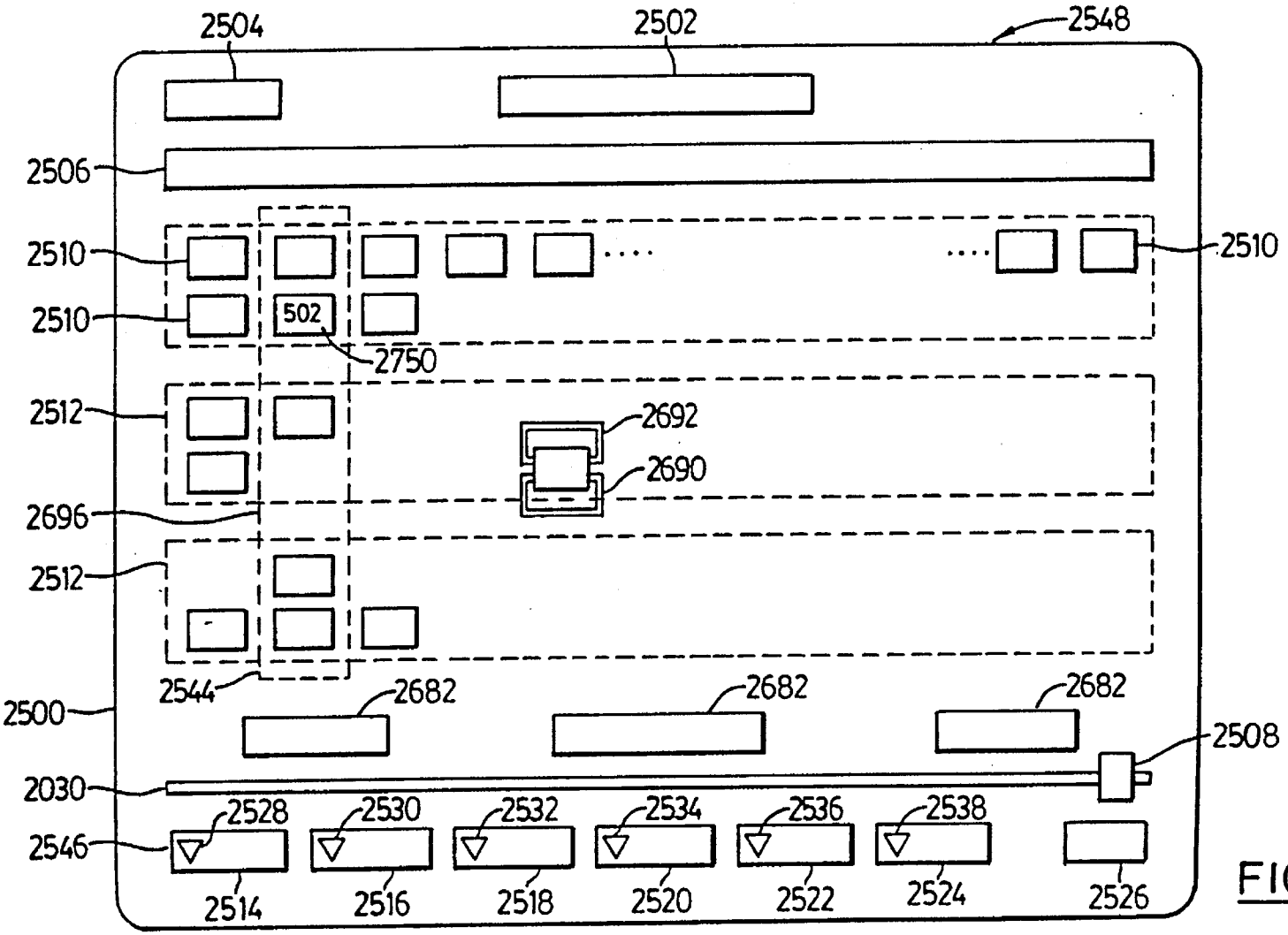
FIG. 51 is a diagrammatic representation of a screen.

As shown in FIG. 51, the control program 586 utilizes a template 2548 which is common to all the state screens 2500. A template 2548 is preferred for two reasons. First, the template 2548 can be designed to optimize conveying information on a state screen 2500. Second, fixed display locations for commands and status messages on the template 2548 facilitate human interaction and interpretation of the different state screens 2500.

Referring still to FIG. 51, the template 2548 includes a title field 2502, a building location field 2504, and a message field 2506. The physical positions of these fields 2502,2504, 2506 are in the same locations in all the state screens 2500. The title field 2502 contains the name of the particular state screen 2500 being displayed. The location field 2504 identifies the area of the building being displayed. The location field. 2504 is particularly suited for a building with more than one wing or a multi-tower office complex.

The middle and largest portion of the state screen 2500 is arranged in a grid pattern consisting of a plurality of rows 2512 and columns 2544. Each row 2512 and column 2544 encloses a plurality of room icons 2510. Each room icon 2510 corresponds to a room 10 in the building. The rows 2512 can be arranged to depict the floors of a multi-level building, whereas the columns 2544 can be arranged to depict vertical columns of rooms 10 in a multi-level building. The rows 2512 and the columns 2544 form a room matrix 2696, which graphically depicts a map of the rooms 10, i.e. it depicts them in locations corresponding to their actual physical locations in the building. The room matrix 2696 facilitates identifying certain conditions such as fire progression, and utility line failure.

The room icon 2510 can be displayed with a room identifier 2750 as shown in FIG. 51. The room identifier 2750 corresponds to a physical location in the building such as the room number in a hotel. As will be explained in the state screen 2500 descriptions, the room icon 2510 can also display other types of room environment information.

Referring still to FIG. 51, each room icon 10 includes a lower frame 2690 and an upper frame 2692. As will be discussed below, the frames 2690, 2692 are activated when there is an exception condition in a room 10.

The bottom portion of the state screen 2500 includes a menu 2546 of fixed commands. The commands correspond to the various state screens 2500 which can be displayed on the monitor 590. The commands include a room temperature screen command 2514, a cleaning screen command 2516, a presence screen command 2518, a fire alarm screen command 2520, a security alarm screen command 2522, and a HVAC equipment screen command 2524. Since the number of rooms 10 in a building may exceed the allowable display area of the monitor 590, the menu 2546 also includes a scroll command 2526. Using the scroll command 2526, an operator can sequentially display the various floors of a multi-level building.

The scroll command 2526 functions together with a scroll screen field 2508. The field 2508 appears if the entire state screen 2500 cannot be displayed on the monitor 5980. The field 2508 provides the user with an indication of the which sub-screen of the state screen 2500 is currently being displayed.

The commands 2514,2516,2518,2520,2522,2524 include an identification letter which is unique to the respective command. In the present embodiment, the first letter of the command is designated as the identification letter. The first letter serves two functions. First, the color of the letter corresponds to a particular state screen 2500. Second, the letter maps the Command to the keyboard 592. Under the control program 586, selected keys on the keyboard 592 are mapped as command inputs.

Above the menu 2546, there is an area reserved for a plurality of context dependent fields 2682. The control program 586 only displays these codes 2682 on state screens 2500 which require additional information. The context dependent fields 2682 are separated from the menu 2546 by a solid line 2030.

Each state screen 2500 will next be described in more detail, with reference to FIGS. 52 to 60 in which the following color coding will be used. In figures with only one color shown, the color key is indicated in the text. In figures with more than one color, the color red is indicated by lines sloping upwardly to the right; the color blue is indicated by lines sloping upwardly to the left; the color white is shown as an unshaded area; the color purple is shown in cross-hatched horizontal lines; and the color green is depicted in bold face.

Figure 52A:
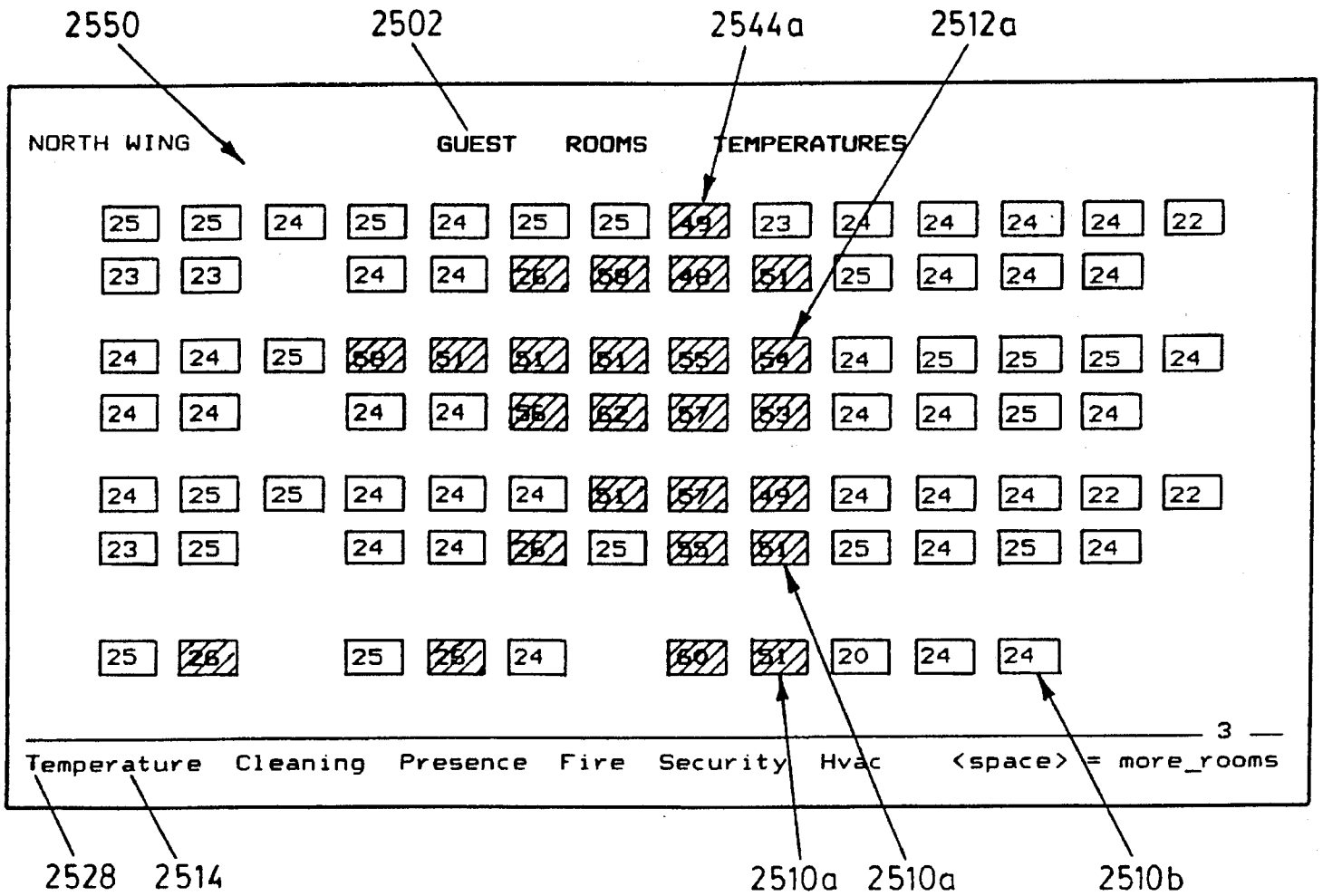
FIG. 52A is a representation of the Guest Room Temperature Screen.
Figure 52B:
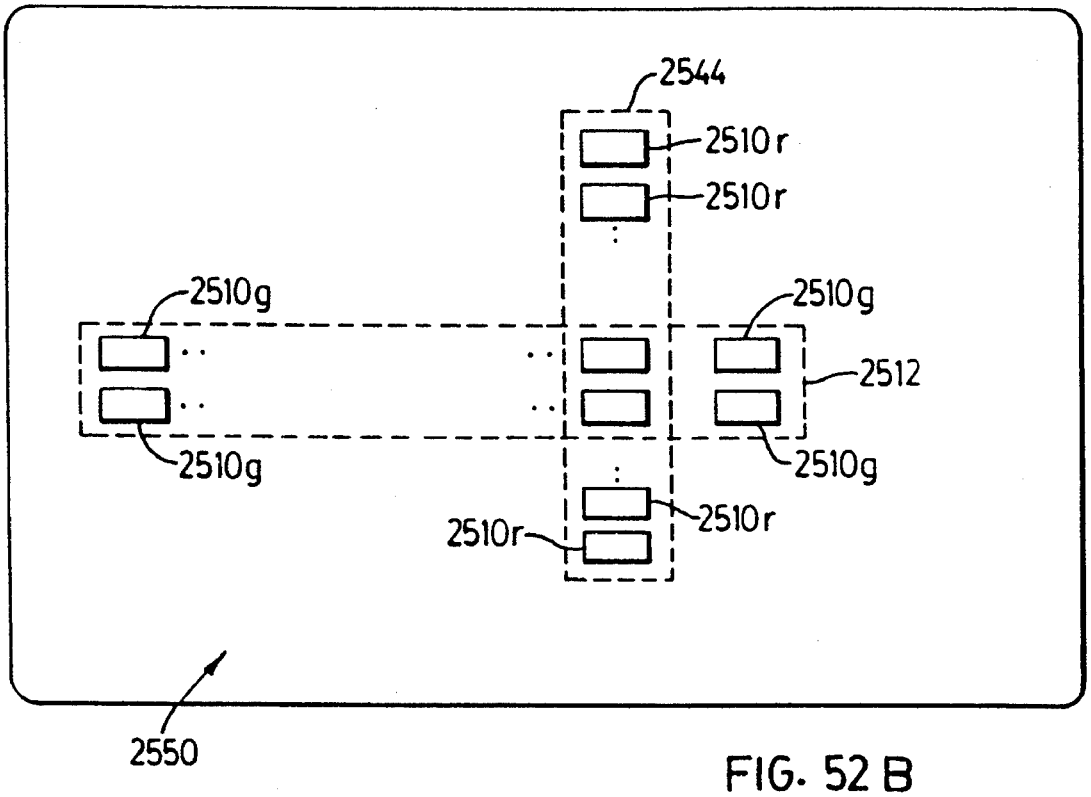
FIG. 52B is a representation of a HVAC failure displayed on the Guest Rooms Temperature Screen.

The Guest Rooms Temperature State Screen (FIGS. 52A, 52B)

Referring to FIG. 52A, the Guest Rooms Temperature state screen 2550 is shown as it would appear on the monitor 590. In the Room Temperature screen 2550, the current temperature of a room 10 is displayed instead of the room identifier 2750. The temperature in each room 10 appears as a number which is positioned in the respective room icon 2510. (As discussed, all temperatures are shown in Celius.)

Room icons 2510*a* with room temperatures exceeding a specified upper temperature are displayed in the color red. Room icons 2510*b* with temperatures in a defined comfort range are displayed in the color white. Room icons with temperatures below a specified lower room temperatures are displayed in the color blue (not shown).

The color coded room icons 2510 together with the room matrix 2696 can be used to monitor temperature patterns in the building. The temperature patterns, in turn, can indicate failures associated with room temperature. As shown in FIG. 52A, a column 2544*a* or row 2512*a* of room icons 2510 appearing in the color red and displaying very high temperatures show the progression path of a fire. This can indicate to a person viewing the screen not only where the fire has spread, but also where it is likely to spread in the future.

Similarly, but shown in FIG. 52B, a column 2544 of room icons 2510*r* appearing in the color blue in the winter season indicates that a valve supplying hot water to a riser pipe feeding the column 2544 of rooms 10 has failed. A row 2512 of room icons 2510*q* appearing in the color blue, again in the winter season, indicates the failure of an electrical main feeding the floor corresponding to these room icons 2510*q* (i.e. that the fans of all these rooms 10 have stopped).

Figure 53:
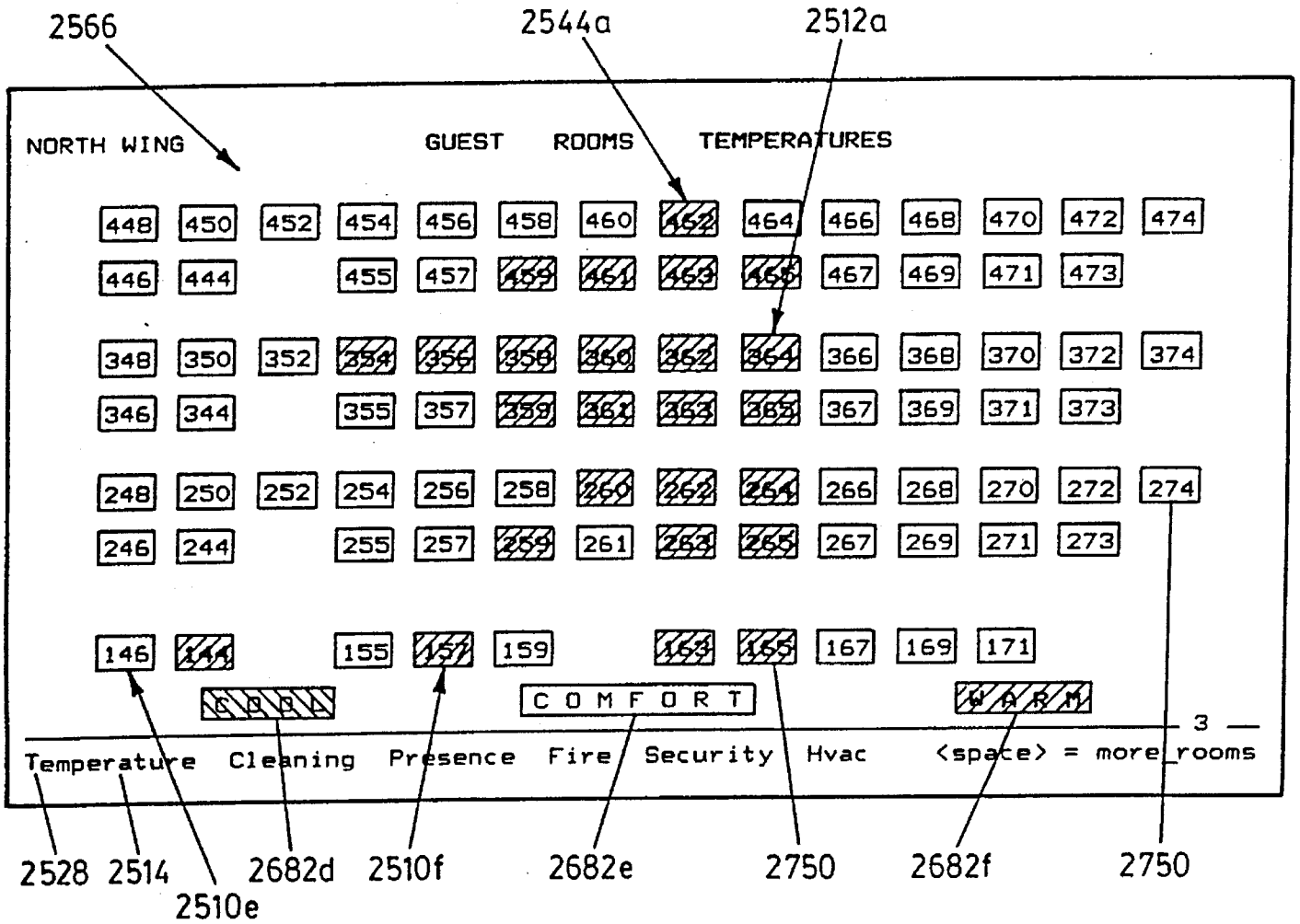
FIG. 53 is a representation of the Guest Room Temperature Range Screen.

The Guest Rooms Temperature Range State Screen (FIG. 53)

Referring to FIG. 53, the Room Temperature Range state screen 2566 also displays temperature information for the rooms 10, but in a different format. In state screen 2566, the room icons 2510 are displayed with the respective room identifiers 2750, and the context dependent fields 2682 are used to convey temperature information.

As shown in FIG. 53, room temperature information is displayed by using three color codes for the room icons 2510. A blue room icon (not shown), corresponding to field 2682*d*, indicates that the room 10 is in a cool temperature range (below a specified temperature e.g. 18 degrees). A white room icon 2510*e*, corresponding to field 2682*e*, signifies that the room 10 is in the comfortable temperature range (between specified low and high temperatures, e.g. 18 and 25 degrees respectively). A red room icon 2510*f*, corresponding to field 2682*f*, indicates that the room 10 is in the warm temperature range (above a specified temperature e.g. 25 degrees).

As discussed for the Room Temperature state screen 2550, the resulting temperature color patterns on state screen 2566 can also indicate equipment failures related to temperature.

The room temperature state is accessed by entering the letter 2528 of the temperature command 2514. Once in the temperature state, the operator uses the ALT, CAPS LOCK, INSERT, OR DEL keys on the keyboard 592 to toggle between the two temperature state screen 2550,2566.

Figure 54:
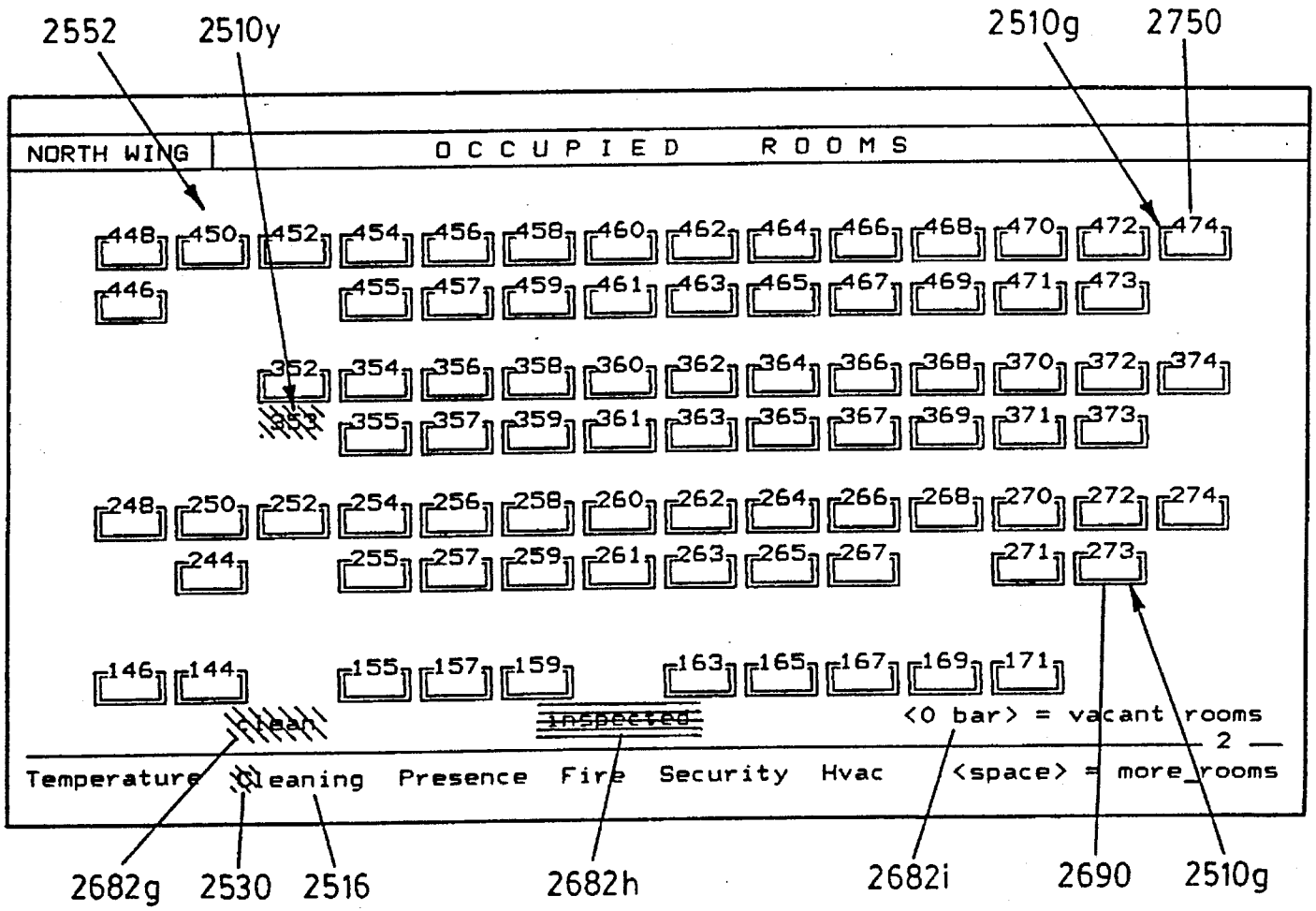
FIG. 54 is a representation of the occupied Rooms Screen.

The Occupied Rooms State Screen (FIG. 54)

The Occupied Rooms state screen 2552 is accessed by entering the letter 2530 for the cleaning command 2516. Referring to FIG. 54, the Occupied Rooms state screen 2552 displays the cleaning status of rooms 10 which are currently occupied by guests. In this state screen 2552, the room icons 2510 are displayed with the corresponding room identifier 2750.

On the state screen 2552, the cleaning status of a room 10, which is occupied, can take one of three states: (1) dirty, (2) cleaned; and (3) cleaned and inspected. A dirty room 10 appears with a lower frame 2690 bracketing the room icon 2510*g*. A cleaned room 10 appears as a room icon 2510*y* displayed without the frame 2690 and in the same color (e.g. blue) as indicated by cleaned room field 2682*g*. An inspected and cleaned room 10 appears as a room icon 2510 displayed in the same color (e.g. purple) as the field 2682*h* and without the frame 2690.

As shown in FIG. 54, the Occupied Rooms state screen 2552 includes an additional context field 2682*i* in the lower right-hand corner. The field 2682*h* identifies the ZERO BAR of the keyboard 592 as the key which is mapped to access the vacant Rooms state screen 2554 from the Occupied Rooms state screen 2552.

Figure 55A:
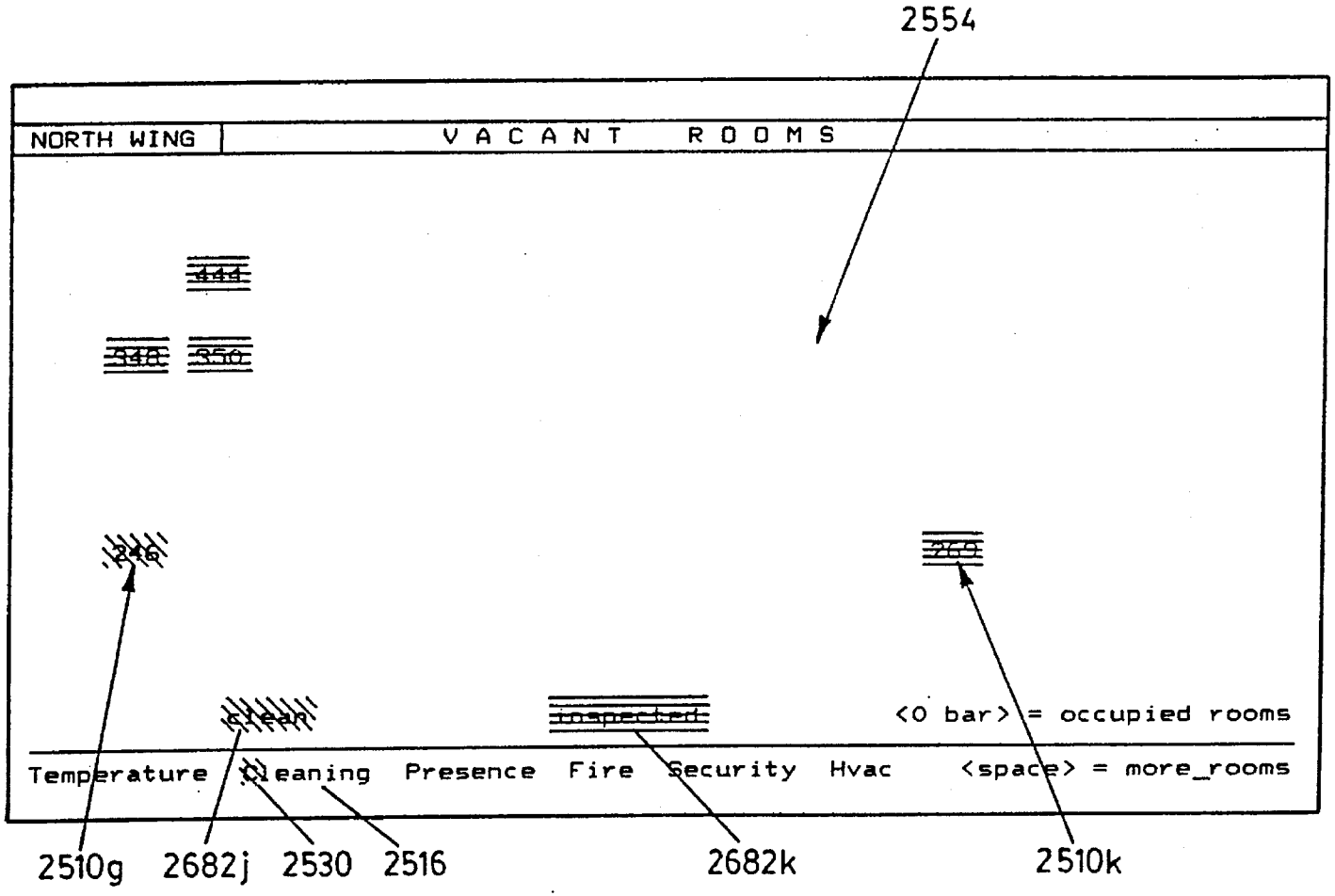
FIG. 55A is a representation of the Vacant Rooms Screen.
Figure 55B:
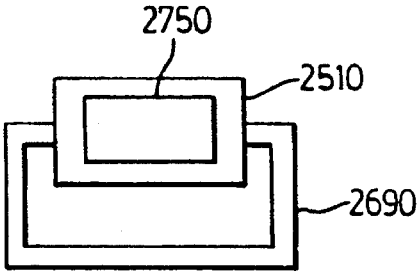
FIG. 55B is a representation of a dirty room on the Vacant Rooms Screen.

The Vacant Rooms State Screen (FIGS. 55A, 55B)

The Vacant Rooms state screen 2554 is also accessed by entering the letter 2530 corresponding to the cleaning command 2516. The appearance of the Vacant Rooms screen 2554 is very similar to the Occupied Rooms screen 2552, except that the room icons 2510 indicate rooms 10 which are vacant. The room icons 2510 are displayed with the room identifier 2750.

Referring to FIG. 55A, only room icons 2510 for vacant rooms 10 are displayed. Thus, the Vacant Rooms screen 2554 is the logical complement of the Occupied Rooms screen 2552.

In the Vacant Rooms screen 2554, a room 10, which is vacant, can again take one of the three states: (1) dirty; (2) cleaned; (3) cleaned and inspected. A room 10, which is vacant and dirty, appears with the lower frame 2690 bracketing the room icon 2510, as shown in FIG. 55B. A cleaned room 10 appears as a room icon 2510*j* displayed without the frame 2690 and in the same color as indicated by cleaned room field 2682*j*. An inspected and cleaned room 10 appears as a room icon 2510*k* displayed in the same color as field 2682*k* and without the frame 2690.

As shown in FIG. 55A, the SPACE BAR is used to switch to the Occupied Rooms screen 2552.

Figure 56:
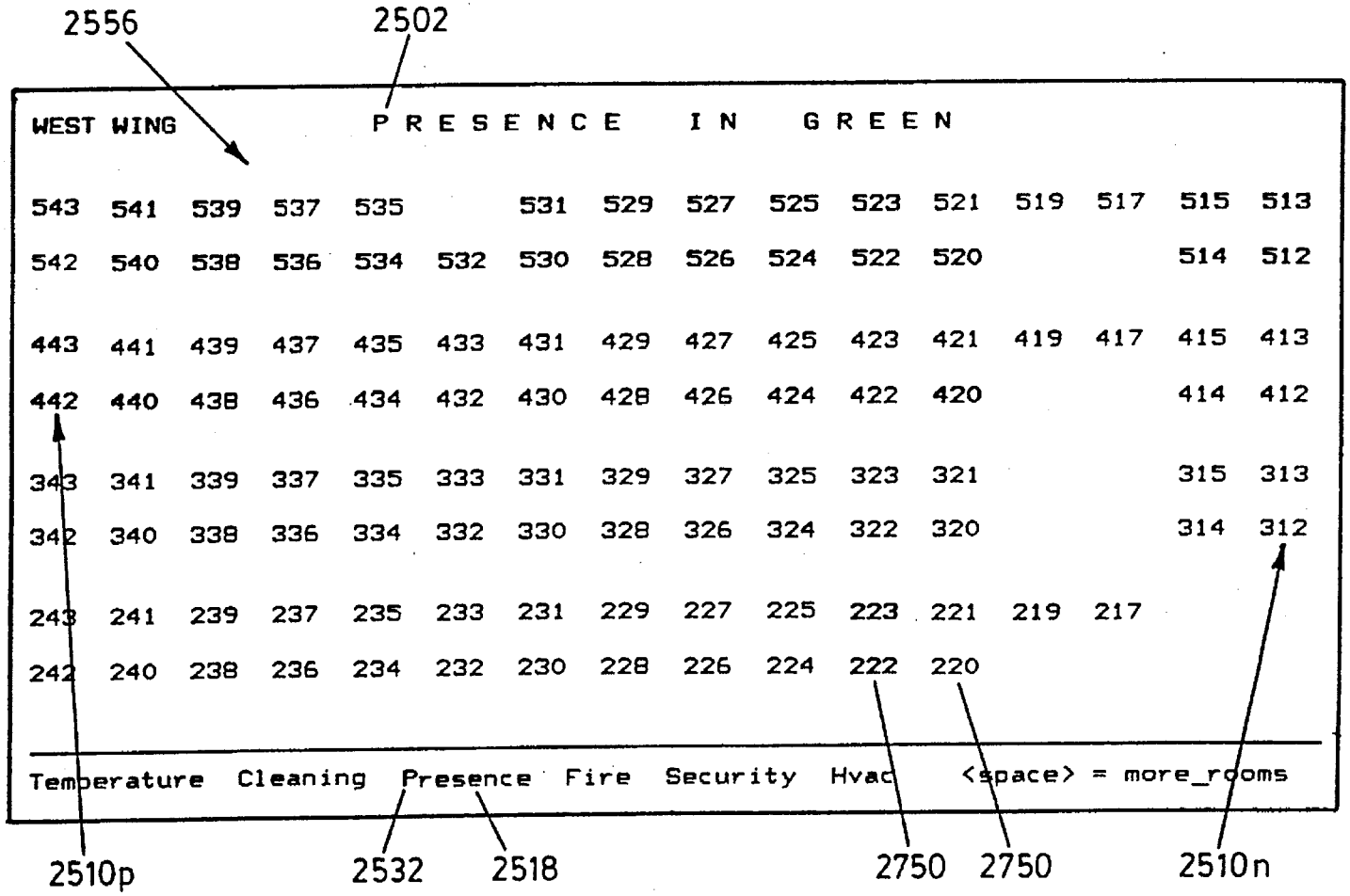
FIG. 56 is a representation of the Presence Screen.

The Presence State Screen (FIG. 56)

The Presence state screen 2556 distinguishes between rooms 10 in which a person is present, and rooms 10 which are empty. As shown in FIG. 56, a room 10 with someone present appears with the room icon 2510*p* in the presence color code (green). The room icon 2510*p* is displayed with the corresponding room identifier 2750. An empty room 10 also appears as a room icon 2510*n* with the corresponding room identifier 2750. However, for an empty room 10, the room icon 2510*n* and identifier 2750 appear in a color which easily contrasts with green (e.g. light brown).

The Presence screen 2556 is accessed by entering the letter 2532 which corresponds to the presence command 2518. As shown in FIG. 56, the command letter 2532 matches the color-code for a presence in a room 10. Additional presence-state association is given by color-coding the title field 2502.

Figure 57A:
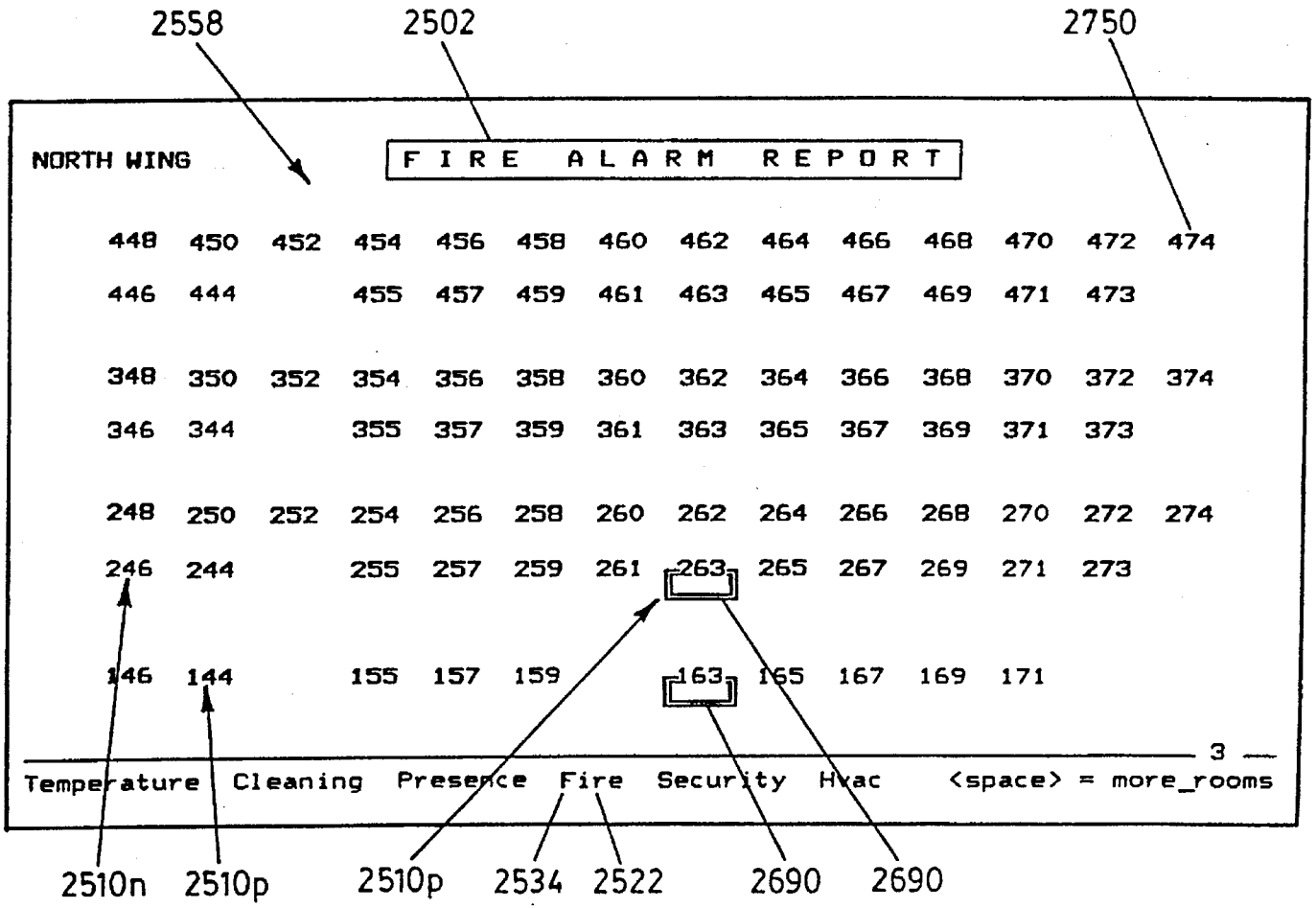
FIG. 57A is a representation of the Fire Alarm Screen showing a fire alarm emergency.
Figure 57B:
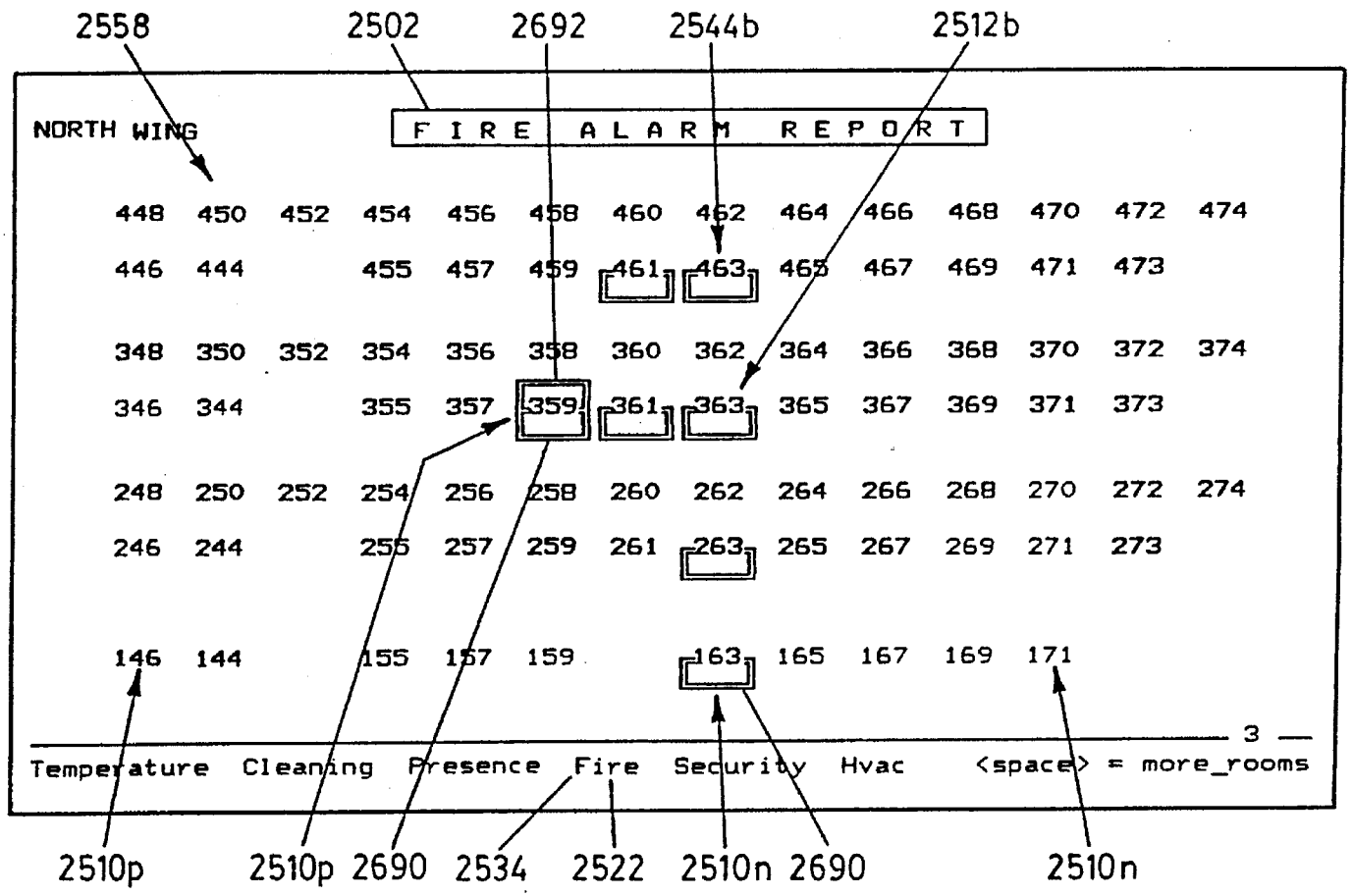
FIG. 57B is a representation of the Fire Alarm Screen showing the fire progression path in a building floor.

The Fire Alarm State Screen (FIGS. 57A, 57B)

The Fire Alarm state screen 2558 is one of the most important screens 2500 displayed by the central computer 170 and the remote terminals 174. The Fire Alarm screen 2558 notifies the authorities and hotel staff of a fire alarm in the rooms 10.

The Fire Alarm screen 2558 can be accessed in two ways. First, in emergency mode, the control program 586 automatically displays the Fire Alarm screen 2558, thereby overriding the present screen state 2500. Second, in normal mode, the Fire Alarm screen 2558 can be accessed by entering the letter 2534 which corresponds to the fire alarm command 2522 as shown in FIGS. 57A, 57B. It follows that in normal mode, there would be no alarms displayed on the Fire Alarm screen 2558.

Referring to FIG. 57A, rooms 10 with someone present are displayed using the room icons 2510*p* which appear in the presence color code (green) and with the corresponding room identifier 2750. Rooms 10 with no presence are also displayed using the room icons 2510*n* and corresponding room identifier 2750, but in a different color code (e.g. light brown).

A fire alarm condition in a room 10 is indicated by displaying the lower and upper frames 2690, 2692. The lower frame 2690 brackets a room icon 2510*p* when there is a fire in the room 10. The upper frame brackets the room icon 2510 (not shown) when there is a fire in ceiling above the room 10. If there is both a ceiling and room fire in the room 10, then both frames 2690,2692 bracket the room icon 2510*p*.

As shown in FIG. 57A, the room icon 2510*p*, displayed in the presence color code and bracketed by the frame 2690, alerts authorities that the room 10 corresponding to the room identifier 2750 must be evacuated. Similarly in FIG. 57B, the room icon 2510*p*, displayed in the presence color code and bracketed by both frames 2690,2692, alerts authorities that the room 10 corresponding to the room identifier 2750 must be evacuated. However, the rooms 10 corresponding to room icons 2510*n* displayed with a fire alarm condition but in the non-presence color code need not be evacuated by the authorities because there are no trapped people. Thus, the Fire Alarm screen 2558, which shows both fire and presence on the same screen 2500, allows the authorities to evacuate the rooms 10 in a most efficient manner.

The graphic patterns resulting from the display of rows 2512 and columns of rooms 10 in the fire alarm condition can be used to determine the progression path of the fire. Referring to FIG. 57B, the row 2512*b* indicates a fire which is progressing horizontal along the building floor. Similarly, a column 2544*b* of room icons 2510, which show ceiling fires, indicates a fire which is progressing vertically through a stack of rooms. The fire authorities can use the fire progression path information to effectively extinguish the fire.

In addition, since the graphic display shows the presence of people where there is not yet a fire but where the fire is likely to spread, people in the path of the fire can be evacuated with a higher priority.

Figure 58:
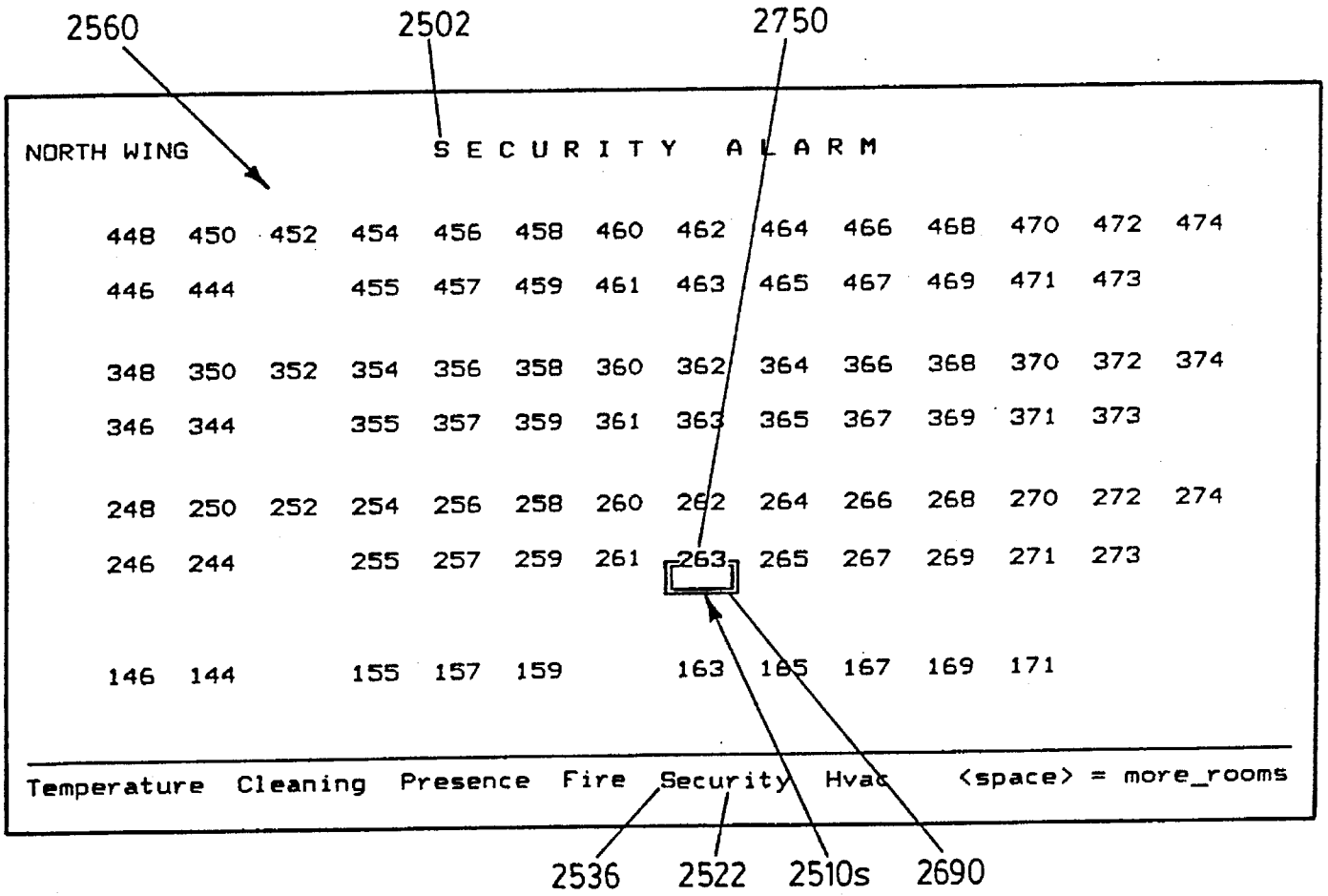
FIG. 58 is a representation of the Security Alarm Screen showing a security breach in a room.

The Security Alarm State Screen (FIG. 58)

The Security Alarm state screen 2560 alerts the authorities that there has been a security breach in a room 10. The screen 2560 can be accessed by entering the letter 2536 which corresponds to the security command 2522.

A security breach in a room 10 appears as a lower frame 2690 bracketing the room icon 2510*s* in which the breach occurred. The color of the room icon 2510*s* and frame 2690 match the color of identifier letter 2536 for the security command 2522 (e.g. high contrast light purple).

As shown in FIG. 58, the room icons 2510 are displayed with the corresponding room identifiers 2750. The displayed room identifier 2750 allows the the authorities to easily ascertain the location of the security alarm.

Figure 59:
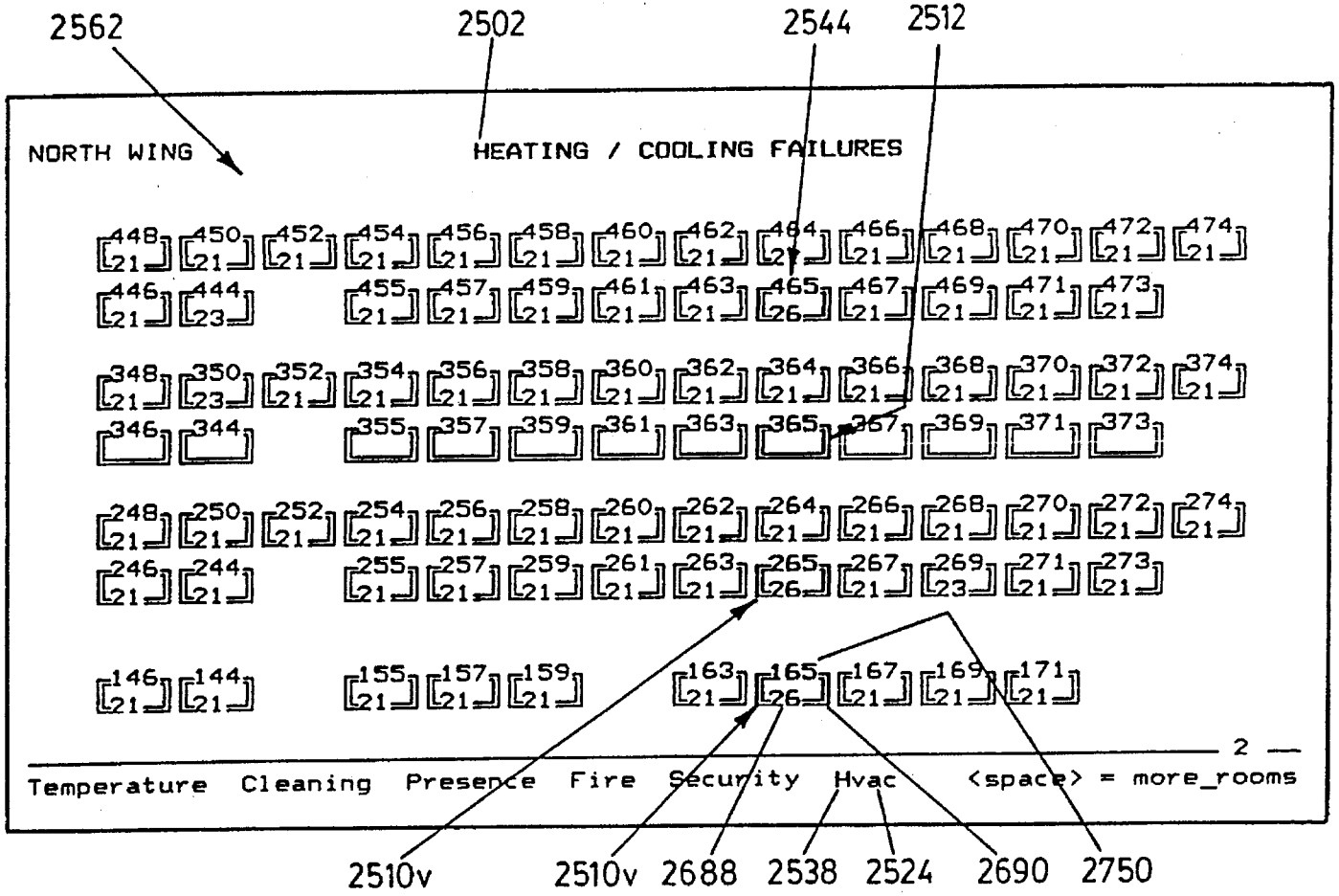
FIG. 59 is a representation of the HVAC Equipment Failure Screen showing failure of a vertical cooling main.

The HVAC Equipment Failure State Screen (FIG. 59)

The HVAC Equipment Failure state screen 2562 displays rooms 10 in which there are equipment failures. The HVAC Failure screen 2562 is accessed by entering the letter 2538 which corresponds to the HVAC command 2524.

Referring to FIG. 59, the room icon 2510 is displayed with the room identifier 2750 and the lower frame 2690. However, unlike the other state screens using the frame 2690, the display of the frame 2690 does not represent an exception condition. Rather, the frame 2690 is used to present the user requested temperature 2688 for the particular room 10 corresponding to the identifier 2750.

As shown in FIG. 59, an HVAC equipment failure in a room 10 is shown by highlighting the corresponding room icon 2510*v*, room identifier 2750 and lower frame 2690. The highlighted color matches the color of the HVAC identifier letter 2538. As shown in FIG. 59, the color of the title field 2502 also matches the color of the HVAC identifier letter 2538, thus emphasizing the failure state of the highlighted room icon 2510.

Referring still to FIG. 59, the graphic depiction of the room icons 2510 using rows 2512 and columns 2544 allows maintenance staff to trace failures in vertical and horizontal electrical mains, heating/cooling ducts, and hot/cold water lines.

Figure 60:
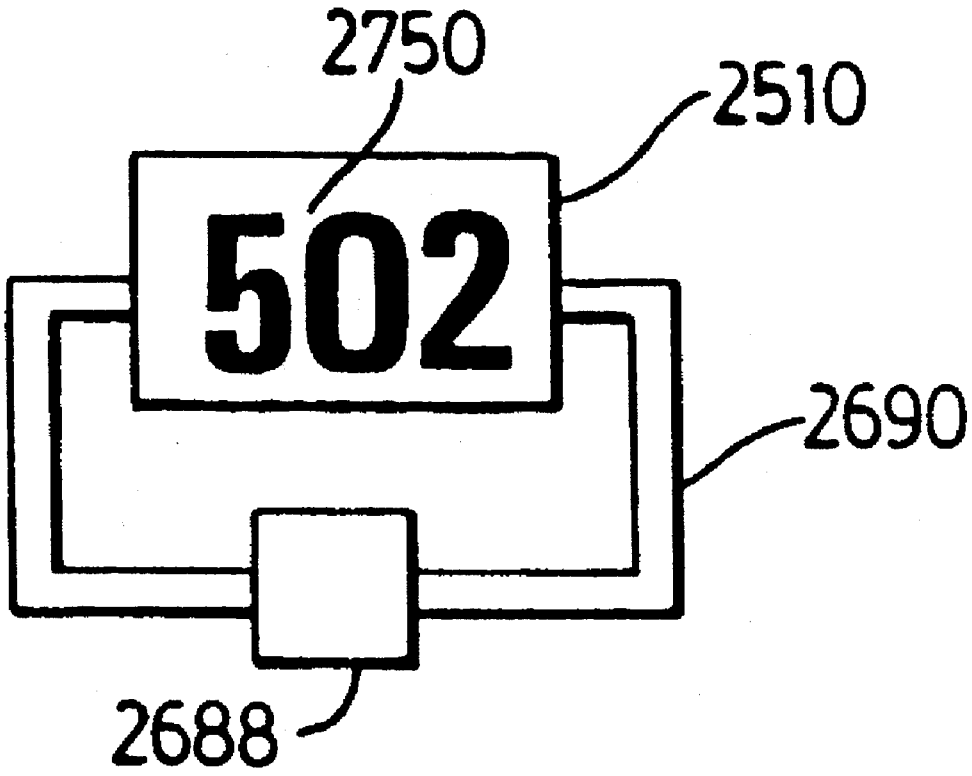
FIG. 60 is a diagrammatic representation of a predicted HVAC equipment failure.

Referring to FIG. 60, a predicted HVAC equipment failure is indicated by only highlighting the room identifier 2750. The lower frame 2690 and user request 2688 are displayed in same color as for a non-failure condition.

I claim:

1. A method of setting a fire alarm in a building having a number of rooms, each room having a fire sensor adapted to provide an indication of whether there is a fire in the room, said method comprising determining if fire indications have been provided for one or more rooms, and if fire indications have been set for more than one room then immediately providing a fire alarm, but if a fire indication has been provided for only one room, then providing a fire alarm only if said fire indication continues for a short selected period of time, thereby to reduce the likelihood of false alarms.

2. A method according to claim 1 wherein each room contains at least two of a rate of heat rise sensor, a maximum temperature sensor and a smoke sensor, said sensors comprising the fire sensor in each room, said method comprising the step of determining whether there are fire indications from more than one sensor in a room, and if so then providing a fire alarm immediately without waiting said short selected period of time.

3. A method according to claim 1 and including the step of determining whether there is a fire alarm for more than a predetermined number of rooms in said building, and if so, then providing a visual indication outside each room in which a person is present, to indicate to a person outside the room the presence of a person in the room.

4. A method according to claim 1 and including the step of determining whether there is a fire alarm for more than a predetermined number of rooms in said building, and if so, then providing a visual indication outside each room in which a person is present, to indicate to a person outside the room the presence of a person in the room, and providing a different visual indication outside each room if no person is present in the room, to indicate to a person outside the room whether the visual indications are functioning.

5. A method according to claim 1 and including the step of determining .whether there is a fire alarm for more than a predetermined number of rooms in said building, and if so, then providing a visual indication outside each room in which either a person or a fire is present.

6. A method of indicating to firefighting and other personnel whether a room is occupied in a building having a plurality of rooms, each room having presence sensing means therein to sense the presence or absence of a person in said room, there being a passage area outside but immediately adjacent each room, said building having a fire alarm, there being an indicating light in said passage area immediately adjacent each room, said method comprising determining when said fire alarm has been operated, and if said fire alarm has been operated, then operating said indicating lights outside those rooms in which a person is present to indicate to a person in said passage area the presence of a person in said room.

7. A method according to claim 6 wherein said method comprises flashing said indicating light in said passage areas adjacent rooms in which a person is present.

8. A method according to claim 7 wherein there is a second indicating light in each passage area and of a colour different from that of said first mentioned indicating light, said method comprising, when said alarm has been operated, then flashing said first mentioned indicating light if a person is present in said room and operating said second indicating light steadily if no person is present in said room.

9. A method according to claim 8 wherein said first mentioned light is flashed if there is a person present in said room or if there is a fire in said room.

10. A method according to claim 8 wherein said first mentioned light is red and said second light is green.

11. A method according to claim 6 wherein each said room includes temperature controlling means, and including the steps of determining, utilizing said presence sensing means, whether or not a person is present in said room and then setting back the temperature of said room if no person is present in said room.

12. A method according to claim 6 and including the steps of displaying a presence indication when a person is present in the room, and when such person has left the room leaving the room vacant then continuing to display said presence indication for a first predetermined period of time thereafter, then setting off said presence indication at the end of said first predetermined period and timing a second predetermined period from the end of said first predetermined period, determining whether a fire alarm is operated during said second predetermined period, and if said fire alarm is operated during said second predetermined period, then restoring the display of said presence indication.

13. A method of indicating the presence or absence of persons in a group of rooms, each room having means for determining the presence of a person therein, said method comprising displaying on a screen a map of said rooms with each room identified by its number, indicating on said map each room where a person is present by differentiating the display for such room from the display of rooms where no person is present, and including the step, if there is a fire in a room, of further displaying an indication of said fire in the display for such room, so that both presence and fire are indicated on the same screen.

14. A method according to claim 13 wherein the display of a room number is in one colour if a person is present in the room and is in a second and different colour if no person is present in the room, and wherein said indication of fire is provided by associating a line of a third colour adjacent the number of such room, said third colour contrasting with said first and second colours.

* * * * *